US011300348B2

(12) United States Patent
Park et al.

(10) Patent No.: US 11,300,348 B2
(45) Date of Patent: Apr. 12, 2022

(54) REFRIGERATOR

(71) Applicant: LG Electronics Inc., Seoul (KR)

(72) Inventors: Yoomin Park, Seoul (KR); Jinho Son, Seoul (KR); Changwon Eom, Seoul (KR); Myeongha Yi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/922,497

(22) Filed: Jul. 7, 2020

(65) Prior Publication Data

US 2020/0340728 A1 Oct. 29, 2020

Related U.S. Application Data

(63) Continuation of application No. 15/862,350, filed on Jan. 4, 2018, now Pat. No. 10,731,911.

(30) Foreign Application Priority Data

Jan. 4, 2017 (KR) ..... 10-2017-0001597
May 12, 2017 (KR) ..... 10-2017-0058980

(51) Int. Cl.
*F25D 11/02* (2006.01)
*F25B 21/04* (2006.01)
(Continued)

(52) U.S. Cl.
CPC ..... *F25D 11/02* (2013.01); *F25B 21/04* (2013.01); *F25D 11/025* (2013.01); *F25D 19/04* (2013.01);
(Continued)

(58) Field of Classification Search
CPC ..... F25D 11/02; F25D 2317/061; F25D 2700/122; F25D 21/08; F25D 19/04;
(Continued)

(56) References Cited

U.S. PATENT DOCUMENTS

2009/0056366 A1* 3/2009 Cho ..... F25D 21/14 62/441
2012/0304667 A1* 12/2012 Shin ..... F25D 11/025 62/3.6
2016/0370052 A1 12/2016 Yang

FOREIGN PATENT DOCUMENTS

DE 202014010502 10/2015
EP 2530408 12/2012
(Continued)

OTHER PUBLICATIONS

KR Office Action in Appln. No. 10-2017-0058980, dated Feb. 1, 2021, 10 pages (with English translation).
(Continued)

*Primary Examiner* — Steve S Tanenbaum
(74) *Attorney, Agent, or Firm* — Fish & Richardson P.C.

(57) ABSTRACT

A refrigerator includes a storage space, a freezing chamber defining an insulating space configured to maintain a chamber temperature independent from the storage space, an evaporator in the storage space, a grille panel assembly that defines an evaporator space configured to accommodate the evaporator and at least a portion of the storage space, a thermoelectric element assembly including a thermoelectric element, a heat sink, and a cold sink to cool the freezing chamber to a temperature less than the temperature of the storage space, a module accommodation portion located at a side of the grille panel assembly, a defrost water guide that communicates with the module accommodation portion and the evaporator space and that is configured to discharge defrost water generated during a defrost operation of the freezing chamber, and a defrost heater located in the module accommodation portion and configured to melt ice during the defrost operation.

17 Claims, 36 Drawing Sheets

(51) Int. Cl.
*F25D 21/08* (2006.01)
*F25D 19/04* (2006.01)

(52) U.S. Cl.
CPC ..... *F25D 21/08* (2013.01); *F25D 2317/061* (2013.01); *F25D 2323/021* (2013.01); *F25D 2700/122* (2013.01)

(58) Field of Classification Search
CPC .... F25D 11/025; F25D 17/065; F25D 23/069; F25D 23/062; F25D 25/025; F25D 2323/021; F25D 23/087; F25B 21/04; F25B 2321/0251; F25B 2341/062; F25B 5/02; F25B 2321/023; F25B 21/02; Y02B 40/34; H01L 35/00; H01L 37/00
USPC ..... 62/441
See application file for complete search history.

(56) References Cited

FOREIGN PATENT DOCUMENTS

| | | |
|---|---|---|
| EP | 2787308 | 10/2014 |
| JP | H07301479 | 11/1995 |
| KR | 1020090006419 | 1/2009 |
| KR | 1020140119444 | 10/2014 |
| KR | 1020160097648 | 8/2016 |
| WO | 2016129906 | 8/2016 |

OTHER PUBLICATIONS

European Extended Search Report in European Application No. 18150130.5, dated Jul. 18, 2018, 9 pages.

* cited by examiner

REFRIGERATOR

CROSS-REFERENCE TO RELATED APPLICATIONS

The present application is a continuation of U.S. application Ser. No. 15/862,350, filed on Jan. 4, 2018, which claims priority under 35 U.S.C. 119 and 35 U.S.C. 365 to Korean Patent Application No. 10-2017-0001597, filed on Jan. 4, 2017 and Korean Patent Application No. 10-2017-0058980, filed on May 12, 2017. The disclosures of the prior applications are incorporated by reference in their entirety.

BACKGROUND

The present invention relates to a refrigerator having a deep-temperature freezing chamber.

A typical refrigerator is a household appliance that stores food at a low temperature and can be divided into a refrigerating chamber and a freezing chamber depending on the temperature of the food stored in the refrigerator. Typically, the refrigerating chamber generally keeps a temperature of 3° C., to 4° C., and the freezing chamber generally keeps a temperature of about −20° C.

A freezing chamber with a temperature of about −20° C. is a space in which food is kept in a state of being frozen and is often used by consumers to store food for a long period of time. However, in the existing freezing chamber which keeps a temperature of about −20° C., there are problems that when the meat or seafood is frozen and the water in the cell is frozen, the water is discharged out of the cell and the cell is destroyed, and thus the original taste thereof is lost or texture thereof is changed when the meat or the seafood is cooked after thawing.

On the other hand, there are advantages that when meat, seafood, or the like is frozen, a temperature range of the freezing point where the ice forms in the cell is rapidly passed and the cooling thereof is done, the cell destruction can be minimized and, the quality and the texture of the meat are freshly renewed or reproduced and thus cooking is delicious, after thawing.

Because of this, high-end restaurants use deep-temperature freezers that can rapidly freeze meat, fish, seafood, or the like. However, unlike restaurants that need to preserve large quantities of food, it is unlikely to purchase deep-temperature freezers such as those used in restaurants since it is not always necessary to use a deep-temperature freezer in regular homes.

However, as the quality of life has improved, consumers' desire to eat more delicious foods has become stronger, and thus consumers who want to use deep-temperature freezers have increased.

In order to meet the needs of such consumers, there has been developed a household refrigerator in which a deep-temperature freezing chamber is installed in a portion of the freezing chamber. It is preferable that the deep-temperature freezing chamber satisfies a temperature of about −50° C., and such a cryogenic temperature is a temperature that cannot be reached only by a refrigeration cycle using a typical refrigerant.

Accordingly, household refrigerators are developed in which includes a separate deep-temperature freezing chamber in which the food is cooled to a temperature of −20° C. by a refrigeration cycle and is cooled to a temperature lower than −20° C. by a thermoelectric element (TEE).

However, since the difference in temperature between a freezing chamber of −20° C. and a deep-temperature freezing chamber of −50° C. is considerably large, if structures such as insulation, defrosting, and cold supply which is applied to a design of the existing freezing chamber are applied to the deep-temperature freezing chamber, as it were, it is not easy to implement a temperature of −50° C.

On the other hand, in the space of the deep-temperature freezing chamber, there is a cooling portion which is cooler than the deep-temperature freezing chamber and if condensation occurs in this portion, the condensation needs to be removed. However, since the temperature inside the deep-temperature freezing chamber is much lower than the temperature of the freezing chamber, which is the space outside the deep-temperature freezing chamber, as well as the melting point of water, it is unlikely to make defrosting smooth.

In addition, when excessive heating of the cooling portion of the deep-temperature freezing chamber for defrosting, since the excessive heating thereof may adversely affect the environment of the deep-temperature freezing chamber, a technique that can minimize the adverse effect is required.

In addition, a phenomenon is also an evitable problem which the defrost water is re-frozen by exposing the defrost water to the cryogenic environment in a process of discharging the defrost water generated by defrosting in the deep-temperature freezing chamber. In addition, it is also very difficult to implement a structure for discharging the defrost water.

Also, the cryogenic environment of the deep-temperature freezing chamber generates an excessive negative pressure inside the deep-temperature freezing chamber and a structure for relieving the negative pressure while minimizing the cold loss in the deep-temperature freezing chamber is required.

In addition, when the deep-temperature freezing chamber is provided while occupying the space of the freezing chamber itself, it is necessary to minimize the volume occupied by the structure for cooling and circulating the cooling air in the deep-temperature freezing chamber since a decrease in the volume capacity of the freezing chamber has to be minimized.

In particular, in a case where a cryogenic temperature is implemented by using a thermoelectric element, heat exchange is generated smoothly on both the heat absorption side and the heat generation side of the thermoelectric element, and the cooling air cooled through heat exchange on the heat absorption side has to be circulated smoothly, and heat exchange loss or flow loss shall not be generated while having a simple structure as possible.

In addition, there is a concern that the flow rate and the pressure distribution of the grille panel assembly structure of the related art may change, and the freezing of the freezing chamber may not be performed smoothly, due to the volume occupied by the thermoelectric element and the components relating thereto which are installed to implement the cryogenic temperature.

SUMMARY

The present invention relates to a configuration for cryogenic temperature cooling and an object thereof is to provide a refrigerator that has a defrosting structure of a deep-temperature freezing chamber which does not harm a cryogenic atmosphere of a deep-temperature freezing chamber while reliably defrosting a configuration exposed to the environment of the deep-temperature freezing chamber.

An object of embodiments of the present invention is to provide a refrigerator that has negative pressure relieving structure of the deep-temperature freezing chamber which eliminates the negative pressure in a deep-temperature freezing chamber that is generated in a cryogenic environment but does not damage a cryogenic atmosphere of a deep-temperature freezing chamber.

An object of embodiments of the present invention is to provide a refrigerator that can simplify the structure by implementing the defrost structure and the negative pressure relieving structure in one configuration and minimize the volume occupied by the defrost structure and the negative pressure relieving structure.

An object of embodiments of the present invention is to provide a refrigerator that smoothly discharges defrost water during a defrosting operation of an independent deep-temperature freezing chamber that is cooled to a cryogenic state by a thermoelectric element in a storage space.

An object of embodiments of the present invention is to provide refrigerator that can prevent deterioration in performance due to the freezing of an independent deep-temperature freezing chamber which is cooled to a cryogenic state by a thermoelectric element in a storage space.

According to an embodiment of the present invention, there is provided a refrigerator including a main body in which a storage space is formed; a deep-temperature freezing chamber that forms a heat insulating space which is independent of the storage space; an evaporator that is provided inside the storage space and cools the storage space; a grille panel assembly which defines the storage space and a space in which the evaporator is accommodated; a thermoelectric element module assembly which is provided at one side of the deep-temperature freezing chamber and includes a thermoelectric element, a heat sink, and a cold sink to cool the deep-temperature freezing chamber to a temperature lower than that of the storage space; a thermoelectric element module accommodation portion that is formed at one side of the grille panel assembly and in which at least a portion of the thermoelectric element module assembly is accommodated; a defrost water guide that is formed to communicate the thermoelectric element module accommodation portion and the space in which the evaporator is accommodated with each other and discharges defrost water generated during a defrost operation of the deep-temperature freezing chamber; and a defrost heater which is provided in the thermoelectric element module accommodation portion and melts the ice driven and dropped during the defrosting operation.

During the defrosting operation, a reverse voltage may be applied to the thermoelectric elements to generate heat in the cold sink.

The thermoelectric element module accommodation portion may be provided with a cooling fan that adsorbs the air of the deep-temperature freezing chamber and exchanges heat with the thermoelectric element, and then forces the flow of air to be discharged to the deep-temperature freezing chamber.

The thermoelectric element module accommodation portion may be formed with an accommodation portion discharge port that communicates with the defrost water guide and a bottom surface of the thermoelectric element module accommodation portion may be inclined toward the accommodation portion discharge port.

The defrost water guide may communicate with the bottom surface of the thermoelectric element module accommodation portion and the defrost heater may be disposed on the bottom surface of the thermoelectric element module accommodation portion.

The defrost heater may be disposed on the bottom surface of the thermoelectric element module accommodation portion and may be located below the cold sink.

The defrost heater includes an accommodation portion heating portion that is bent a plurality of times and disposed along the bottom surface of the thermoelectric element module accommodation portion; and a guide heating portion that extends from one side of the accommodation portion heating portion to the inside of the defrost water guide.

The grille panel assembly may include a grille panel that forms a rear wall surface of the storage space and has an absorption port and a discharge port for cooling air; and a shroud that forms a wall surface of the space in which the evaporator is accommodated and is coupled in a state of being spaced apart from the grille panel to form a flow path of the cooling air.

The shroud can shield the thermoelectric element module accommodation portion and the thermoelectric element module assembly from behind.

The defrost water guide extends from the thermoelectric element module accommodation portion and further extends through the shroud to a space in which the evaporator is accommodated.

The shroud may be provided with a through-hole through which the defrost water guide passes, and the defrost water guide may be provided with a lower restraining protrusion protruding from the outside of the through-hole to restrain the defrost water guide from the outside of the through-hole.

The defrost water guide includes an extension portion that extends from the thermoelectric element module accommodation portion and guides the defrost water downward; and a rounded portion that is formed to be rounded from the end portion of the extension portion toward the evaporator and guides the defrost water to the evaporator side, in which the rounded portion can be formed on the outer side of the shroud.

The defrost water guide is formed such that the rear surface thereof is opened, and the opened rear surface by the shroud is shielded to form a closed flow path through which the defrost water flows.

The grille panel is provided with a guide mounting portion which is recessed so as to mount the defrost water guide, and a rear end of the defrost water guide and the rear surface of the grille panel can be positioned on the same plane in a state where the defrost guide is mounted on the guide mounting portion.

The rear surface of the defrost water guide is opened, and the opened rear surface of the defrost water guide can be shielded by the shroud when the shroud is mounted.

According to another aspect of the present invention, there is provided a refrigerator including: a storage space; a wall body that is positioned behind the storage space and defines a rear boundary of the storage space; a deep-temperature case that is provided inside the storage space and positioned on the front surface of the wall body; and a thermoelectric element module assembly that is positioned at a rear portion of the deep-temperature case and is positioned at a rear surface of a wall body corresponding to a front surface of the wall body where the deep-temperature case is positioned to supply cooling air to the deep-temperature case, in which the thermoelectric element module assembly includes a cooling fan, a cold sink, a thermoelectric element, and a heat sink in order from a front side to a rear side, in which a drain hole is formed in a lower portion of the cold sink for discharging defrost water generated when the cold sink is defrosted, and in which a bottom surface that is formed with a downwardly inclined slope for drain toward the drain hole is provided in a surrounding of the drain hole.

The drain hole is provided at the rear side of the wall body and the defrost water can be discharged to the outside of the deep-temperature freezing chamber through the drain hole.

A heating wire may be installed between a surface of the slope for drain and the drain hole and the heating wire can be disposed to cover an area larger than that corresponding to the cold sink.

Power can be also supplied to the heating wire while power is supplied to the thermoelectric element at least for defrosting the cold sink.

The power supplied to the heating wire may be cut off after being further supplied for a predetermined period after the power supplied to the thermoelectric element is cut off for defrosting the cold sink.

According to the embodiment of the present invention, as a configuration for cooling at a cryogenic temperature, defrosting with respect to the configuration exposed to the environment of the deep-temperature freezing chamber is surely carried out, but the cryogenic atmosphere of the deep-temperature freezing chamber is not damaged.

In addition, according to the present invention, the negative pressure inside the deep-temperature freezing chamber generated in a cryogenic environment is relieved, but the cryogenic atmosphere of the deep-temperature freezing chamber is not damaged.

In addition, the present invention implements the defrost structure and the negative pressure relieving structure in a single structure to simplify the structure and minimize the volume occupied by the defrost structure and the negative pressure relieving structure, which is advantageous for securing the internal space of the refrigerator.

The thermoelectric element module assembly for cooling the deep-temperature freezing chamber allows the heat sink to pass through the low-temperature refrigerant supplied to the evaporator, thereby increasing the temperature difference between the heat absorption surface and the heat generation surface of the thermoelectric element, and finally, the deep-temperature freezing chamber can implement a cryogenic temperature of about −40° C. to −50° C.

In addition, a reverse voltage is applied to the thermoelectric element during the defrosting operation of the deep-temperature freezing chamber to remove the frost and freezing formed on the cold sink side. In addition, the defrosting performance of the ice can be further improved by heating ice blocks inside the thermoelectric element module accommodation portion dropped from the cold sink with the defrost heater. In addition, through the complete defrosting, the cooling air supplied to the inside of the deep-temperature freezing chamber can smoothly flow, and the heat-exchanging performance of the cold sink can be also kept at the best condition.

There are advantages that the defrost heater is formed to extend to the inside of the defrost water guide to prevent ice pieces of a small size introduced into the defrost water guide from being frozen and a space can be secured in the inside of the defrost water guide so that flow of the defrost water is always smooth.

In addition, the defrost water guide can be kept a firmly fixed state on the grille panel, and even if the cooling air flows between the grille panel and the shroud at a high speed, the cooling air is prevented from flowing to prevent noise and keep the firmly fixed state thereof.

In addition, the defrost water guide extends from the inside of the thermoelectric element module accommodation portion to a space where the evaporator outside the shroud is accommodated, so that the defrost water does not flow into a space between the grille panel and the shroud and thus it is possible to prevent the defrost water from being frozen or the cooling air flow path from being blocked.

In addition, there is an advantage that the defrost water guide has an end that is formed to be rounded toward the evaporator side to guide the dropping defrost water toward the evaporator and noise generated when the defrost water drops can be prevented.

Figure 21:
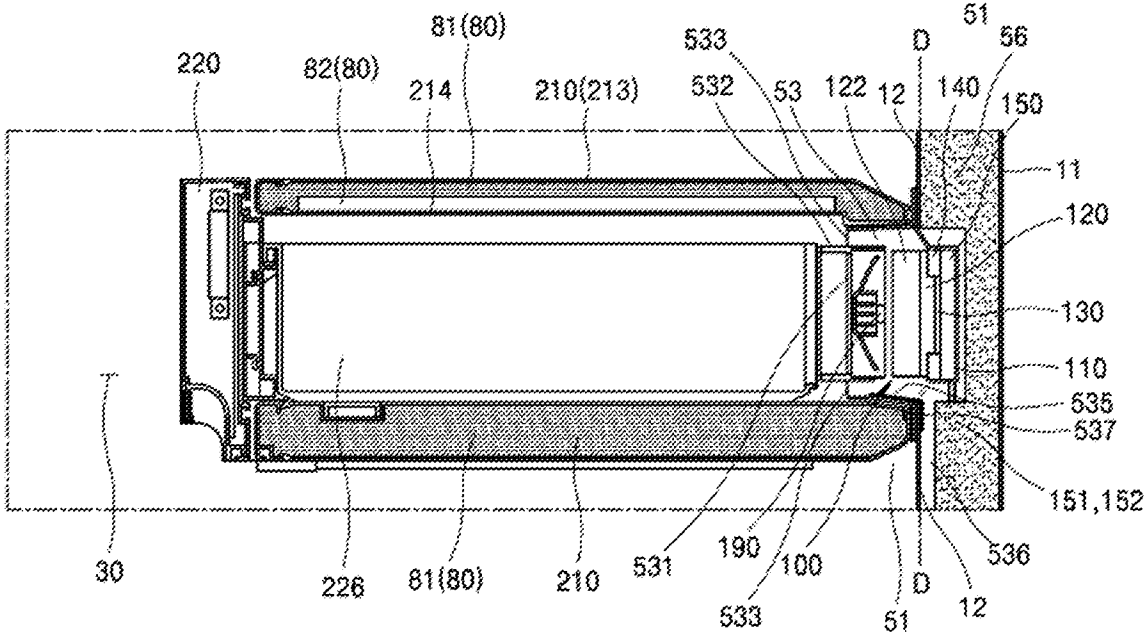

FIG. 21 is a side sectional view illustrating an example in which the deep-temperature freezing chamber of the present invention is installed in a refrigerating chamber.

Figure 22:
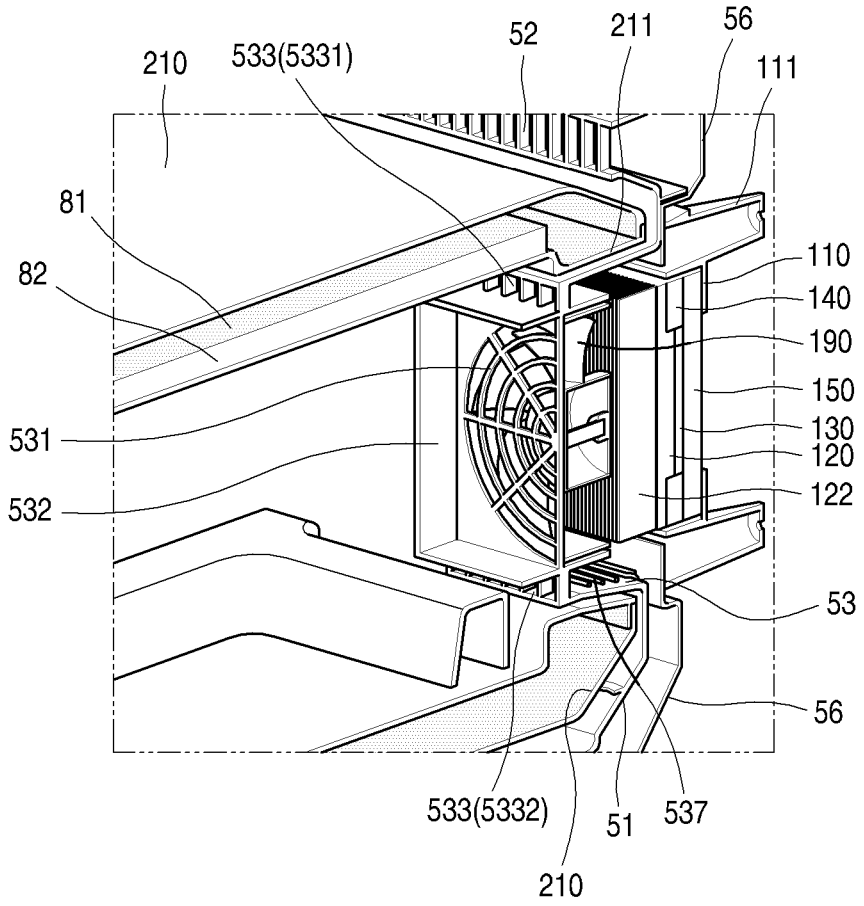

FIG. 22 is a side sectional perspective view illustrating a state where a thermoelectric element module assembly is installed in a grille panel assembly on which a deep-temperature case is mounted.

Figure 23:
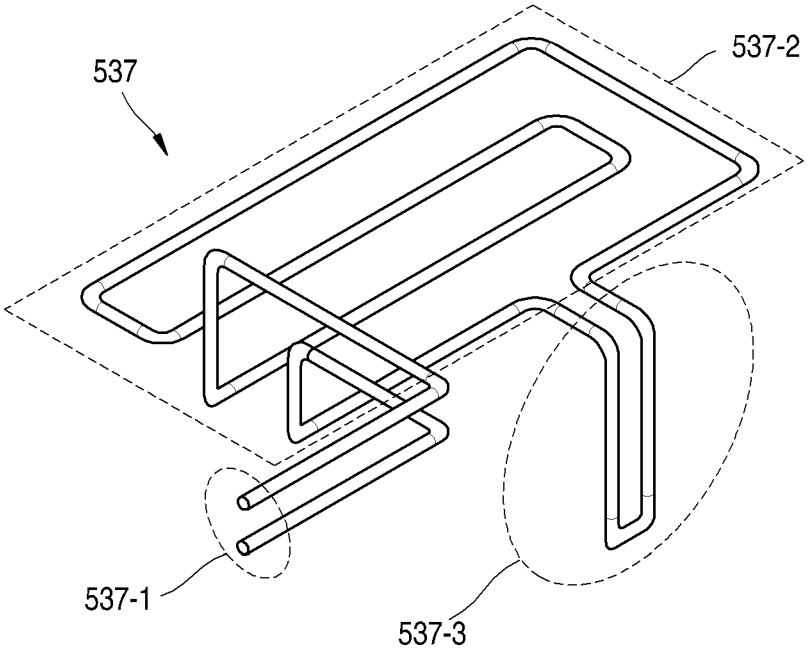

FIG. 23 is a perspective view illustrating only a shape of a heating wire.

Figure 11:
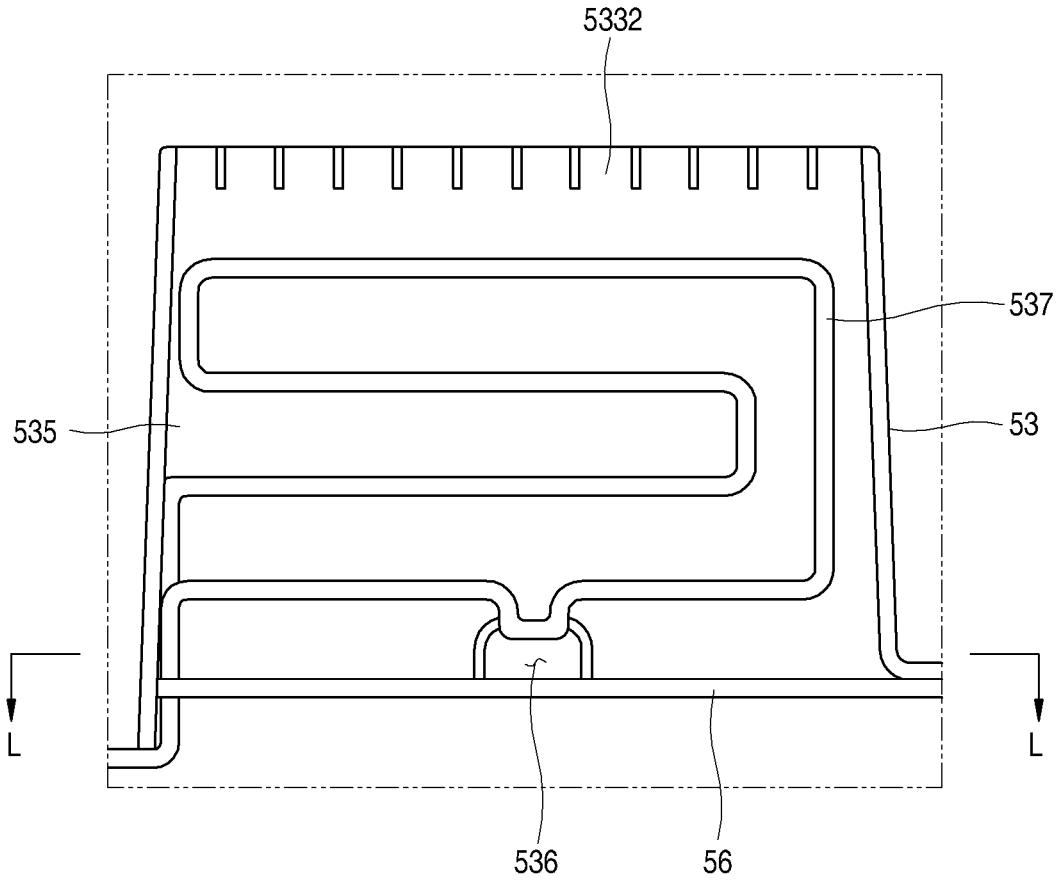
FIG. 11 is a sectional view taken along line X-X in FIG. 9.
Figure 24:
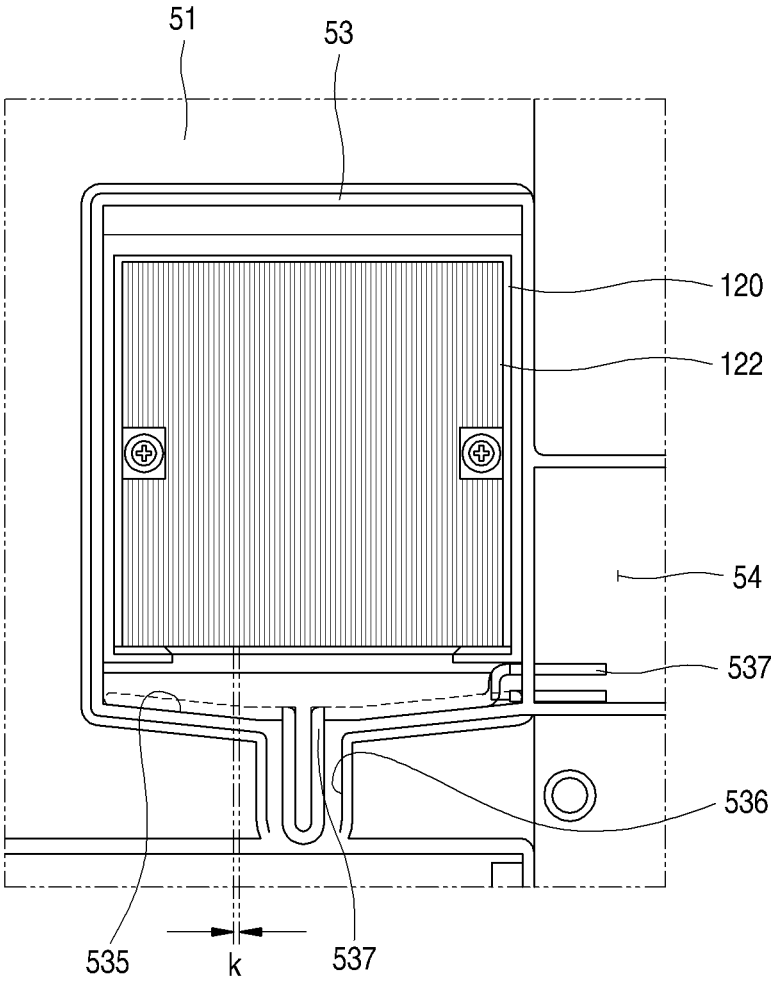

FIG. 24 is a sectional view taken along line L-L in FIG. 11 and illustrating a thermoelectric element module accommodation portion and a cold sink.

Figure 25:
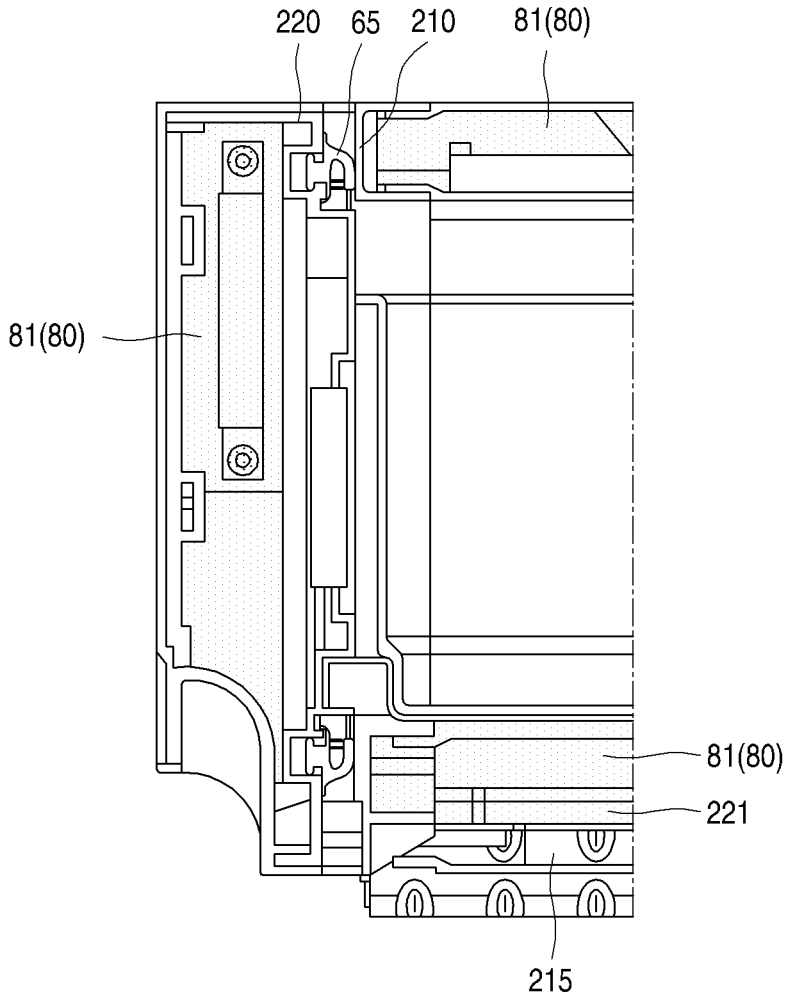

FIG. 25 is an enlarged side sectional view illustrating a state where the deep-temperature chamber door is closed in the deep-temperature case.

Figure 26:
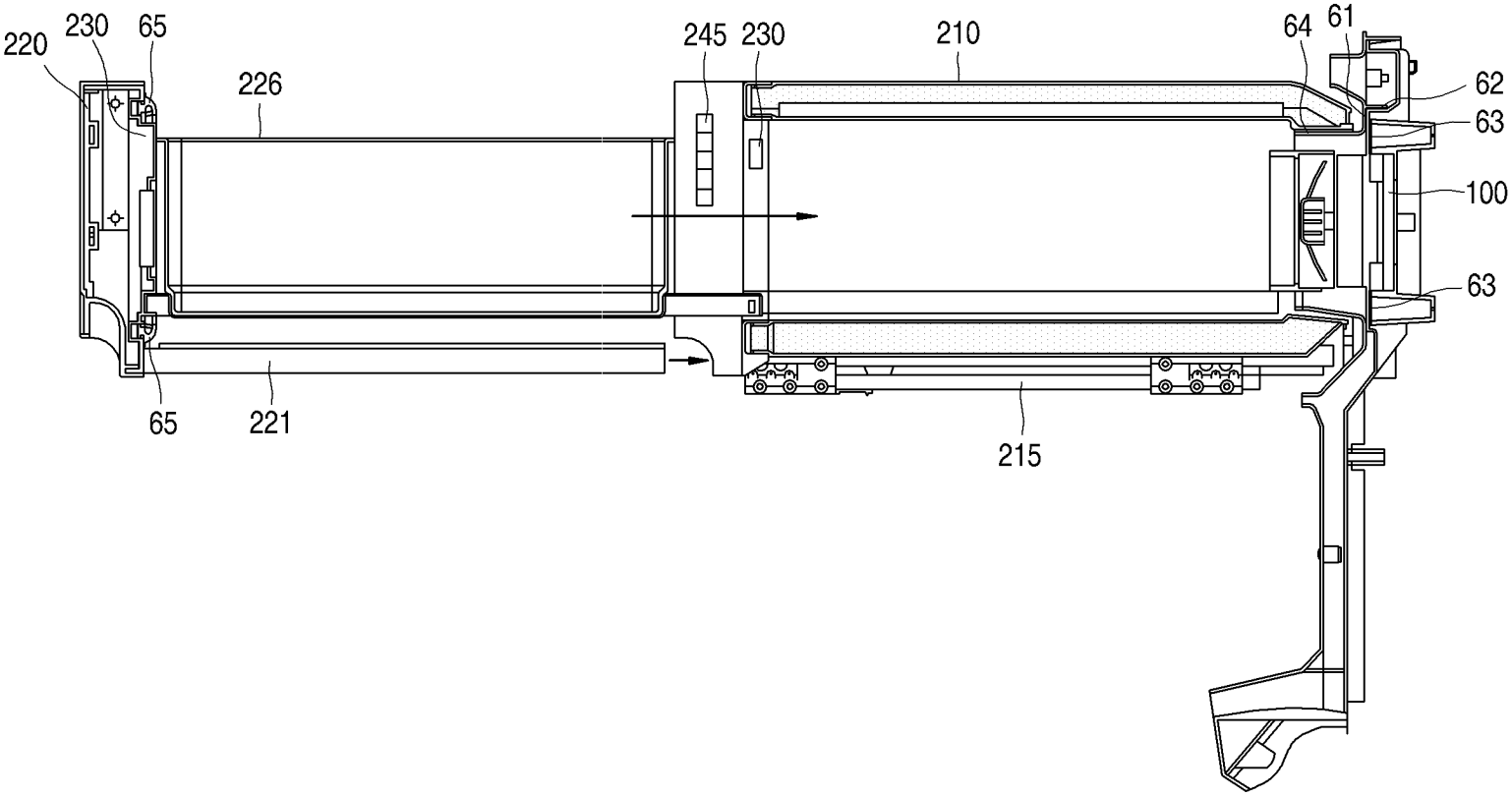

FIG. 26 is a side sectional view illustrating a state where a deep-temperature chamber door and a deep-temperature tray are pulled out of the deep-freezing case assembled in the grill assembly.

FIGS. 27A to 27D are views illustrating various modification examples of a drain hole according to the present invention.

Figure 28:
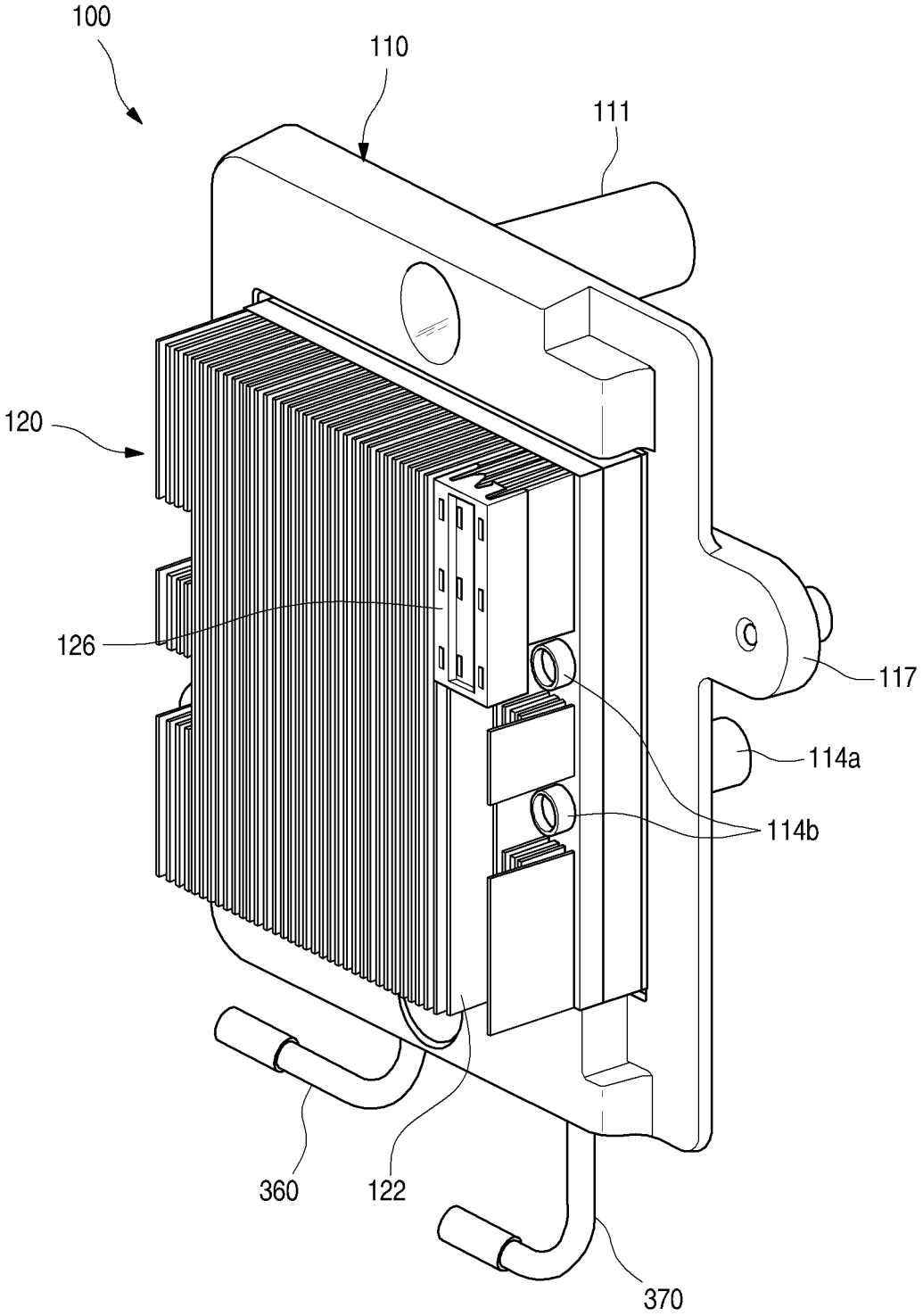

FIG. 28 is a perspective view of the thermoelectric element module assembly according to another embodiment of the present invention as viewed from the front.

Figure 29:
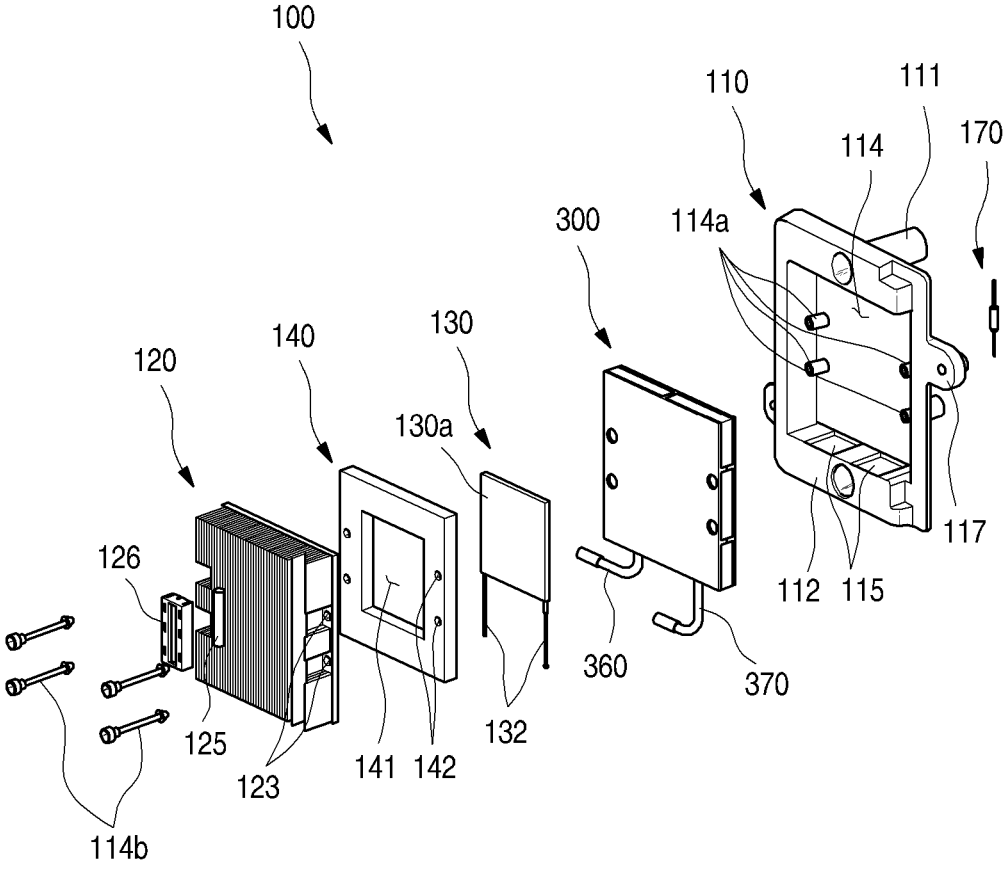

FIG. 29 is an exploded perspective view of the coupling structure of the thermoelectric element module assembly as viewed from the front.

Figure 30:
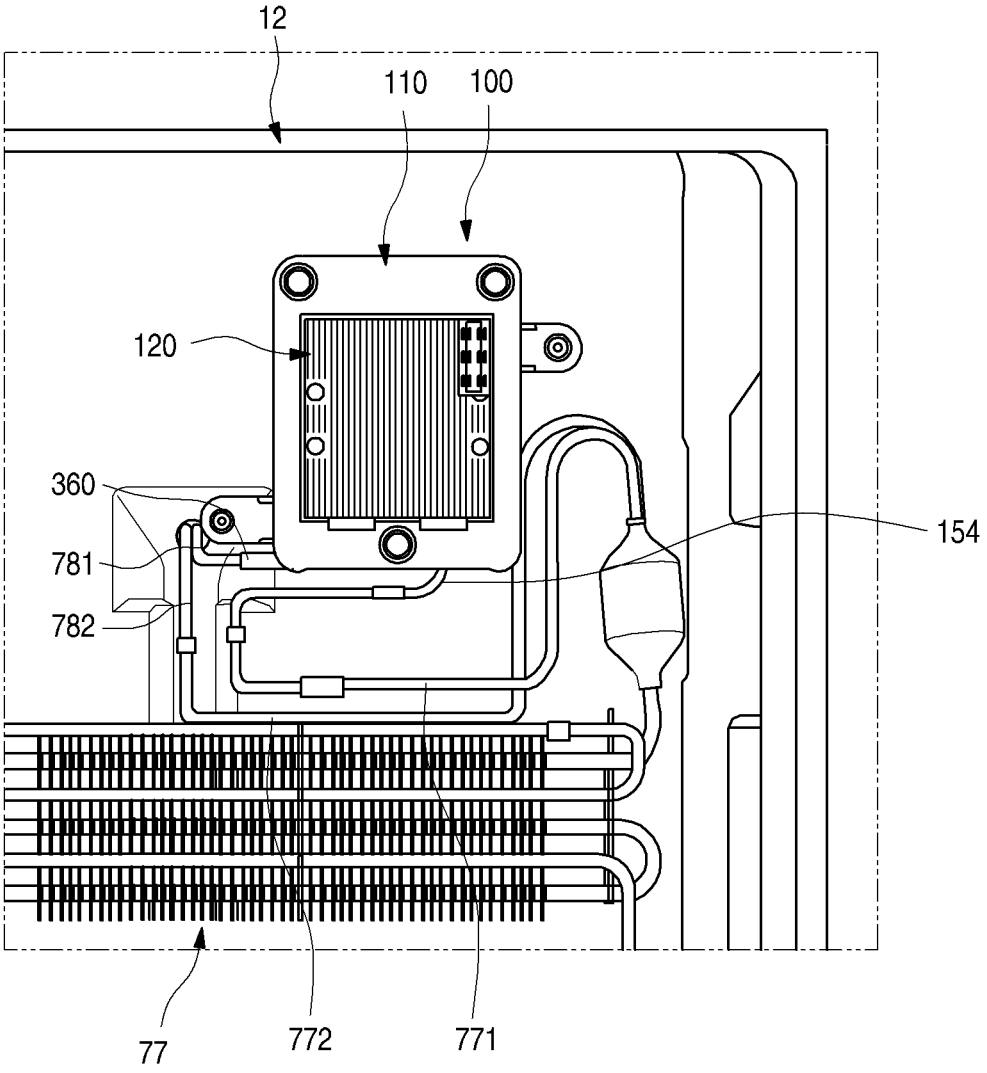

FIG. 30 is a view illustrating a connection state of a refrigerant pipe between the thermoelectric element module assembly and the evaporator.

Figure 31:
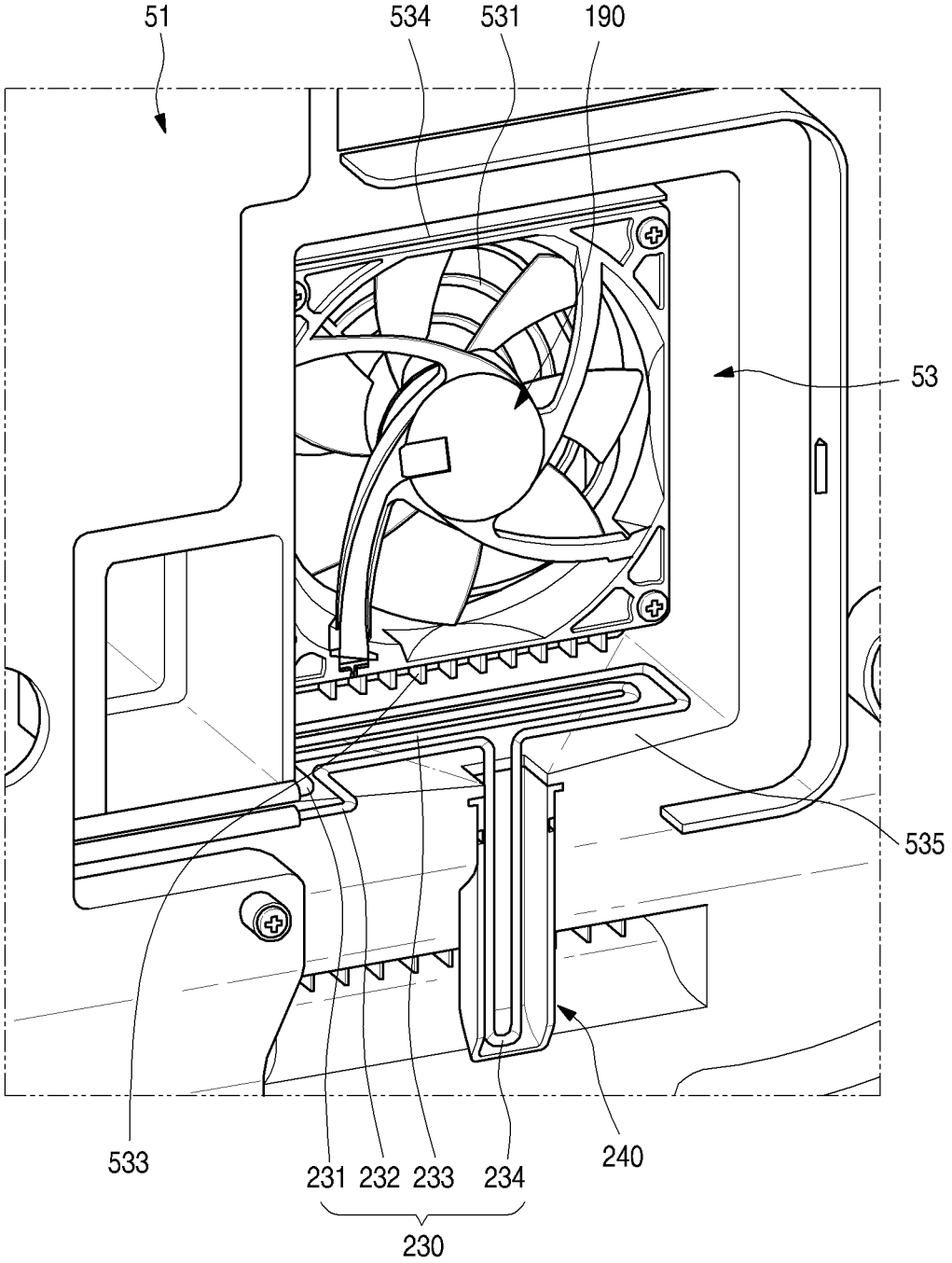

FIG. 31 is a partial perspective view illustrating the disposition of the defrost heater and the defrost water guide according to another embodiment of the present invention.

Figure 32:
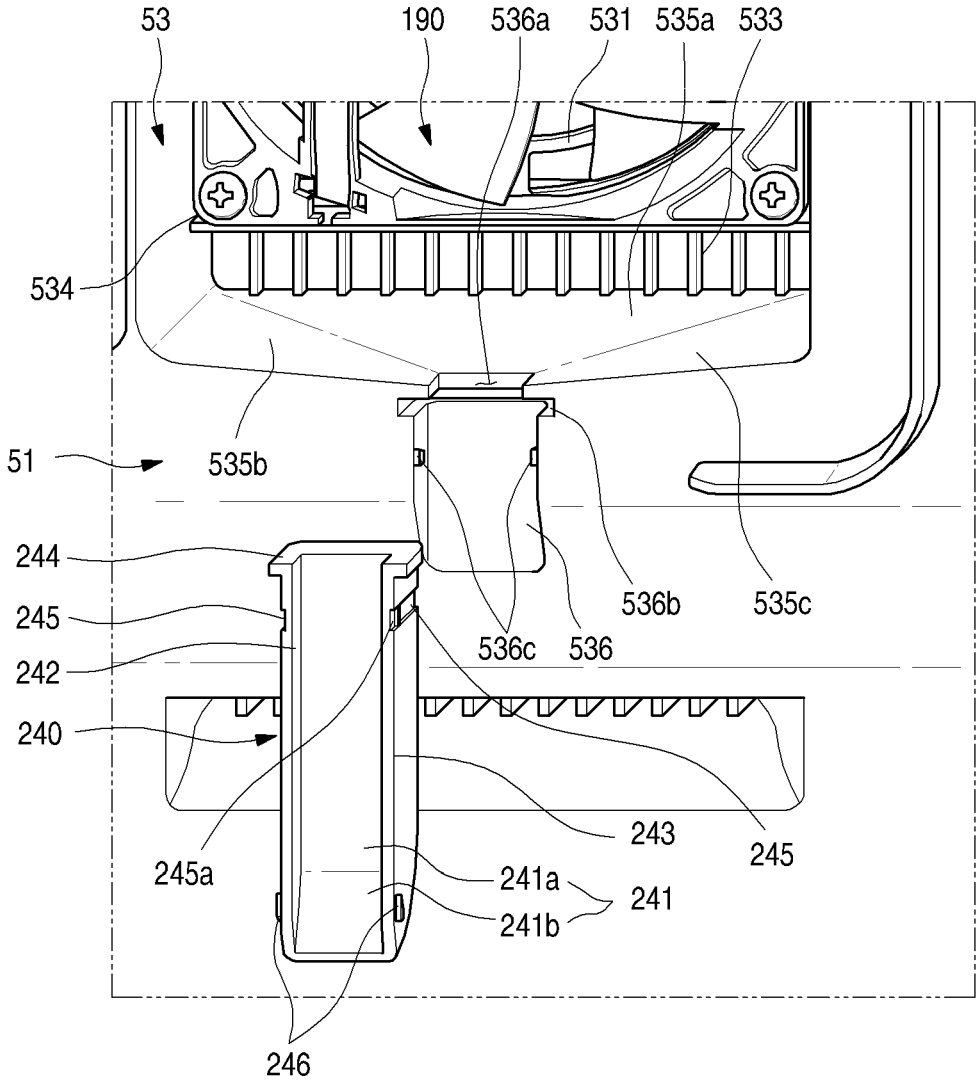

FIG. 32 is an exploded perspective view illustrating coupling structure of the defrost water guide.

Figure 33:
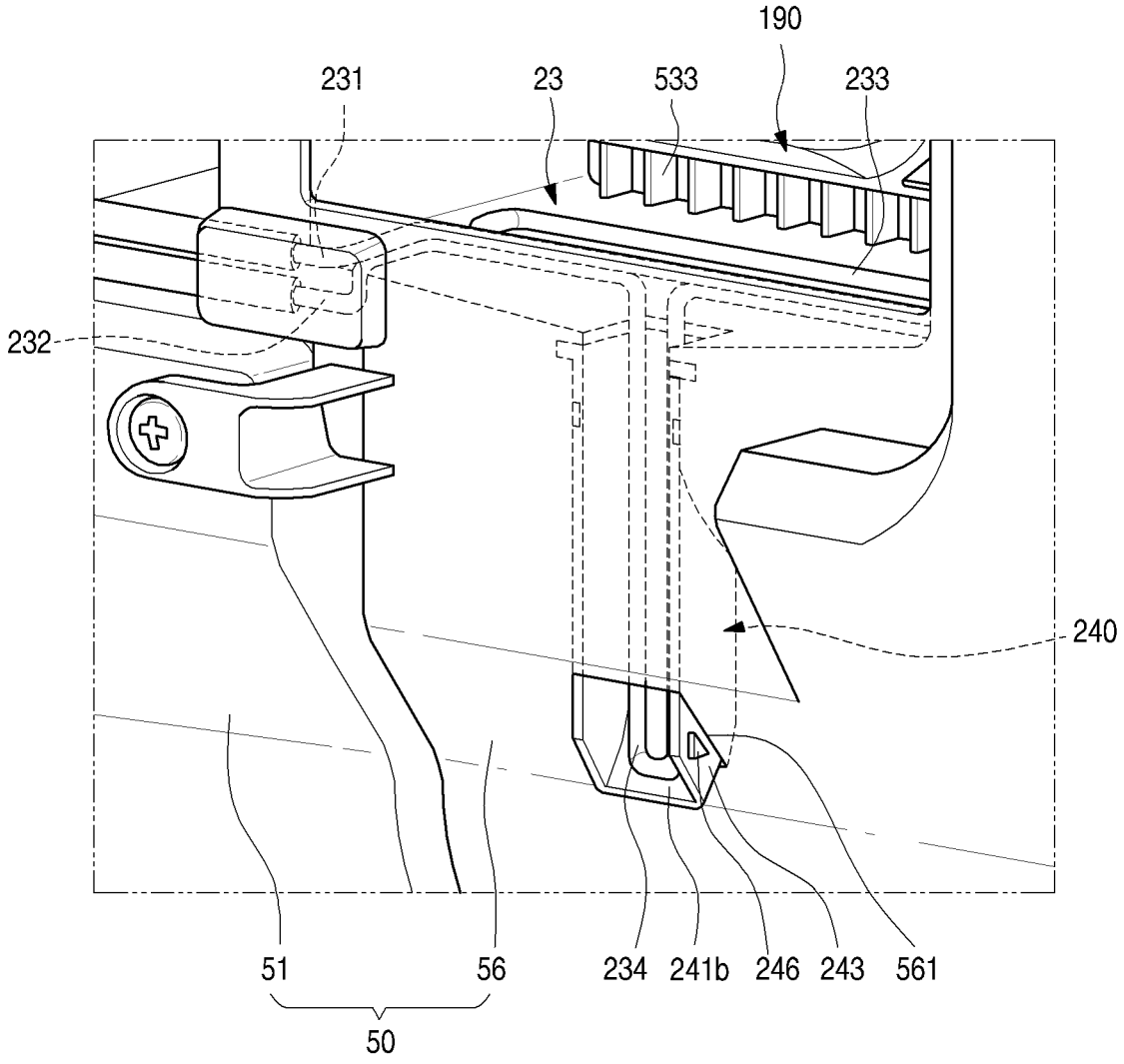

FIG. 33 is a partial perspective view illustrating a coupling structure of the grille panel assembly and the defrost water guide.

Figure 34:
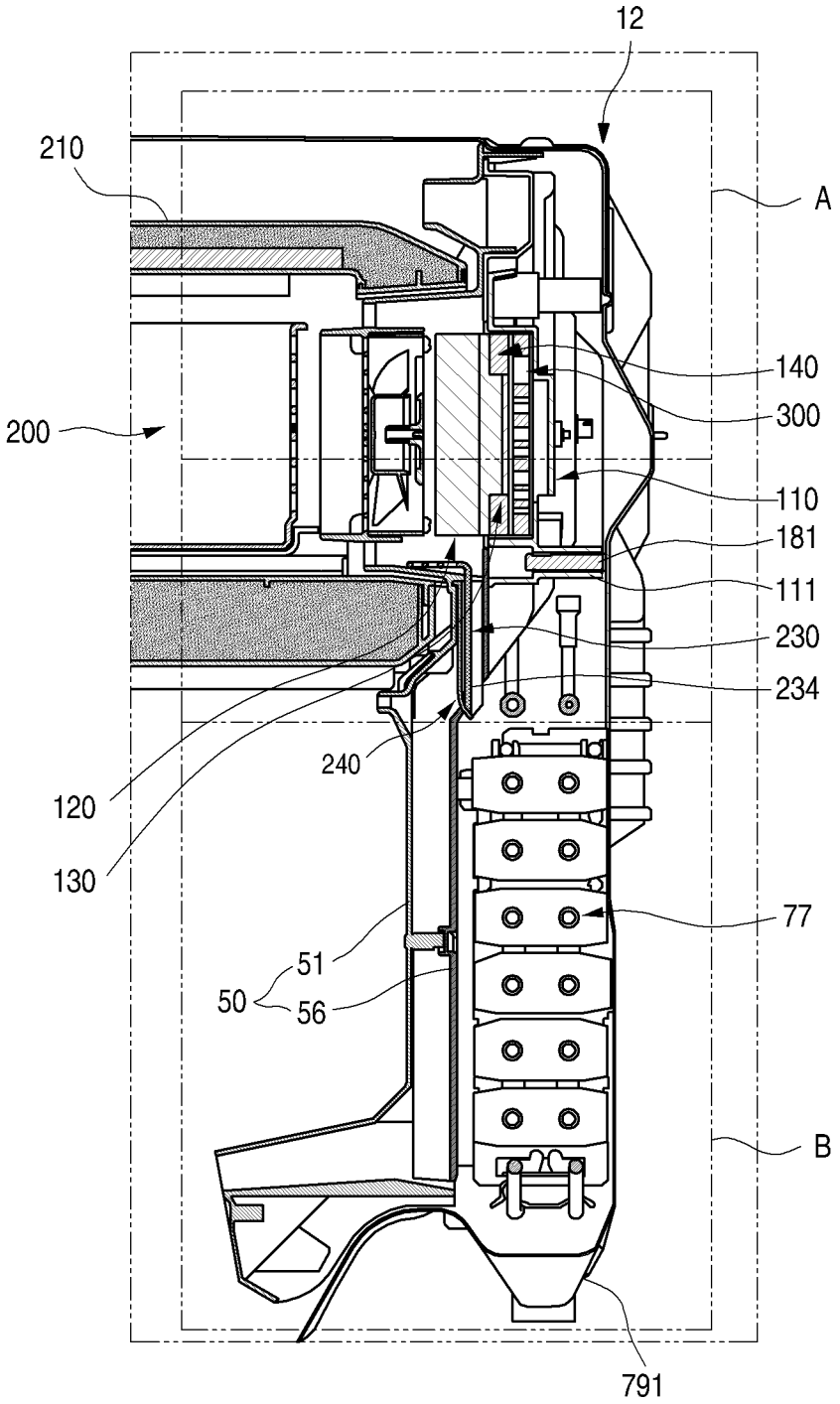

FIG. 34 is a view illustrating a state where the thermoelectric element module assembly and the grille panel assembly are coupled.

Figure 35:
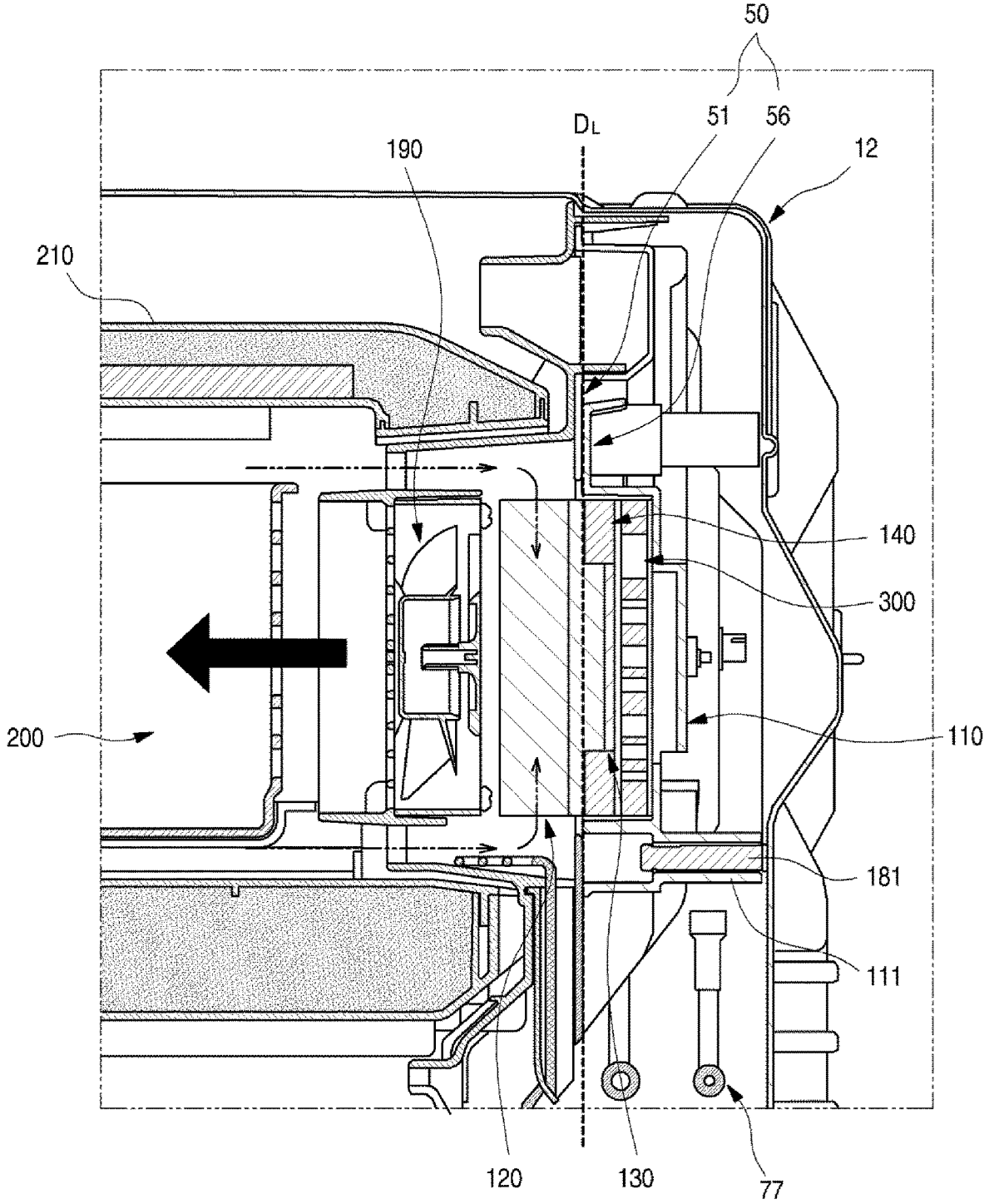

FIG. 35 is an enlarged view of portion A of FIG. 34.

Figure 36:
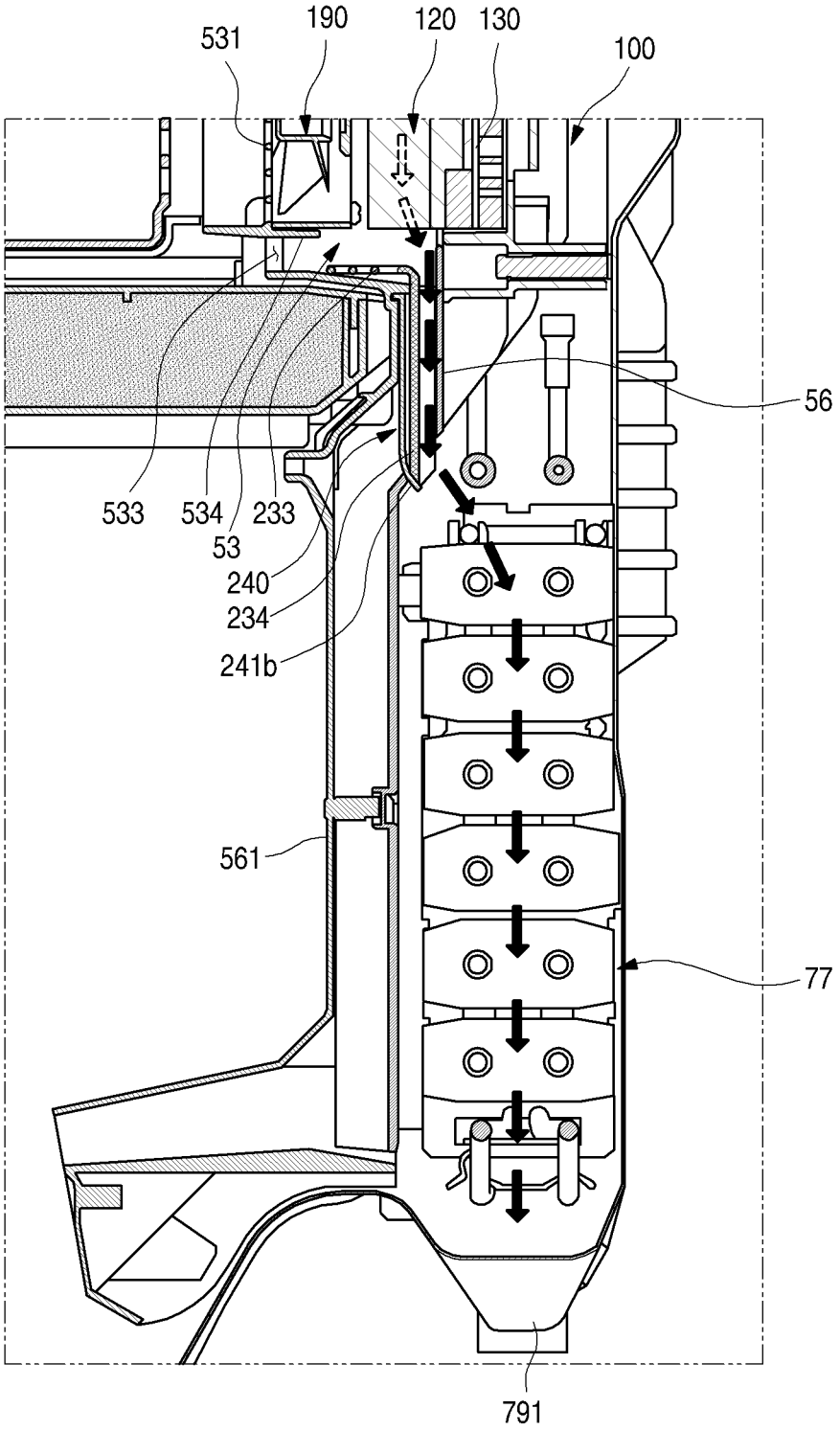

FIG. 36 is an enlarged view of portion B in FIG. 34.

DETAILED DESCRIPTION OF THE EMBODIMENTS

Hereinafter, preferred embodiments of the present invention will be described in detail with reference to the accompanying drawings.

It is to be understood that the present invention is not limited to the disclosed embodiments described above, but may be embodied in many different forms. However, the present embodiment is provided so that the disclosure of the present invention is complete and a person skilled in the art will fully understand the scope of the invention.

In the present invention, the term "deep-temperature" means a temperature lower than −20° C. which is a typical freezing storage temperature of the freezing chamber, and the range thereof is not limited numerically. In addition, even at a deep-temperature freezing chamber, the storage temperature thereof includes −20° C. and may be above than −20° C.

Figure 1:
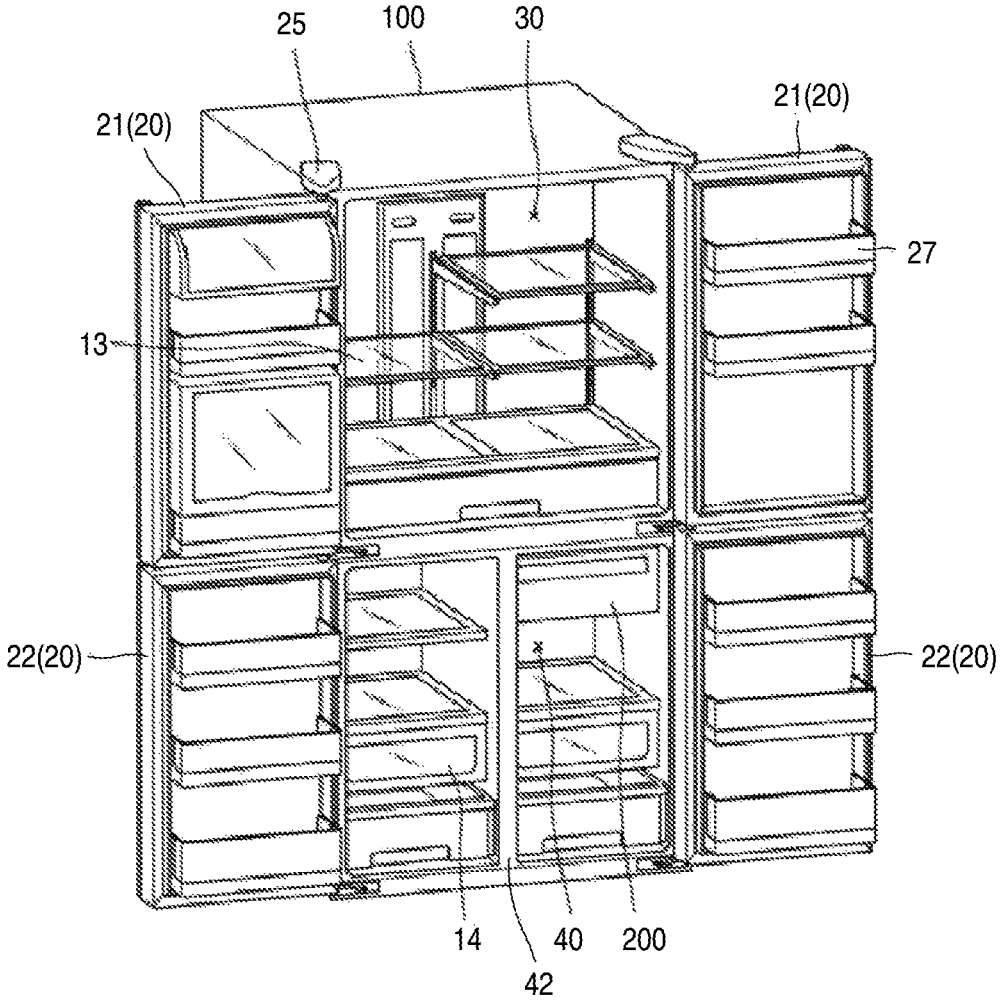
FIG. 1 is a perspective view illustrating a refrigerator in a state where a door according to the present invention is opened.
Figure 2A:
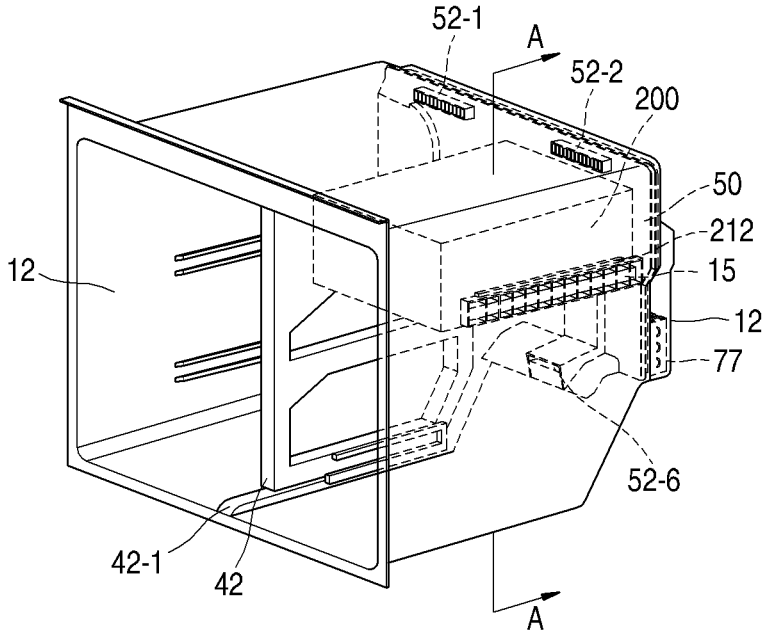
FIGS. 2A to 2C are perspective views illustrating a state where a grille panel assembly and a deep temperature freezing chamber are installed in an inner case of a freezing chamber side of a refrigerator main body of the present invention, and a partition wall and an inner case side wall, respectively.
Figure 2B:
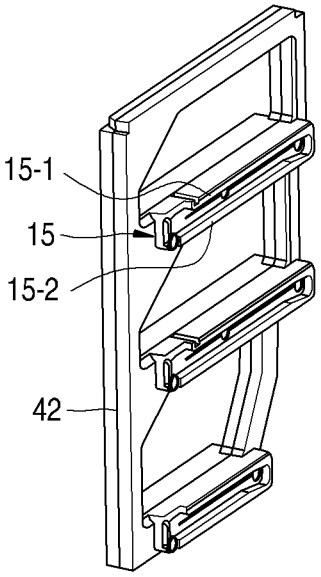
Figure 2C:
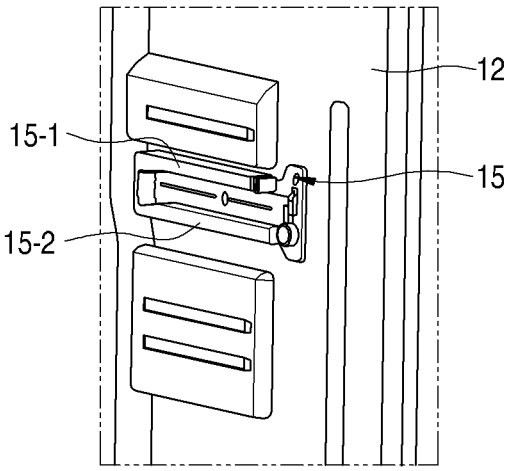

FIG. 1 is a perspective view illustrating a refrigerator in a state where a door according to the present invention is opened, and FIG. 2 illustrates (a) a perspective view illustrating state where a grille panel assembly and a deep-temperature freezing chamber are installed in an inner case of a freezing chamber side of a refrigerator main body of the present invention, and (b) a partition wall, and (c) an inner case side wall, respectively.

The refrigerator according to the present invention includes a rectangular parallelepiped refrigerator main body 10 and a refrigerator door 20 for opening and closing each space of the cabinet in front of the main body. The refrigerator of the present invention has a bottom freezer structure in which a refrigerating chamber 30 is provided at an upper portion and a freezing chamber 40 is provided at a lower portion thereof. The refrigerating chamber and the freezing chamber include double doors 21 and 22 which are rotated and opened with respect to a hinge 25 at both end portions, respectively. However, the present invention is not limited to the refrigerator of the bottom freezer structure. As long as a refrigerator having a structure capable of installing the deep-temperature freezing chamber in the freezing chamber, the present invention may be also applied to a refrigerator having a side by side structure in which a refrigerating chamber and a freezing chamber are disposed on the left and right, respectively, a refrigerator having a top mount structure in which a freezing chamber is disposed above a refrigerating chamber or the like.

The refrigerator main body 10 includes an outer case 11 that constitutes an exterior and an inner case 12 that is provided with a predetermined space with the outer case 11 and constitutes the interior of the refrigerating chamber 30 and the freezing chamber 40. The space between the outer case 11 and the inner case 12 is foamed and filled with a heat insulating material 80 so that the refrigerating chamber 30 and the freezing chamber 40 are insulated from the indoor space.

A shelf 13 and a drawer 14 are installed in the storage space of the refrigerating chamber 30 and the freezing chamber 40 in order to increase space utilization efficiency and store food. The shelf and the drawer may be guided along rails 15 disposed on left and right thereof and thus be installed in storage space. As illustrated in the drawings, a door basket 27 is installed inside the refrigerating chamber door 21 and the freezing chamber door 22 and is suitable for storing containers such as drinks.

The deep-temperature freezing chamber 200 according to the present invention is provided in the freezing chamber 40. The space of the freezing chamber 40 is partitioned into left and right sides for efficient use and is defined by a partition wall 42 extending vertically from the center of the freezing chamber. Referring to (a) and (b) of FIG. 2, the partition wall 42 is fitted and installed inwardly from the front of the cabinet and can be supported in the freezing chamber through an installation guide 42-1 provided at the bottom of the refrigerator. According to the present invention, it is exemplified that the deep-temperature freezing chamber 200 is located on the upper right side of the freezing chamber 40. However, the present invention is not limited to the deep-temperature freezing chamber 200 being necessarily provided in the freezing chamber. In other words, the deep-temperature freezing chamber 200 of the present invention may be provided in the refrigerating chamber 30. However, in a case where the deep-temperature freezing chamber 200 is disposed in the freezing chamber 40, since the temperature difference between the inside and outside (freezing chamber atmosphere) of the deep-temperature freezing chamber is smaller, it would be more advantageous to install the deep-temperature freezing chamber in the freezing chamber from a viewpoint of prevention of leakage of cooling air or insulation.

In the rear lower portion of the freezing chamber, a machine chamber which is spaced apart from the freezing chamber is positioned and a compressor 71 and a condenser 73 of a refrigeration cycle cooling device 70 by a refrigerant are disposed in the machine room. A grille panel assembly 50 including a grille panel 51 for defining the rear wall surface of the freezing chamber and a shroud 56 which is coupled to the rear side of the grille panel 51 and distributes the cooling air in the freezing chamber is installed between a space that forms a freezing chamber and a rear side wall of the inner case 12. An evaporator 77 of the refrigeration cycle cooling device 70 is installed in a predetermined space between the grille panel assembly 50 and the rear side wall of the inner case 12. The refrigerant evaporating when the refrigerant in the evaporator 77 is evaporated, exchanges heat with the air flowing in an internal space of the freezing chamber, and the air cooled by the heat exchanging distributes in a cooling air dispensing space defined by the grille panel 51 and the shroud 56 and flows to the freezing chamber and thus the freezing chamber is cooled.

Figure 3:
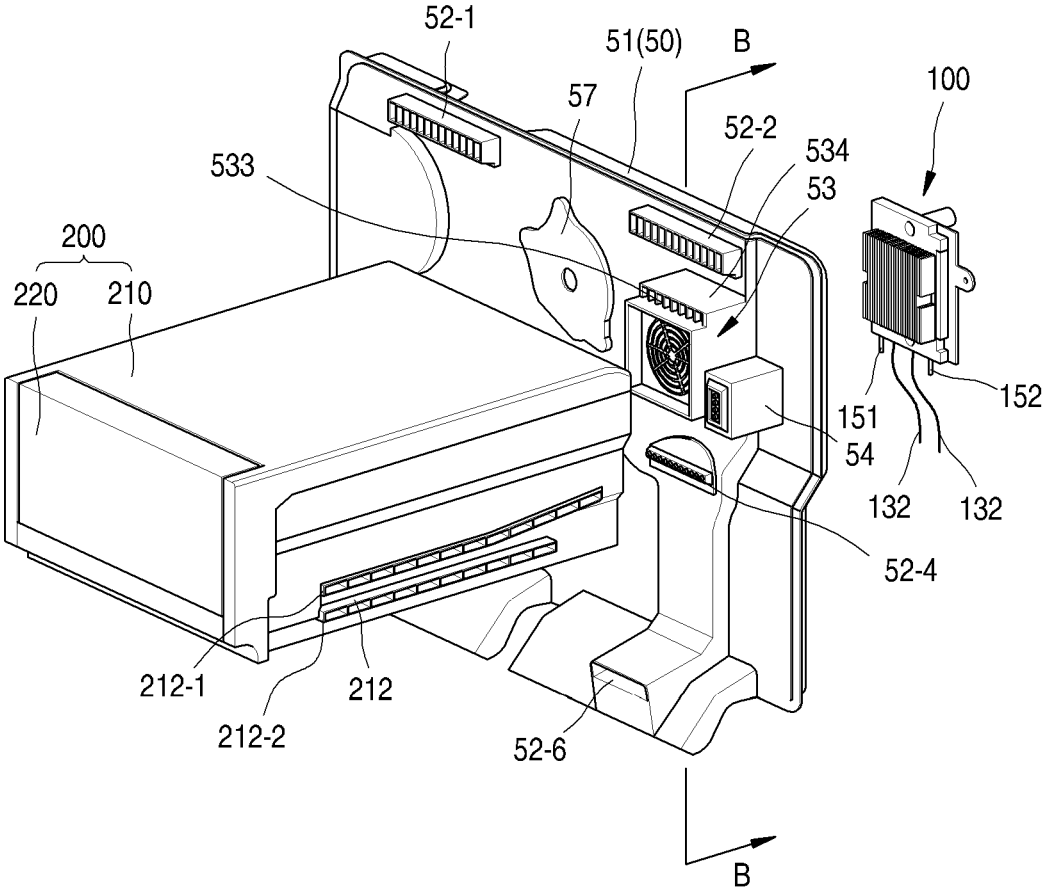
FIG. 3 is front perspective view illustrating a state where the grille panel assembly, the deep-temperature freezing chamber, and the thermoelectric element module assembly of the freezing chamber according to the present invention are exploded.
Figure 4:
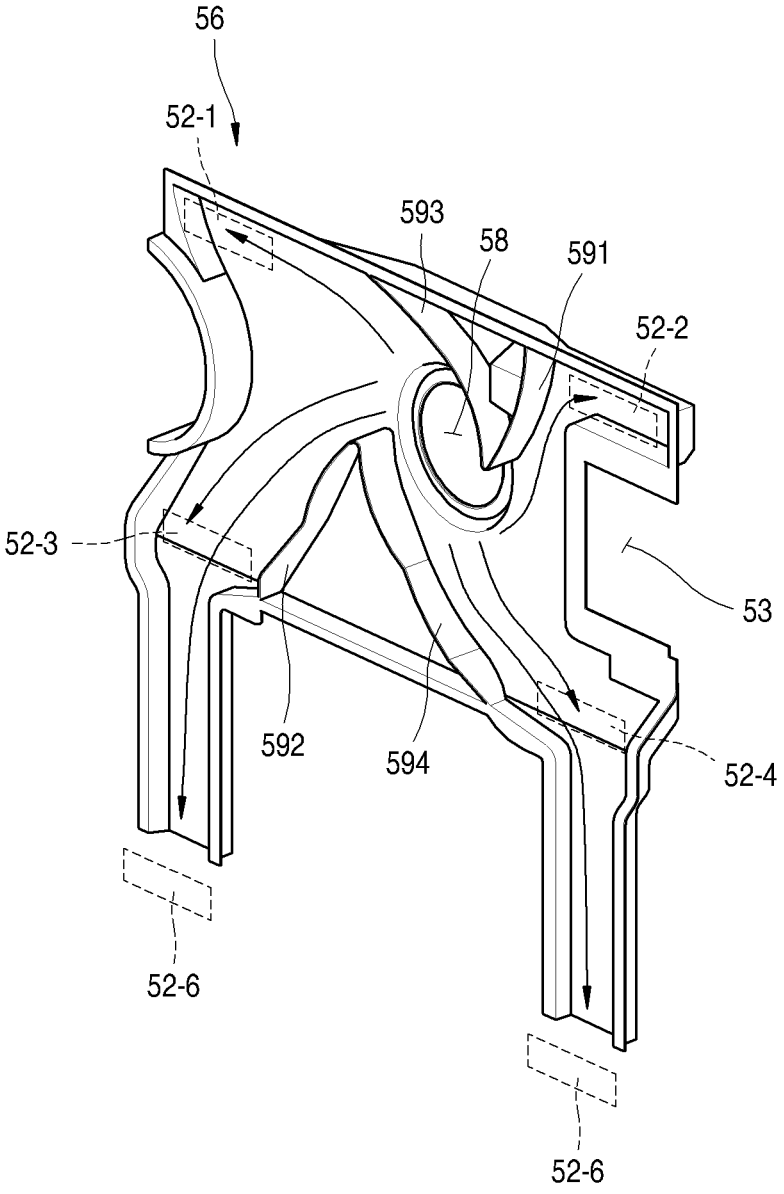
FIG. 4 is a perspective view illustrating a shroud of the grille panel assembly.
Figure 5:
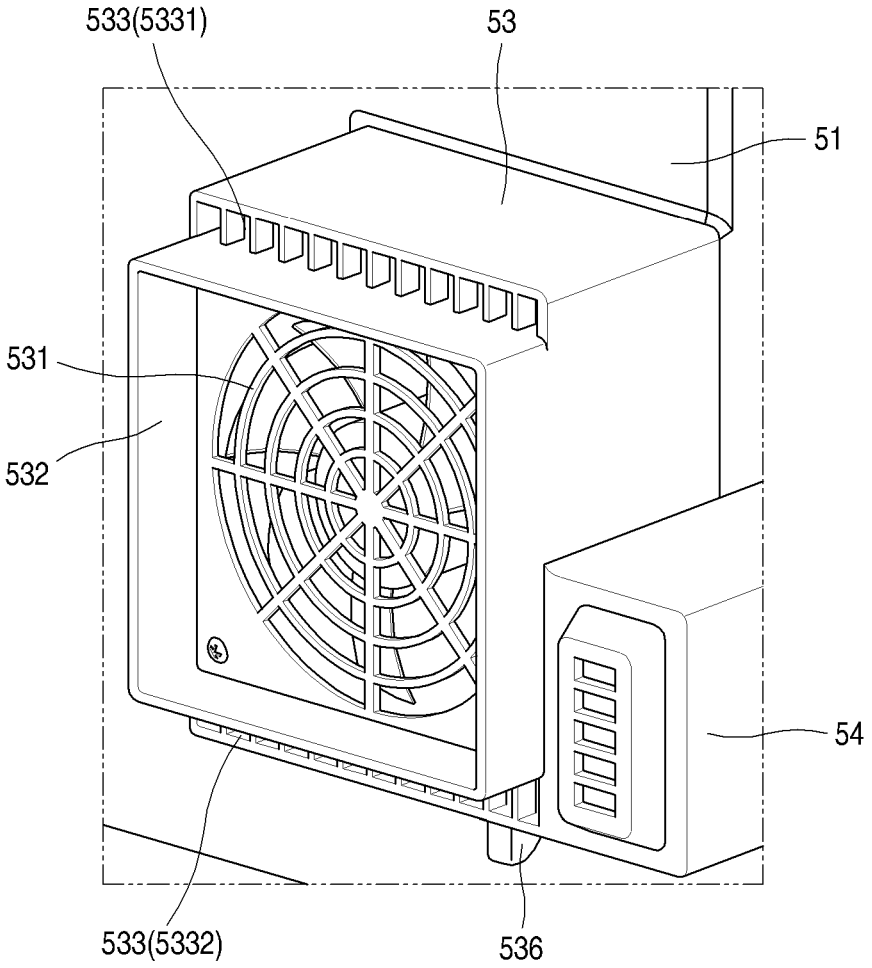
FIG. 5 is an enlarged perspective view of a thermoelectric element module accommodation portion.
Figure 6:
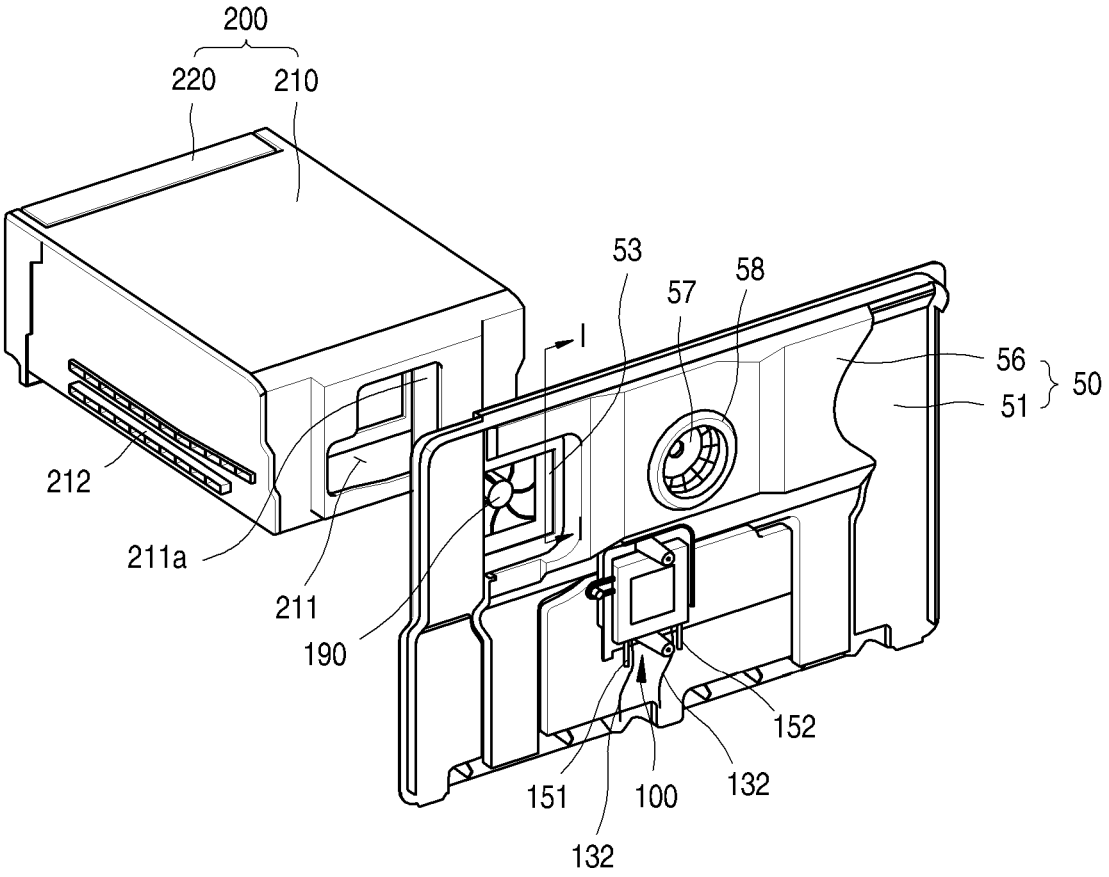
FIG. 6 is a rear perspective view of FIG. 3.
Figure 7:
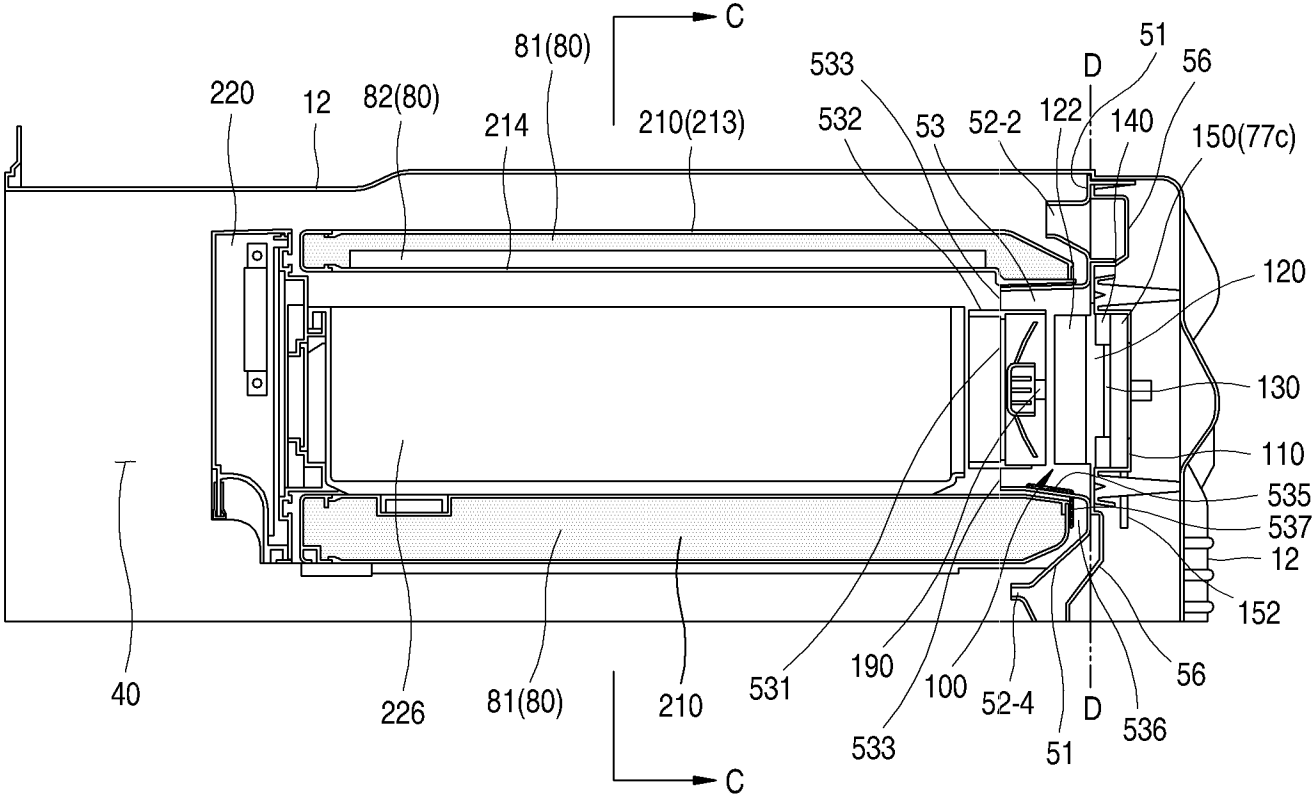
FIG. 7 is a sectional view taken along line A-A in FIGS. 2A to 2C.
Figure 8:
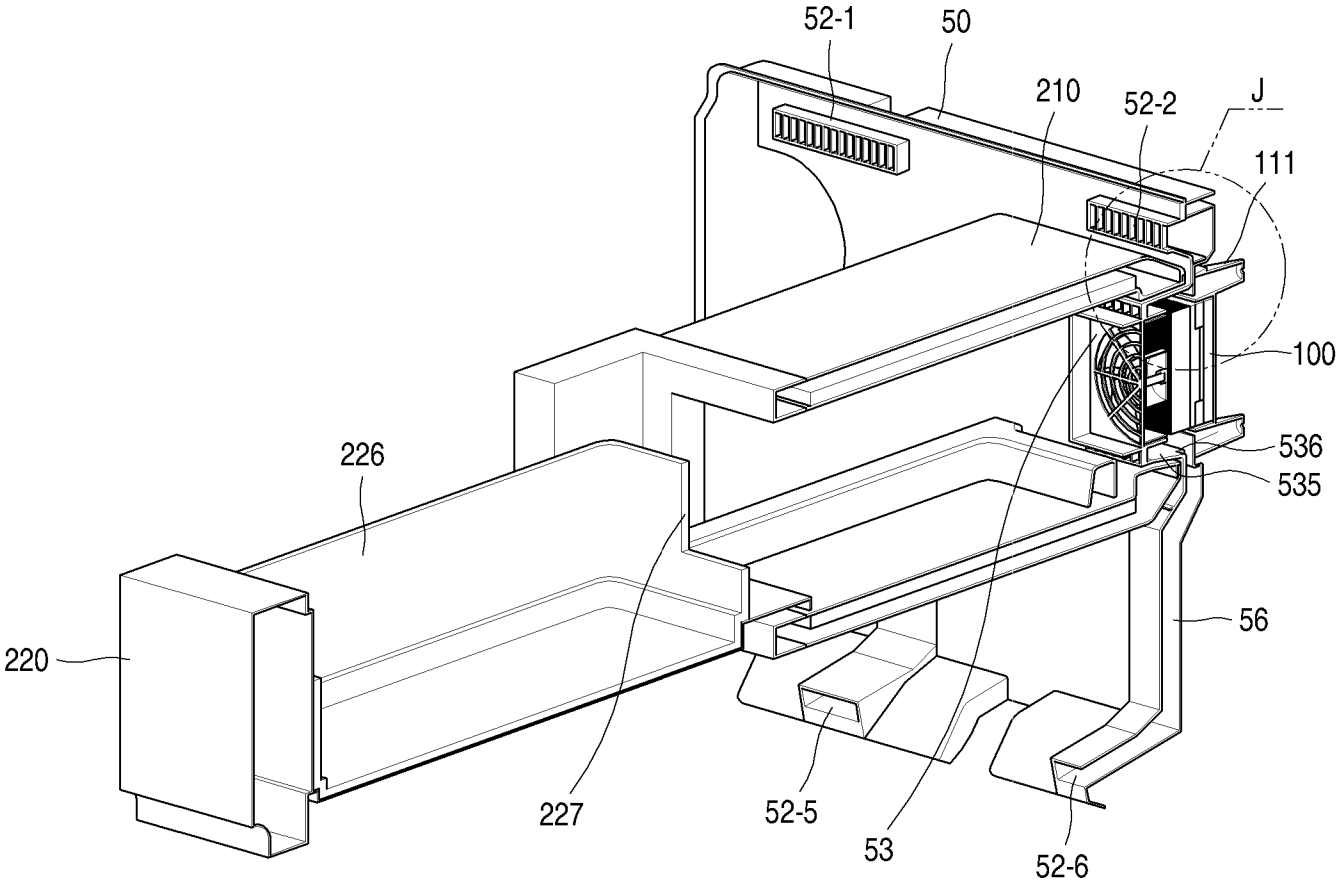
FIG. 8 is a sectional view taken along line B-B in FIG. 3 (heating wire is omitted).
Figure 9:
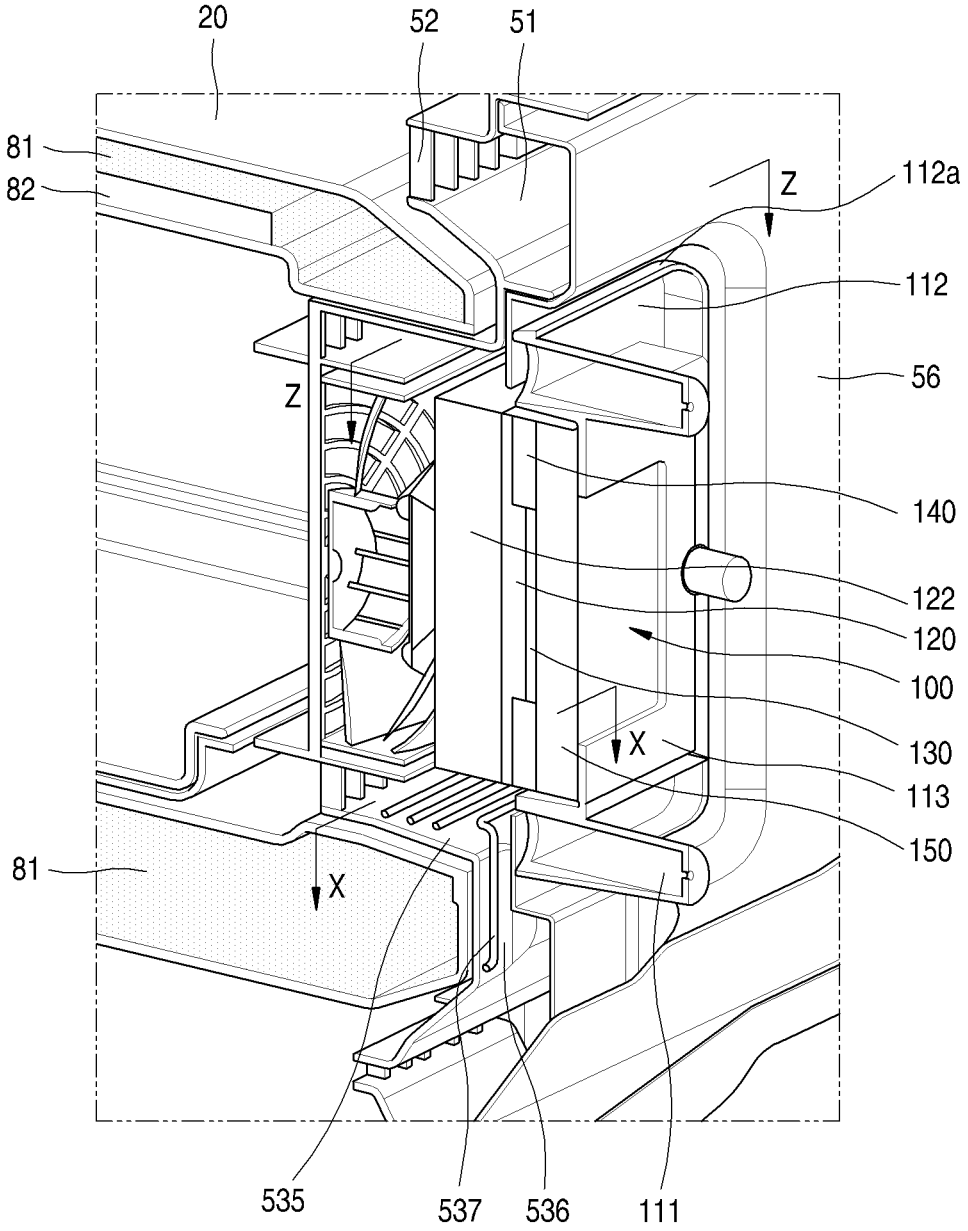
FIG. 9 is a rear perspective view of a side section of the grille panel assembly provided with a thermoelectric element module assembly.
Figure 10:
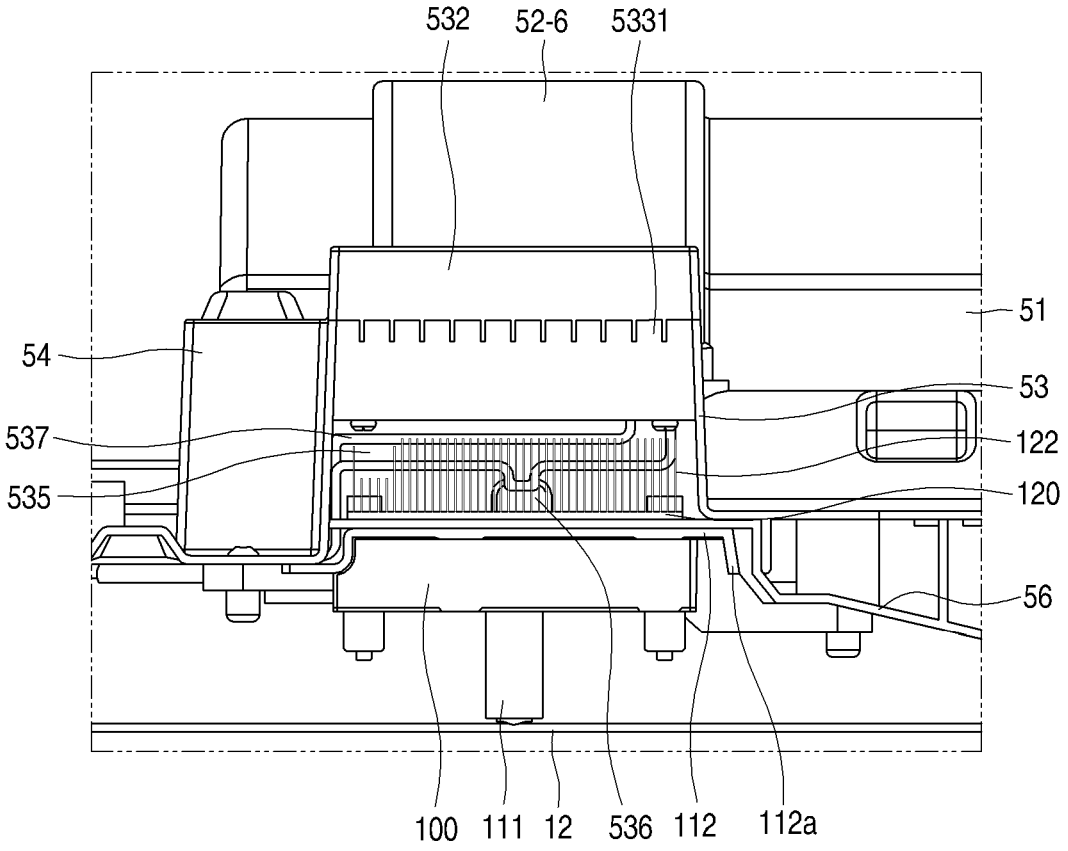
FIG. 10 is a sectional view taken along line Z-Z in FIG. 9.
Figure 12:
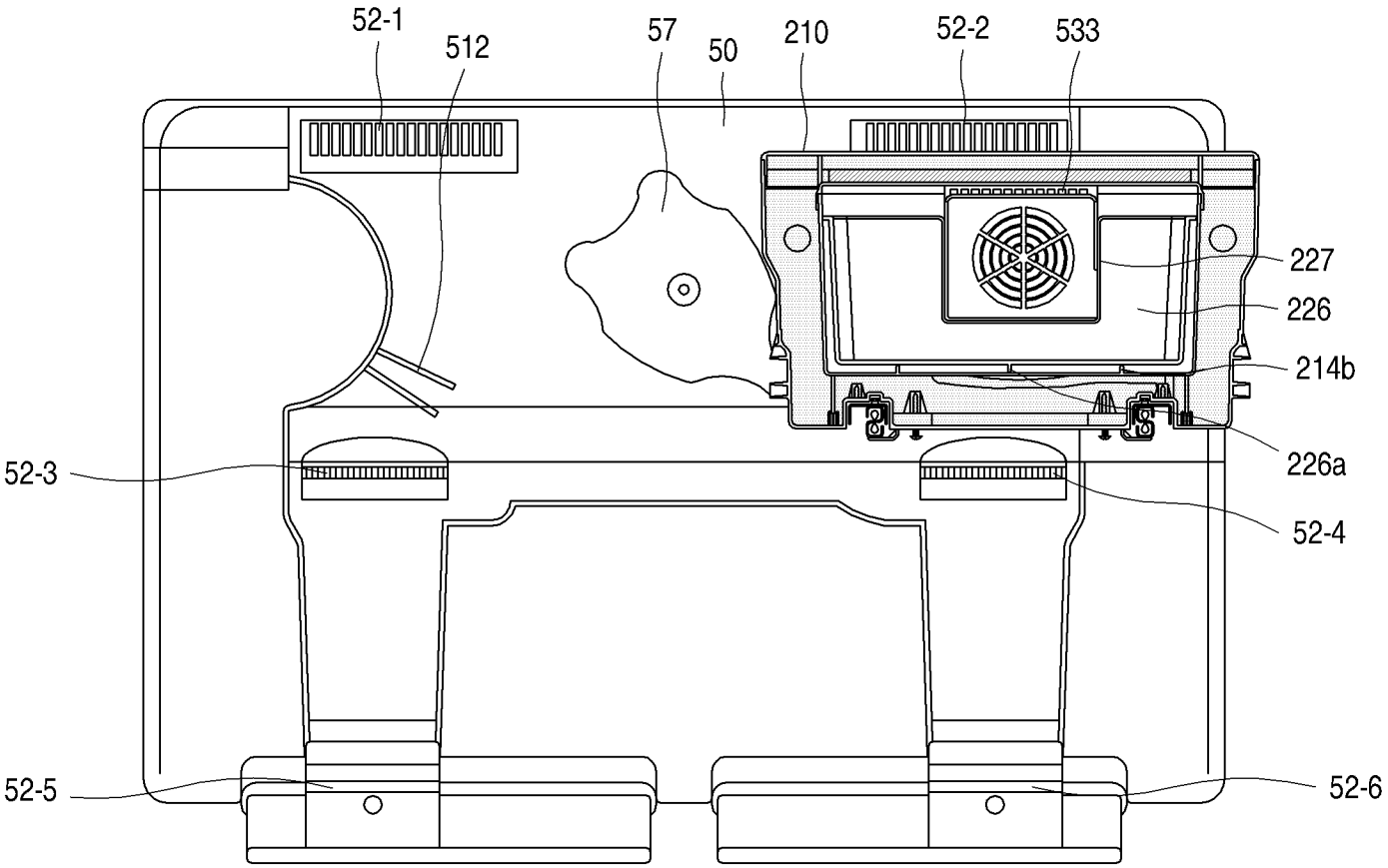
FIG. 12 is a sectional view taken along line C-C of FIG. 7.

FIG. 3 is a front perspective view illustrating a state where the grille panel assembly, the deep-temperature freezing chamber, and the thermoelectric element module assembly of the freezing chamber according to the present invention are disassembled, FIG. 4 is a perspective view illustrating a shroud of the grille panel assembly, FIG. 5 is an enlarged perspective view of a thermoelectric element module accommodation portion, FIG. 6 is a rear perspective view of FIG. 3. FIG. 7 is a sectional view taken along line A-A in FIG. 2, FIG. 8 is a sectional view taken along line B-B in FIG. 3, FIG. 9 is a rear perspective view of a side section of the grille panel assembly provided with a thermoelectric element module assembly, FIG. 10 is a sectional view taken along line Z-Z in FIG. 9, FIG. 11 is a sectional view taken along line X-X in FIG. 9, and FIG. 12 is a sectional view taken along line C-C of FIG. 7.

First, referring to FIG. 3, FIG. 4 and FIG. 6 as an embodiment according to the present invention, a grille panel assembly 50 to which the deep-temperature freezing chamber 200 is applied includes a grille panel 51 portion that defines a freezing chamber rear side wall and shroud 56 which distributes cooling air cooled by heat exchange with the evaporator 77 described above from the rear surface of the grille panel 51 and supplies the cooling air to the interior of the freezing chamber.

As illustrated in the drawings, the grille panel 51 is provided with cooling air discharge ports 52 which serve as paths for discharging cooling air toward the front. In the illustrated embodiment, the cooling air discharge port 52 is provided at the upper left and right sides 52-1 and 52-2, the center-left and right sides 52-3 and 52-4 and the lower left and right sides 52-5 and 52-6 (in FIG. 3, the cooling air discharge port on the lower left side of the center-left is covered by the deep-temperature freezing chamber).

The shroud 56 is coupled to the rear of the grille panel 51 and defines a predetermined space together with the rear surface of the grille panel 51 after being coupled. This space serves as a space for distributing the air cooled by the evaporator 77 provided on the rear surface of the grille panel assembly 50 or the shroud 56. A cooling air absorption hole 58 communicating with a space behind the shroud 56 and the space between the grille panel 51 and the shroud 56 is provided at a substantially central upper portion of the shroud 56. A fan 57 for absorbing cooling air in the space behind the shroud 56 through the cooling air absorption hole 58 and distributing and pressing the cooling air into the space between the grill fan 51 and the shroud 56 is provided in the space between the grille panel 51 and the shroud 56.

The cooling air pressurized by the fan 57 flows through the space between the grille panel 51 and the shroud 56, is appropriately distributed, and is discharged through the cooling air discharge port 52 which is opened to the front of the grille panel 51 in the front direction. With reference to FIG. 4, a fan (see FIG. 6) installed in front of the cooling air absorption hole 58 is a sirocco fan that rotates in a counterclockwise, for example, discharges in a radial direction after absorbing cooling air from the cooling chamber through a cooling air absorption hole 58. The cooling air is guided by guide diaphragms 591, 592, 593, and 594 that reduce the flow loss of air and guide the direction of air flow and thus is dispensed and flows to cooling air discharge port 52 in upper both sides 52-1 and 52-2, both sides 52-3, 52-4 of the central portion, and lower both sides 52-5 and 52-6 of the grille panel. The projecting portion provided on the upper pardon of the cooling air discharge port 52-3 of the grille panel 51 of FIG. 12 is a water path groove 512 protruding forward in a slim form and is a configuration in which a condensation that can be formed on the inner wall of the grille panel 51 flows down to the lower portion and is prevented from flowing out through the cold air discharge ports 52-3 and 52-5. In other words, the water path groove 512 of the grille panel 51 has a groove shape recessed at the rear surface of the grille panel, and has a shape inclined downward from the left to the center portion so that water droplets flowing down from above can flow downward through the water path groove, and thus water droplets are not moved through the cooling air discharge port.

The air discharged into the freezing chamber 40 through the cooling air discharge ports 52 spreads evenly inside the freezing chamber and flows to the door basket 27 of the freezing chamber door 22. Accordingly, the air cooled by the evaporator 77 is uniformly supplied to the inside of the freezing chamber to cool the freezing chamber.

On the other hand, referring to FIG. 3 and FIG. 5 to FIG. 12, as the upper right portion of the grille panel 51, between the cooling air discharge port 52-2 on the upper right side and the cooling air discharge port 52-4 on the right side center, thermoelectric element module accommodation portion 53 in which a thermoelectric element module assembly 100 for deep-temperature freezing of the deep-temperature freezing chamber 200 is installed is provided.

First, referring to FIG. 3 and FIG. 5, the thermoelectric element module accommodation portion 53 is provided on the front surface of the grille panel 51 corresponding to the position where the deep-temperature freezing chamber 200 is installed in the freezing chamber 40. The thermoelectric element module accommodation portion 53 is integrally formed with a wall body defining the rear boundary of the freezing chamber 40, that is, a grille panel 51, which is one of the storage spaces where cooling is performed by the refrigeration cycle cooling device 70 and can be installed in a manner that the thermoelectric element module accommodation portion is manufactured and assembled as separate components from the wall body. For example, the grille panel can be manufactured by injection molding. At this time, a method of molding the grille panel and a portion corresponding to the thermoelectric element module accommodation portion 53 together may be applied. On the other hand, in a case where the rear boundary of the storage space is defined by the inner case 12 and it is difficult to form the shape of the thermoelectric element module accommodation portion 53 together in the process of molding the inner case 12, as illustrated in the FIG. 21, a method in which the thermoelectric element module accommodation portion 53 is formed as a separate component and fixedly assembled to the wall body may be applied.

The thermoelectric element module accommodation portion 53 has a substantially rectangular parallelepiped shape protruding forward from the front surface of the grille panel 51 (rear side is opened toward cooling chamber provided with evaporator) and becomes a long rectangular shape and the shape thereof seen from the front is roughly a longer rectangular shape in the up and down direction. A grill portion 531 for discharging the air cooled by the thermoelectric element module assembly 100 is provided at a central portion of the rectangular shape when seen from the front and absorption portions 533 opened to the front are provided on the upper portion and the lower portion thereof. The absorption portion 533 is a path through which an outside air of the absorption portion 533 is absorbed into an internal space (that is, space behind grill portion 531 and internal space of rectangular outer peripheral wall body defining an outer shape of thermoelectric element module accommodation portion 53) of the thermoelectric element module accommodation portion 53. The internal space of the thermoelectric element module accommodation portion 53 becomes a space which is spaced apart from a space provided in a front of the grille panel 51 except that the internal space communicates with a space provided ahead of the thermoelectric element module accommodation portion 53 through the grill portion 531 and the absorption portion 533.

In order to prevent the cooling air discharged from the grill portion 531 from being immediately re-introduced into the absorption portion 533 disposed close to the grill portion 531, a discharge guide 532 in the form of a partition wall, which extends between the grill portion 531 and the absorption portion 533 in the front direction, is provided between the grill portion 531 and the absorption portion 533. In order to prevent the air discharged from the grill portion 531 from being immediately re-introduced into the absorption portion 533, it is sufficient to provide the discharge guide 532 only in the range where the grill portion 531 and the absorption portion 533 are adjacent to each other.

However, when it is desired to further enhance the effect that the cooling air discharged from the grill portion 531 flows forward, that is, the effect of improving the straightness, it is preferable that the discharge guide 532 may be formed in a shape that entirely surrounds the grill portion 531 as illustrated. The flow cross-section of the discharge guide 532 may be a square shape as illustrated but may have a circular shape, such as a blade shape of the fan disposed behind the grill portion 531 or the grill portion. Such a flow cross-sectional shape does not necessarily have a quadrangular or circular flow cross-section but can be modified into various forms as long as it can improve the straightness of cooling air while preventing the cooling air discharged from the grill portion from being re-introduced into the absorption portion.

In addition, a forming position of the absorption portion 533 is not limited to the upper and lower positions of the cooling fan 190. In other words, the absorption portion may be also provided on the left and right sides of the cooling fan 190 and the installation positions thereof may be provided at one or more selected positions of the upper, lower, left, and right sides of the cooling fan.

As illustrated in FIG. 6 to FIG. 9, the rear side of the thermoelectric element module accommodation portion 53 is opened. The thermoelectric element module assembly 100 is inserted forward from the rear of the grille panel 51 and is accommodated in the thermoelectric element module accommodation portion 53.

The sensor installation portion 54 in which a sensor for sensing the temperature and humidity of the deep-temperature freezing chamber 200 is installed is provided at one side of the thermoelectric element module accommodation portion 53 (See FIG. 3, FIG. 5 and FIG. 10). The sensor installation portion 54 is provided with a defrost sensor, and it is possible to determine whether or not defrosting is required by sensing when the defrosting of a cold sink 120 (to be described below) is necessary. Preferably, the sensor installation portion is provided at a position representative of a state of the deep-temperature freezing space when measuring a state of the deep-temperature freezing space. In addition, according to the embodiment of the present invention, since the absorption portion is disposed at the upper portion and the lower portion of the thermoelectric element module accommodation portion, it is advantageous for more accurate measurement that the sensor installation portion avoids such a position and is installed. Therefore, in the present invention, the sensor installation portion 54 is installed on one side of the thermoelectric element module accommodation portion 53. In addition, the sensor installation portion 54 is provided with a through-hole in the front to allow an air atmosphere in front of the sensor installation portion to be also transmitted to the internal space of the sensor installation portion 54 therethrough.

Referring to FIG. 7 to FIG. 11, in a state where the thermoelectric element module assembly 100 is accommodated, there is some space below the thermoelectric element module accommodation portion 53. This space is an internal space of the thermoelectric element module accommodation portion provided at the rear of the absorption portion 5332 provided in front of the space and becomes a flow path of air introduced into the accommodation portion internal space through the absorption portion 5332. In other words, the air introduced through the absorption portion 5332 passes through some space provided in the lower portion of the thermoelectric element module accommodation portion 53, moves upward, and exchanges heat with the cold sink 120.

Referring to FIG. 9 to FIG. 11, as the bottom surface of the thermoelectric element module accommodation portion 53, a slope for drain 535 having a shape inclined downward toward the main body of the grille panel 51 from the absorption portion 5332 is provided rearward from the position where the absorption portion 5332 is provided. The slope for drain 535 means that the bottom surface of the thermoelectric element accommodation portion 53 is inclined downward. A drain hole 536 is formed at the center of the lower end of the slope for drain 535. In the drain hole, the cold sink 120 is disposed directly above the slope for drain 535.

According to this structure, as the defrosting with respect to the condensation of the cold sink 120 is performed, the water separated from the cold sink 120 is dropped onto the slope for drain 535, and the water dropped on the slope for drain 535 flows through a downward inclined surface and moves to the drain hole 536. Finally, the water escapes down along the drain hole 536.

The position where the slope for drain 535 and the drain hole 536 are provided is a space communicating with the deep-temperature freezing space. Therefore, there is a concern that water that falls from the cold sink 120 and heat exchange fin 122 thereof due to defrosting to the drain hole may be frozen again in the slope for drain and in the drain hole 536 in the deep-temperature freezing atmosphere.

In view of this point, the bottom surface and the drain hole portion are provided with the heating wire 537, thereby preventing the defrosted water from being frozen again. The water falling on the slope for drain 535 from the cold sink 120 flows toward the drain hole 536 along the slope for drain 535 and can be guided to the drain hole 536 without being frozen by the heat generated from the heating 537 when the defrosting of the cold sink 120 disposed in the thermoelectric element module accommodation portion 53 is performed by the defrost sensor in the sensor installation portion. Also, since the heating wire extends to the inside of the drain hole 536, the drain water falling along the drain hole 536 also flows down without freezing. The defrost water falling from the drain hole 536 is collected into a drain tray for the evaporator 77 of the cooling chamber located behind the shroud through a hole formed on the shroud located under the drain hole. Such a phenomenon that the water cannot be drained in the deep temperature freezing atmosphere and is frozen again in the slope for drain and the drain hole can be prevented by the heat of the heating wire 537.

Hereinafter, a method of installing the deep freezing chamber 200 will be described. On both sides of the deep-temperature case 210 of the deep-temperature freezing chamber 200, guide rails 212 extending in the front and rear direction are provided as illustrated in FIG. 3 and FIG. 6. Specifically, the guide rail 212 has a shape in which an upper guide portion 212-1 and a lower guide portion 212-2, which are a pair of vertically spaced protrusions, are elongated in the front and rear direction and protruded laterally. Thus, a space-shaped groove recessed in the front and rear direction is provided between the pair of projections. In other words, the guide rail 212 protrudes in a section similar to a "[" shape.

Meanwhile, with reference to FIG. 2, the side surface of the inner case 12 and the side surface of the partition wall 42 of the freezing chamber 40 have a shape corresponding to the recessed space of the guide rail 212 and a rail 15 is provided which is elongated in the front and rear direction and projected in the lateral direction. The rail is injection molded separately from the inner case 12 to secure shape accuracy and strength and then may be installed in the form of being coupled to the inner surface of the inner case 12. These rails can be used as pedestal structures when installing shelves or drawers. Also, according to the present invention, the deep-temperature freezing chamber can be installed using the rail. The rails 15 may be attached to the inner wall of the freezing chamber and the side wall of the partition wall. Referring to (c) of FIG. 2, the rail 15 includes a pair of upper and lower rails 15-1 and 15-2 spaced vertically apart from each other and extending laterally in the front and rear direction and protruding in the lateral direction and project in a section similar to a "[" shape. The rear ends of the upper rail 15-1 and the lower rail 15-2 are connected to each other to regulate the insertion depth of the guide rails 212 of the deep-temperature case. The guide rail 212 and the rail 15 can be fastened to each other by the lower guide portion 212-2 being placed on the lower rail 15-2 and the upper guide portion 212-1 being placed on the upper rail 15-1. According to this structure, since the guide rails 212 are vertically supported by the rails 15 in two stages, it is possible to fix the guide rails 212 more firmly.

When the groove spaces of the guide rails 212 provided on both sides of the deep-temperature case 210 are inserted into the rails 15 provided on the side surfaces of the inner case 12 and the partition wall 42 of the freezing chamber, the interior space of the deep-temperature freezing chamber 200 faces the thermoelectric element module accommodation portion 53 and the sensor installation portion 54 as illustrated in FIG. 7 to FIG. 12. An opening 211 in which the thermoelectric element module accommodation portion 53 and the sensor installation portion 54 are inserted is formed at the rear of the deep-temperature case 210 of the deep-temperature freezing chamber 200, and an inner peripheral surface of the opening 211 is fitted to the outer peripheral surface of the thermoelectric element module accommodation portion 53 and the sensor installation portion 54.

The inner peripheral surface 534 of the thermoelectric element module accommodation portion 53, the outer peripheral surface of the sensor installation portion 54, and the inner peripheral surface of the opening 211 of the deep-temperature case 210 can be manufactured to have a slightly inclined surface that gradually narrows in the front direction and gradually broadens in the rear direction (See FIGS. 7 to 9) so as to facilitate fitting operation therebetween. If a shape of this inclined surface is provided, since the cross-sectional area of the opening rear end of the deep-temperature case is slightly larger than the cross-sectional area of the front end portions of the thermoelectric element module accommodation portion 53 and the sensor installation portion 54, the thermoelectric element module accommodation portion 53 and the sensor installation portion 54 are naturally guided into the opening of the deep-temperature case 210 at the beginning of insertion and the insertion is started and the cross-sectional area of the thermoelectric element module accommodation portion 53 and the sensor installation portion 54 and the cross-sectional area of the openings 211 of the deep-temperature case coincide with each other when the insertion therebetween is complete so that they are tightly fitted.

The thermoelectric element module assembly 100 is inserted forward from the rear of the grille panel assembly 50 and is accommodated in and fixed to the thermoelectric element module accommodation portion 53. With reference to FIG. 6 to FIG. 10, specifically, in a state where the outer peripheral surface of the cooling fan 190 in the form of a box fan faces the inner peripheral surface of the thermoelectric element module accommodation portion 53 at the front side of the thermoelectric element module accommodation portion 53 and thus the positions thereof are restricted, the outer peripheral surface of the cooling fan 190 fixed to the front surface of the thermoelectric element module housing portion 53 by fixing means such as a screw. The thermoelectric element module assembly 100 is inserted forward from the rear of the grille panel assembly 50 so as to be disposed behind the cooling fan 190 and fastened and fixed to the grille panel assembly 50 by a fixing means such as a screw.

The portion of the grille panel assembly 50 to which the thermoelectric element module assembly 100 is fixed may be present only in the portion of the grille panel 51 or may be present in the form of overlapping the grille panel 51 and the shroud 56, and a portion thereof may be present only in the grille panel 51, and the remaining portion thereof may be in the form that the grille panel and the shroud are overlapped with each other. When the thermoelectric element module assembly 100 is fixed to a portion where the panel and the shroud are overlapped by fixing means such as a screw, the thermoelectric element module assembly 100 can be fixed at a time when the grille panel and the shroud are fixed to each other and thus convenience of assembly may be obtained and the grille panel and the shroud are stacked so that the thermoelectric element module assembly 100 can be fixed to the more rigid point.

In the thermoelectric element module assembly 100, a spacer 111 is extended rearward, and an end of the spacer 111 is in contact with the inner case 12. In other words, the spacer 111 is supported by the inner case 12 and functions to support the thermoelectric element module assembly 100 from the inner case 12 to keep a position spaced forward. Since the end of the spacer 111 is fixed to the inner case 12 as described above, the thermoelectric element module assembly 100 keeps a position clearly spaced apart from the inner case 12 and thus the heat radiation efficiency of the thermoelectric element module assembly 100 is further improved.

Meanwhile, as will be described below, the heat sink 150 of the thermoelectric element module assembly 100 is provided with a path through which the refrigerant passes, and the heat sink is provided with an inflow pipe 151 and an outflow pipe 152 for the inflow and outflow of the refrigerant. In the assembling process of the refrigerator, the inflow pipe and the outflow pipe of the refrigerant provided in the heat sink 150 of the thermoelectric element module assembly have to be welded to the refrigerant pipe through which the refrigerant flows in the refrigeration cycle cooling device 70 of the refrigerator. Specifically, the inflow pipe 151 is connected to the rear end of the condenser, that is, the liquid receiver and the rear of the expansion device such as the capillary pipe (capillary), and the outflow pipe 152 can be connected to the front of the evaporator.

Thus, each component (colt sink, thermoelectric element, heat sink, and module housing) of the thermoelectric element module assembly 100 illustrated in FIG. 13 described below has an assembled module shape, is fixed while securing a predetermined gap with the inner case 12 by a spacer 111, the worker can more easily perform the welding work of the refrigerant pipe in the space secured by the spacer 111, after the refrigerant pipe welding operation, the grill fan assembly 50 is installed on the rear side of the freezing chamber, and the grill fan assembly and the thermoelectric module assembly 100 can be fixed. The spacer 111 may be fixed to the inner case 12 by a screw or the like or may be fixed in a manner that a hole provided at the rear of the spacer 111 is fitted to a protrusion protruding from the inner case 12, or the like.

The deep-temperature case 210 has a box-shaped structure which has an opening at the front, an opening 211 formed at a portion of the rear thereof, and has a substantially rectangular parallelepiped shape. As described above, a guide rail 212 is provided on left and right side surfaces which extends in the front and rear direction. The deep-temperature case 210 has an outer case 213 facing the space of the freezing chamber and an inside case 214 which is coupled with the outer case 213 inside the outer case 213 and defines a determined space between the outer case 213 and the inner case 214. A heat insulating material 80 is provided in a space between the outer case 213 and the inner case 214 to insulate the space between the deep-temperature freezing chamber 200 and the freezing chamber 40. As the heat insulating material, a foaming heat insulating material 81 such as polyurethane may be used. In addition to the function of heat insulation, the foam insulating material functions to fix the outer case and the inside case. Such a heat insulating material is filled in a space between the outer case 213 and the inner case 214 through a foaming injection port 218 (see FIG. 6) provided at the rear of the deep-temperature case 210 and the foaming injection port 218 can be closed by a cover (not illustrated) or the like after injection. A vacuum insulated panel 82 having better insulation efficiency may be further applied to the wall body portion of the deep-temperature case where the thickness should be thin.

The opened front of the deep freezing case 210 is opened and closed by the deep-temperature chamber door 220. The deep-temperature chamber door 220 has a predetermined space therein, and a heat insulating material is also provided in such a space to insulate the space between the deep-temperature freezing chamber 200 and the freezing chamber 40. It is preferable that the deep-temperature chamber door 220 has a certain thickness of the user's feeling of gripping, and it is possible to secure the rigidity by foaming the foamed insulator inside the hollow.

A deep-temperature tray 226, which is accommodated in the internal space of the deep-temperature case 210, is fixedly installed at the rear of the deep-temperature chamber door 220. The deep-temperature tray 226 may be configured to move integrally with the deep-temperature chamber door 220. When the deep-temperature chamber door 220 is pulled forward, the deep-temperature tray 226 slides outward from the deep-temperature case 210. The deep-temperature chamber door 220 is guided by an outer rail provided on a lower portion or a bottom surface of the deep-temperature case 210 and is slidable in a front and rear direction.

The rear wall portion of the deep-temperature tray 226 is provided with an opening groove 227 having an opened shape so that cooling air frozen with deep-temperature in the thermoelectric element module assembly 100 can be introduced into the deep-temperature tray 226 when the cooling air flows forward by the cooling fan 190. A shape of the opening groove 227 corresponds to a shape of the thermoelectric element module accommodation portion 53 as illustrated in FIG. 8 and FIG. 12. When the deep-temperature freezing chamber 200 is installed in the freezing chamber 40, the opening groove 227 faces the thermoelectric element module accommodation portion 53 so that the deep-temperature freezing air supplied forward by the cooling fan 190 in the thermoelectric element module accommodation portion 53 can smoothly flow into the internal space of the deep-temperature tray 226.

Meanwhile, with reference to FIG. 7, the upper surface of the deep-temperature case 210 is slightly spaced from the bottom surface of the upper member portion of the inner case 12, that is, the ceiling surface. According to the present invention, the upper surface of the deep-temperature case 210 and the bottom surface of the upper member of the inner case 12 cooperate with each other to implement a structure like a duct. Accordingly, air discharged from the cooling air discharge port 52-2 which is provided on an upper-end portion of the grille panel 51 is guided forward along the same structure as the duct described above to smoothly flow. Therefore, even if the deep-temperature case 210 is installed, the cooling air can smoothly reach the door basket 27 provided in the upper portion of the inner side of the freezing chamber door 22.

The thickness of the upper wall body of the deep-temperature case 210 must be reduced to realize the same structure as the duct described above. In other words, the thickness of the upper portion of the deep freezing case 210 has to be thin, so that the inner volume of the deep freezing case can be ensured and a structure like a duct can be realized. In this respect, in the present invention, in a state where a vacuum insulated panel 82 is filled in the upper member of the deep-temperature case, the thickness of the upper member of the deep-temperature case decreases by foaming the foamed insulating material 81 in the remaining space in the upper member of the deep-temperature case.

The foamed insulating material fills the space inside the outer case and the inside case that the vacuum insulated panel cannot fill. This will further enhance the fastening force of the outer case and the inner case as well as the insulation.

In addition, since the cooling air discharge port 52-4 located near the middle height of the grille panel 51 is disposed under the deep-temperature case 210, the cooling air discharged through the cooling air discharge port 52-4 can smoothly flow forward as well.

Figure 13:
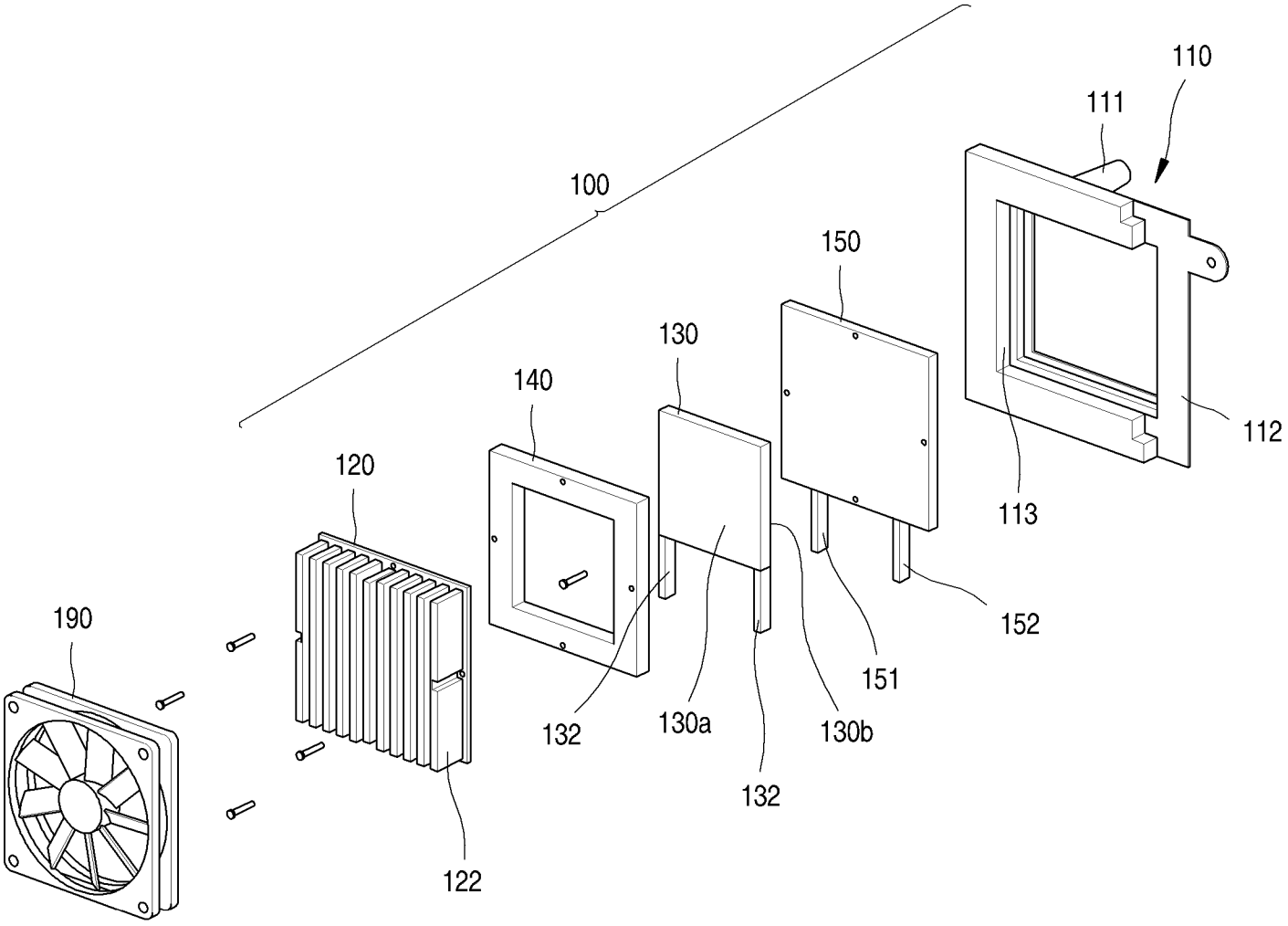
FIG. 13 is an exploded perspective view of a thermoelectric element module according to the present invention.

FIG. 13 is an exploded perspective view of a thermoelectric element module assembly according to the present invention.

The thermoelectric element module assembly 100 is an assembly in which a cold sink 120, a thermoelectric element 130, a heat insulating material 140, and a heat sink 150 are stacked and installed in the module housing 110 to form a module.

The thermoelectric element 130 is an element using a Peltier effect. Peltier effect refers to a phenomenon in which, when a DC voltage is applied across two different elements, heat is absorbed on one side and heat is generated on the other side depending on the direction of the current.

A thermoelectric element is a structure in which an n-type semiconductor material in which electrons are main carriers and a p-type semiconducting material in which holes are carriers are alternately connected in series. Based on a direction in which current flows, on a first surface, an electrode portion for allowing a current to flow from the p-type semiconductor material to the n-type semiconductor material is disposed, and on a second surface, an electrode portion for allowing a current to flow from the n-type semiconductor material to the p-type semiconductor material is disposed. Accordingly, when the current is supplied in a first direction, the first surface becomes the heat absorption surface and the second surface becomes the heat generation surface and when the current is supplied in the second direction opposite to the first direction, the first surface becomes the heat generation surface and the second surface becomes the heat absorption surface.

According to the present invention, since the thermoelectric element module assembly 100 is inserted and fixed from a rear side to a front side of the grille panel assembly 50 and the deep-temperature freezing chamber 200 is provided in front of the thermoelectric element module assembly 100, the thermoelectric element module assembly 100 is configured that the heat absorption is generated at a surface forming a front side of a thermoelectric element, that is, a surface facing the deep-temperature freezing chamber 200 and the heat generation is generated at a surface forming a rear side of the thermoelectric element, that is a surface facing away from the deep-temperature freezing chamber 200 or a surface opposite to a direction facing the deep-temperature freezing chamber 200. When current is supplied in the first direction in which heat absorption is generated at the surface facing the deep-temperature freezing chamber on the thermoelectric element and heat generation is generated at the surface which faces the surface facing the deep freezing chamber on the thermoelectric element, the deep-temperature freezing chamber can be frozen.

In the embodiment of the present invention, the thermoelectric element 130 has a shape such as a flat plate having a front surface and a rear surface, the front surface is a heat absorption surface 130*a* and the rear surface is a heat generation surface 130*b*. The DC power supplied to the thermoelectric element 130 causes a Peltier effect and thereby moves the heat of the heat absorption surface 130*a* of the thermoelectric element 130 toward the heat generation surface 130*b*. Therefore, the front surface of the thermoelectric element 130 becomes a cold surface and the rear surface becomes a heat-generating portion. In other words, it can be said that the heat inside the deep-temperature freezing chamber 200 is discharged to the outside of the deep-temperature freezing chamber 200. The power supplied to the thermoelectric element 130 may be applied to the thermoelectric element through the lead 132 provided in the thermoelectric element 130.

On the front surface of the thermoelectric element 130, that is, the heat absorption surface 130*a* facing the deep-temperature freezing chamber 200, the cold sink 120 contacts and is stacked. The cold sink 120 may be made of a metallic material such as aluminum having a high thermal conductivity or an alloy material. On the front surface of the cold sink 120, a plurality of heat exchange fins 122 extending in the up and down direct ion are formed to be spaced apart from each other in the left and right direction. It is preferable that the heat exchange fins 122 are elongated vertically and continuously extended without interruption. This is to ensure that the water melted in the cold sink during the defrosting of the cold sink 120 flows smoothly in a continuous form of the heat exchange fins extending vertically in the gravity direction. It is preferable that the interval between the heat exchange fins 122 is such that non-flow of the water formed between at least two adjacent heat exchange fins 122 by the surface tension is prevented.

In the cold sink 120 attached to the heat absorption surface of the thermoelectric element, the air inside the deep-temperature freezing chamber flows and performs heat exchange. A phenomenon is generated that the moisture which cools food in the deep refrigerating chamber and is contained in the air is frozen on a surface of a colder cold sink. In order to remove such a freezing water, power is supplied in the current supply direction described above, that is, the second direction which is a direction opposite to the first direction. Accordingly, the heat absorption surface and the heat generation surface of the thermoelectric element 130 are exchanged with each other as compared with a case where the power is applied in the first direction. Accordingly, the surface of the thermoelectric element to which the heat sink contacts acts as a heat absorption surface, and the surface to which the cold sink contacts acts as a heat generation surface. Therefore, the freezing water which is frozen on the cold sink is melted and flows down in the gravity direction, so that defrosting is performed. In other words, according to the present invention, in a case where condensation is generated in the cold sink 120 and thus defrost is required, defrost can be performed by a current being applied in a second direction opposite to the first direction which is the direction of the current applied to cause the deep-temperature freezing action.

The heat sink 150 is in contact with the rear surface of the thermoelectric element 130, that is, the heating surface 130*b* facing a direction in which the deep-temperature freezing chamber 200 is disposed. The heat sink 150 is configured to rapidly dissipate or discharge the heat generated on the heat generation surface 130*b* by the Peltier effect and can configure a portion corresponding to the evaporator 77 of the refrigeration cycle cooling device 70 used for cooling the refrigerator as a heat sink 150. In other words, when the low-temperature low-pressure liquid refrigerant passing through the refrigerant cycle expansion device 75 in the heat sink 150 absorbs heat or evaporates while the heat is absorbed, the heat generated by the heat generation surface 130*b* of the thermoelectric element 130 is absorbed or evaporates while the heat is absorbed by the refrigerant in the refrigeration cycle, so that the heat of the heat generation surface 130*b* can be cooled instantaneously.

Since the cold sink 120 and the heat sink 150 described above are stacked to each other with the flat thermoelectric element 130 therebetween, it is necessary to isolate the heat between the cold sink 120 and the heat sink 150. Accordingly, the thermoelectric element module 100 of the present invention is stacked by a heat insulating material 140 that surrounds the thermoelectric element 130 and fills a gap between the heat sink 150 and the cold sink 120. In other words, the area of the cold sink 120 is larger than that of the thermoelectric element 130 and is substantially the same as the area of the thermoelectric element 130 and the heat insulating material 140. Similarly, the area of the heat sink 150 is larger than that of the thermoelectric element 130 and the area of the thermoelectric element 130 and the heat insulating material 140 are substantially equal to each other.

On the other hand, the sizes of the cold sink 120 and the heat sink 150 are not necessarily the same as each other and it is possible to configure the heat sink 150 to be larger in order to effectively discharge heat.

However, according to the present invention, the refrigerant of the refrigeration cycle cooling device 70 flows through the heat sink so that the heat discharge efficiency of the heat sink 150 can be instantly and surely achieved, so that the refrigerant evaporates in the heat sink to absorb heat quickly from the heat generation surface of the thermoelectric element 130 as vaporizing heat. In other words, the size of the heat sink illustrated in the present invention is designed to have a size enough to immediately absorb and discharge the heat generated by the thermoelectric element and the size of the cold sink may be smaller than the heat sink. However, in the present invention, considering that the heat exchange between gas and solid is generated at the cold sink side while the heat exchange between liquid and solid is generated at the heat sink side, it should be noted that by increasing the size of the cold sink, the heat exchange efficiency on the cold sink side further increases. In order to increase the size of the cold sink, in the embodiment of the present invention, although it is described that the cold sink is designed to a size corresponding to the heat sink as an example by considering compactness of the thermoelectric element module assembly, the cold sink may be configured to be larger than that of the cold sink in order to further increase heat exchange efficiency of the cold sink portion.

The cold sink 120, the thermoelectric element 130, the heat insulating material 140, and the heat sink 150 is inserted into and fixed to an accommodation groove 113 of a module housing 110 in a state of being stacked in close contact with each other by means of close-contact means such as a screw. An outwardly extending flange 112 provided on the rim of the front end of the accommodation groove 113 of the module housing 110 to extend outwardly. The flange 112 is a portion where the thermoelectric element module assembly 100 is in close contact with and is fixed to the grille panel assembly 50.

Figure 16A:
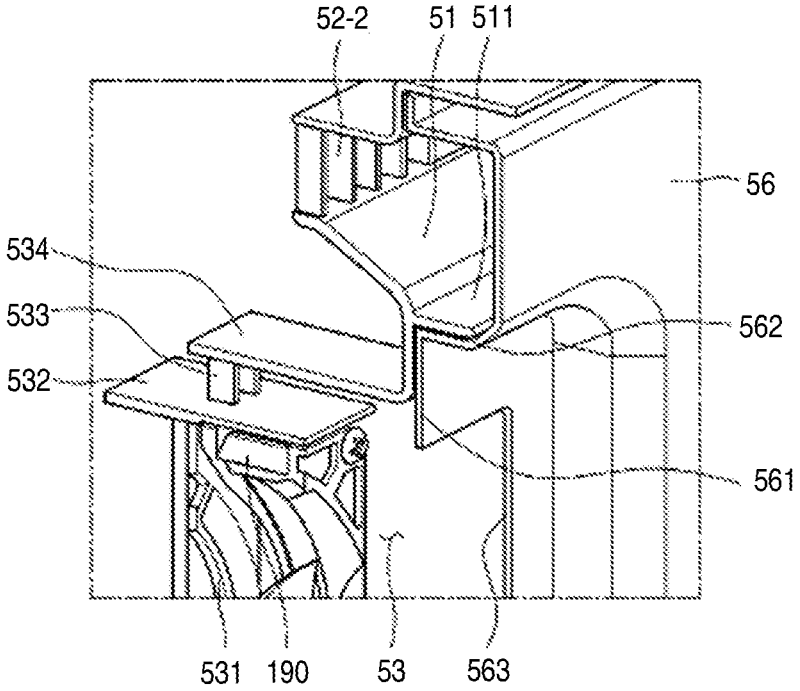
FIGS. 16A and 16B are sectional views taken along line I-I in FIG. 6.
Figure 16B:
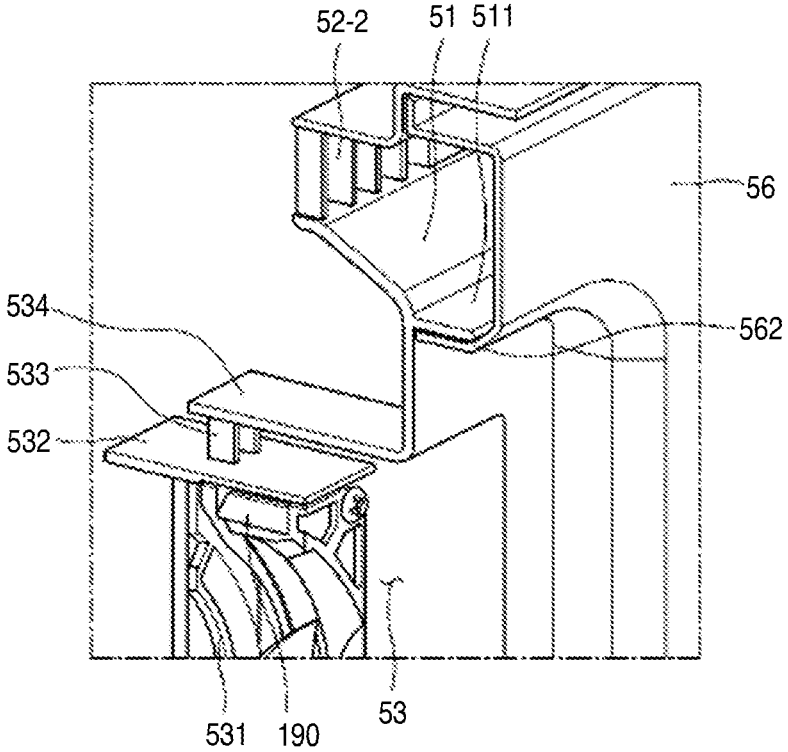

Hereinafter, the installation structure of the thermoelectric element module assembly 100 will be described in more detail with reference to FIGS. 16A and 16B and FIGS. 17A and 17B. FIGS. 16A and 16B are sectional views taken along line I-I of FIG. 6 and FIGS. 17A and 17B are enlarged perspective views of portion J of FIG. 8 viewed from the rear side.

As described above, the grille panel assembly 50 includes the thermoelectric element module accommodation portion 53 for accommodating the thermoelectric element module assembly 100. The thermoelectric element module accommodation portion 53 is provided in a shape protruding forward from the grille panel 51 and the thermoelectric element module assembly 100 is fitted into the thermoelectric element module accommodation portion 53 from the rear side of the grille panel assembly.

Referring to FIG. 16A, a portion of the shroud 56 is disposed in an overlapped manner on the rear side of the thermoelectric element module accommodation portion 53 of the grille panel 51. More specifically, an abutment surface 561 of the shroud is abutted against and fixed to the rear surface of the grille panel 51 surrounding the thermoelectric element module accommodation portion 53. A thermoelectric element module insertion hole 563 is provided around the inner edge of the abutment surface 561 of the shroud and a portion opened by the thermoelectric element module insertion hole 563 becomes a path which communicates with the internal space of the thermoelectric element module accommodation portion 53 from the rear side of the grille panel assembly 50.

Figure 17A:
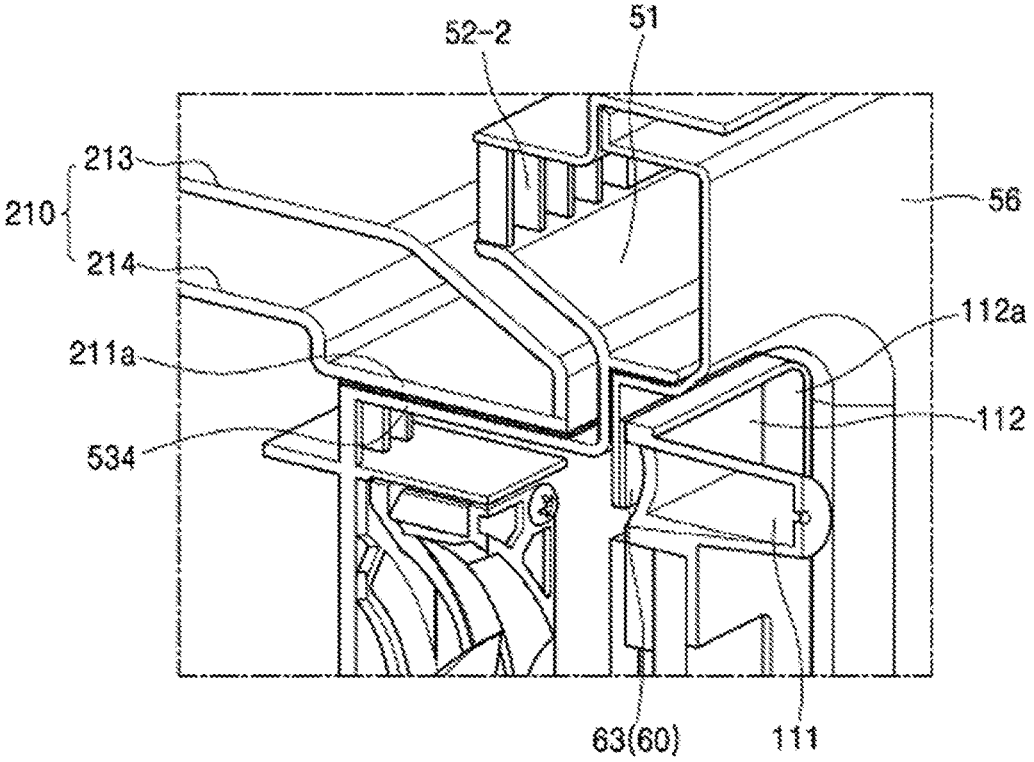
FIGS. 17A and 17B are enlarged perspective views of portion J in FIG. 8 as viewed from the front.
Figure 17B:
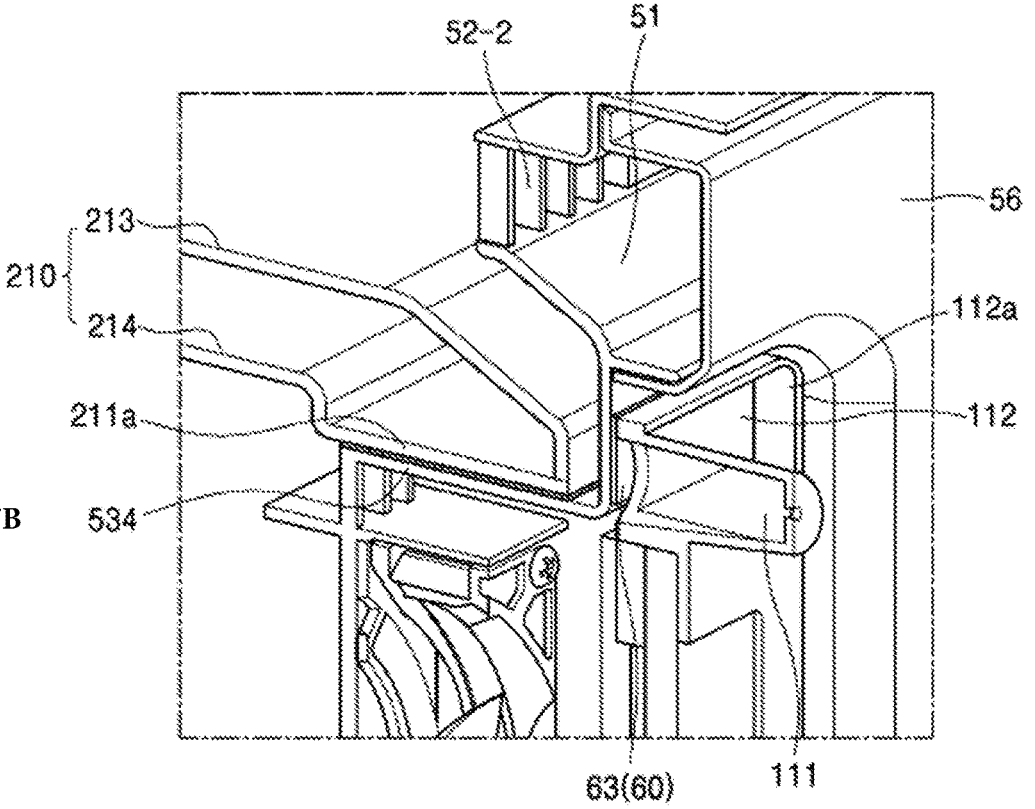

With reference to FIG. 17A, the thermoelectric element module assembly 100 described above is at a position where the rear surface of the grille panel 51 and the abutment surface 561 of the shroud 56 overlap each other. The grille panel 51 and the shroud 56 are usually made of an injection molding or synthetic resin and are produced in a plate form. Although plate-shaped synthetic resin is sufficient as a structure for partitioning a space, there is a concern that rigidity may be insufficient to fix a specific structure on the plate. However, according to the present invention, since the thermoelectric element module assembly 100 is fixed at a position where the rear surface of the grille panel 51 and the abutment surfaces 561 of the shrouds are overlapped with each other. It is possible to sufficiently secure the rigidity for fixing and supporting the thermoelectric element module assembly 100.

As a modification example thereof, the thermoelectric element module assembly 100 may be directly contacted and fixed to the rear surface of the grille panel, as illustrated in FIG. 16B and FIG. 17B. In this modification example, a structure in which the flange 112 of the thermoelectric element module assembly 100 is directly fixed to the rear surface of the grille panel 51 is exemplified.

In addition, a rear rib 511 having a rearwardly extending shape is provided on the rear surface of the grille panel 51. The rear ribs 511 are provided on the outer periphery of the rear surface of the grille panel 51, which has a short distance from the thermoelectric element module accommodation portion 53. More specifically, the rear rib 511 is further formed on the outside of the thermoelectric element module accommodation portion 53 than a position at which the rear surface of the grille panel and the abutment surface 561 of the shroud overlap each other or a position in which the thermoelectric element module assembly 100 is installed.

In addition, the outer peripheral surface of the shroud abutment surface 561 is also provided with a rib abutment surface 562 extending rearward so as to be in contact with the inner surface of the rear rib 511. In other words, the abutment surface 561 and the rib abutment surface 562 are bent and have a stepped shape. Therefore, the shroud abutment surface 561 and the rib abutment surface 562 abut against each other in the "L" shape with the rear surface of the grille panel 51 and the rear rib 511.

The rigidity of the rear rib 511 and the rib abutment surface 562 further increases due to the shape of the stepped shape and the thermoelectric element module assembly 100 fixed to the rear surface of the shroud abutment surface 561 is more easily assembled. In other words, in a case where the outer edge of the flange 112 provided in the module housing 110 of the thermoelectric element module assembly 100 is made in a manner that is an loosely fitted into an inside of the rib abutment surface 562 to a certain extent, that is, slightly, when the thermoelectric element module assembly 100 is fixed to the grille panel assembly 50, it is possible to fix the thermoelectric element module assembly 100 to the grille panel assembly 50 simply while regulating the position of the thermoelectric element module assembly 100 accurately by the outer peripheral surface of the flange 112 of the thermoelectric element module assembly 100 being loosely fitted into the step shape portion by the rib abutment surface 562. As illustrated in FIG. 10 and FIGS. 17A and 17B, when the bent surface 112*a* is formed to extend rearward from the outer edge of the flange 112, the bent surface 112*a* is in contact with the inner peripheral surface of the rib abutment surface 562 and the position is more reliably regulated and the rigidity of the flange 112 is reinforced.

The spacers 111 described above extend rearward from the flange 112 and come into contact with the inner case 12 of the refrigerator main body 10 and are fastened to the inner case 12 by fixing means such as screws and can be fixed in a groove-boss press-fit manner. Accordingly, the module housing 110 firmly fixes the thermoelectric element module assembly 100 to both the grille panel assembly 50 and the inner case 12 side. Since the spacer 111 of the module housing 110 fixes the thermoelectric element module assembly 100 in a state of being spaced apart from the inner case 12, the heat radiation efficiency of the heat sink is increased and a sufficient working space for welding the inflow pipe and the outflow pipe of the refrigerant to the refrigerant pipe of the refrigeration cycle cooling device 70 is secured, as described above.

The cooling fan 190 provided at the foremost side of the thermoelectric element module assembly 100 may be fastened and fixed to the thermoelectric element module accommodation portion 53 of the grille panel 51 as in the embodiment of the present invention illustrated in the drawings and may be formed separately from the thermoelectric element module assembly 100 and may be integrated with the thermoelectric element module assembly 100 in such a manner that the thermoelectric element module assembly 100 is fixed to the cold sink 120 to be spaced apart therefrom by a fastening means such as a screw and thus may be a constitution of the thermoelectric module assembly 100. When the cooling fan 190 rotates, the cooling fan 190 pressurizes the air toward the front side, that is, toward the deep-temperature freezing chamber 200. Accordingly, the air in the rear of the cooling fan 190 is discharged forward by the cooling fan 190, so that the air inside the deep-temperature freezing chamber 200 is filled in the rear of the cooling fan 190 again. The air filled in the thermoelectric element module accommodation portion 53 again exchanges heat with the cold sink 120 and is cooled to be deep frozen.

According to the refrigerator having the deep-temperature freezing chamber according to the present invention, since the thermoelectric element 130 of the thermoelectric element module assembly 100 and the heat sink 150 are further disposed at the rear side of a surface which is formed by the grille panel 51 forming the rear wall of the freezing chamber 40, inflowing of heat generated at the thermoelectric element 130 to the freezing chamber 40 can be blocked in principle, as a characteristic of the present invention.

With reference to FIG. 7, FIG. 10, FIGS. 16A and 16B, and FIGS. 17A and 17B, a space of the freezing chamber 40 is defined as a front space of the grille panel 51, and the deep-temperature freezing chamber 200 is defined as an internal space divided by the grille panel 51, the deep-temperature case 210, and a deep-temperature chamber door 220. The thermoelectric element module assembly 100 according to the present invention is disposed behind the deep-temperature case 210 and particularly the thermoelectric element 130 of the thermoelectric element module assembly 100, a heat insulating member 140 and a heat sink 150 portion is positioned at the rear side of the rear end surface (D-D in FIGS. 7 and 10) of the freezing chamber 40 defined by the grille panel 51. In other words, the thermoelectric element 130 and the portion of the heat sink 150 located behind the thermoelectric element 130 are located between the rear of the grille panel 51 and the inner case 12 and more specifically, are disposed in a heat exchange space (cooling chamber which is space defined separately from the freezing chamber) which is located on the rear side of the grille panel in which an evaporator 77*a* is provided.

According to the disposition position of the thermoelectric element module 100, the heat generated in the heat generation surface 130*b* and the heat sink 150 is blocked from affecting the temperature of the freezing chamber 40 in principle and thus heat loss in the internal space of the freezing chamber 40 by the thermoelectric element 130 can be prevented. In other words, according to the present invention, since the thermoelectric element module assembly 100 is installed in a rear side of the grille panel 51 which is a wall which divides into the freezing chamber and the cooling chamber and is installed in a space which is distinguished from the deep-temperature freezing chamber installed in the freezing chamber side, deep-freezing is smoothly performed and the generation of heat loss of the freezing chamber can be prevented.

The receiving recess 113 of the module housing 110 is provided to extend rearward with respect to the flange 112. The flange 112 is fixed to the grille panel 51 defining the rear face of the freezing chamber with the shroud 56 interposed therebetween. However, as described above, it is preferable that the thermoelectric element of the thermoelectric element module assembly and the heat sink portion are disposed in a space separate from the freezing chamber.

Therefore, in the present invention, the accommodation grooves 113 are formed to extend rearward with respect to the flange 112 and the heat sink, the thermoelectric element, and the cold sink are accommodated in the accommodation groove in this order and thus the heat sink and the thermoelectric element is further positioned at a rear side than a space which is defined as a freezing chamber.

In contrast to the disposition of the thermoelectric elements and the heat sink, the deep-temperature freezing chamber 200 is disposed inside the freezing chamber. The cold sink 120 portion of the thermoelectric element module assembly 100 is also disposed in front of the rear end surface of the freezing chamber 40 ((D-D; see FIG. 7 and FIG. 10). The cold sink 120 may be disposed in front of the rear end surface of the freezing chamber as a colder portion than the freezing chamber. Rather, the cold sink 120 is preferably disposed as close as possible to the deep-temperature freezing chamber 200 in terms of cooling of the deep-temperature freezing chamber.

In other words, according to the present invention, the deep-temperature freezing chamber 200 and the cold sink 120 are located forward of the rear end surface of the freezing chamber defined by the grille panel, that is, on a side of the freezing chamber, and the thermoelectric element 130 and the heat sink 150 are positioned at a rear side of a rear end surface of the freezing chamber, that is, at a side of the cooling chamber.

Figure 14:
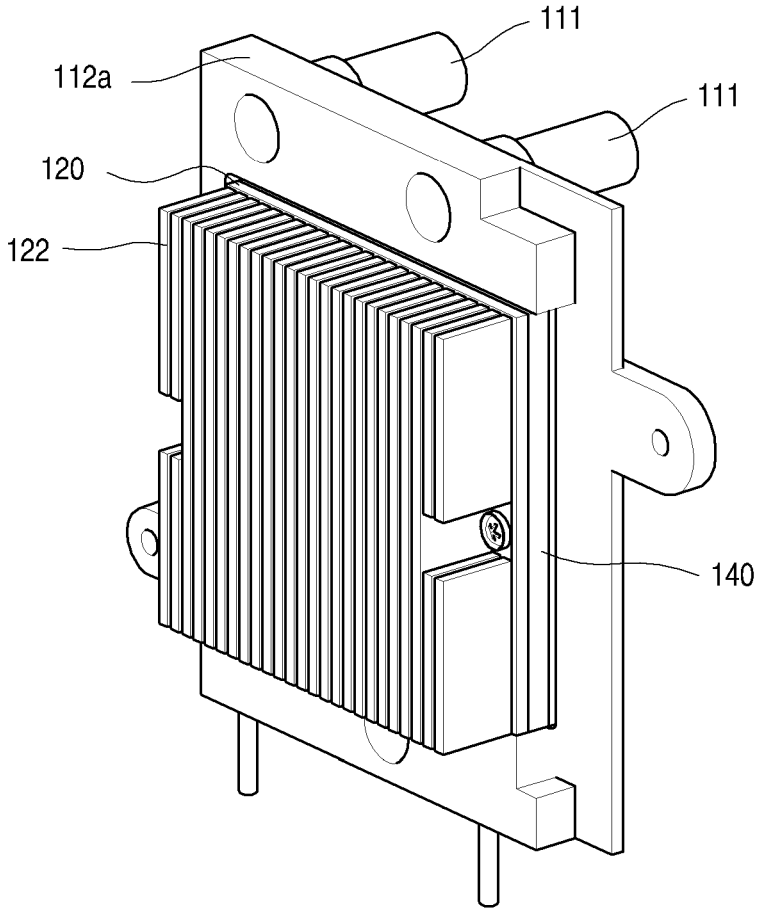
FIG. 14 is a front perspective view illustrating a modification example of the thermoelectric element module assembly according to the present invention.
Figure 15:
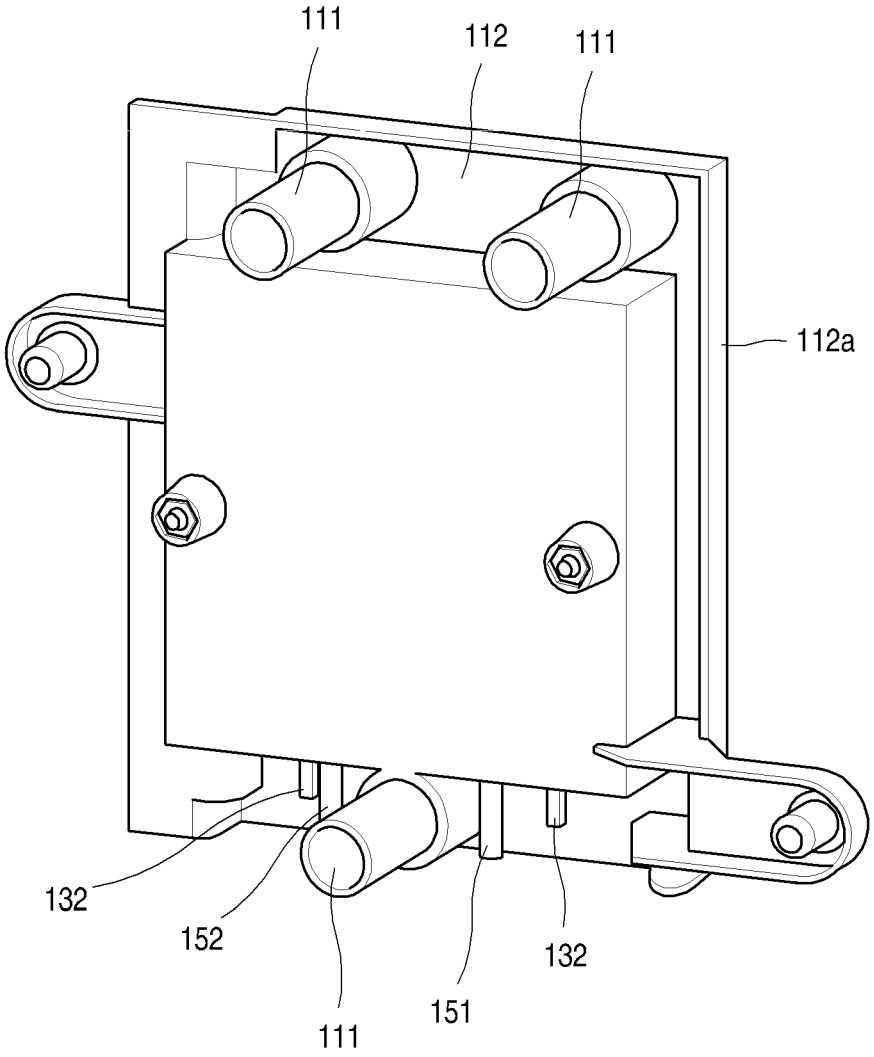
FIG. 15 is a rear perspective view of a modification example of FIG. 14.

FIG. 14 is a front perspective view illustrating a modification example of the thermoelectric element module according to the present invention and FIG. 15 is a rear perspective view of a modification example of FIG. 14.

The modification example illustrated in FIG. 14 and FIG. 15 are different from the thermoelectric element module assembly of FIG. 13 in that two spacers 111 are provided at the upper portion. In other words, according to the modification example, since the spacer 111 has three spacers that are not disposed in a straight line, it is possible to secure the space fixing force to the inner case 12 more than the thermoelectric element module assembly having only the upper and lower spacers, that is, two spacers.

According to a modification example, since holes or grooves are provided at the rear of the spacer, and the inner case 12 is provided with protrusions that can be fitted to such holes or grooves, so that the spacers 111 can be fixed to the inner case 12 in a groove-boss press-fit manner, installation is more convenient. This is a simpler method than a method of fastening the spacer and the inner case with a screw through the screw hole of the spacer 111 illustrated in FIGS. 17A and 17B.

On the other hand, the deep-temperature freezing chamber 200 may be installed in the refrigerating chamber 30. Referring to FIG. 21, the wall body defining the rear boundary of the storage space of the refrigerating chamber 30 may be the inner case 12. Further, although not illustrated, a multi-duct for uniformly distributing cooling air to the refrigerating chamber may form at least a portion of the wall body defining the rear boundary of the refrigerating chamber storage space.

The space between the inner case 12 and the outer case 11 may be filled with a foam insulating material so that space is provided in which the thermoelectric element module 100 can be disposed when foaming the foam insulating material. In addition, a drain hole 536 through which the defrost water can escape is formed when the foaming heat insulating material is foamed. In addition, in a state where the refrigerant pipe connected to the heat sink 150 of the thermoelectric element module assembly 100 is embedded, the foam insulating material can be filled therein. Of course, the embedded refrigerant pipe may be connected to the refrigerant pipes 151 and 152 of the heat sink 150 by welding or the like in a process of installing the thermoelectric element module assembly 100.

The flange 112 portion of the module housing 110 may be fixed to the front surface of the inner case 12 in a process of disposing the thermoelectric element module assembly 100 in place. The thermoelectric element module accommodation portion 53 made of a separate component can be fixed to the front surface of the inner case 12. At this time, the thermoelectric element module accommodation portion 53 and the flange 112 portion of the module housing 110 may be overlapped and fixed to the inner case 12 as illustrated or may be fixed to the inner case 12 not to overlap each other although not illustrated. The thermoelectric element module accommodation portion 53 is integrated with the inner case 12 by being fixed to the inner case 12.

The rear surface 211-1 (see FIG. 6) of the deep-temperature case 210 of the deep freezing chamber 200 may be in close contact with the front of the inner case 12, which is a wall body defining the rear surface of the storage space. Meaning that the rear surface of the deep-temperature case 210 is in close contact with the front of the inner case 12 includes a case where the rear surface of the deep-temperature case is directly in contact with the front surface of the inner case, as a result, a case of being in contact with the inner case by contacting a surface of the thermoelectric element module accommodation portion 53 which is installed on a front surface of the inner case, or the like.

The inner peripheral surface 211*a* of the opening 211 provided at the rear of the deep-temperature case 210 may be in close contact with the outer peripheral surface 54 of the thermoelectric element module accommodation portion 53.

Even with the structure described above, the thermoelectric element 130 of the thermoelectric element module assembly 100 and the heat sink 150 are disposed on a rear side of the wall body (inner case 12) defining the rear boundary D-D of the storage space (the refrigerating chamber 30) cooled by the refrigeration cycle cooling device, so that the influence of the heat generated in the thermoelectric element module assembly 100 on the refrigerating chamber 30 can be minimized and the heat exchange fin 122 of the cold sink 120 can be located forward of the rear boundary D-D and thus the cooling efficiency of the deep-temperature freezing chamber 200 can be kept high.

[Refrigeration Cycle Cooling System for Implementing Cryogenic Temperature of Deep-Temperature Freezing Chamber]

Figure 18:
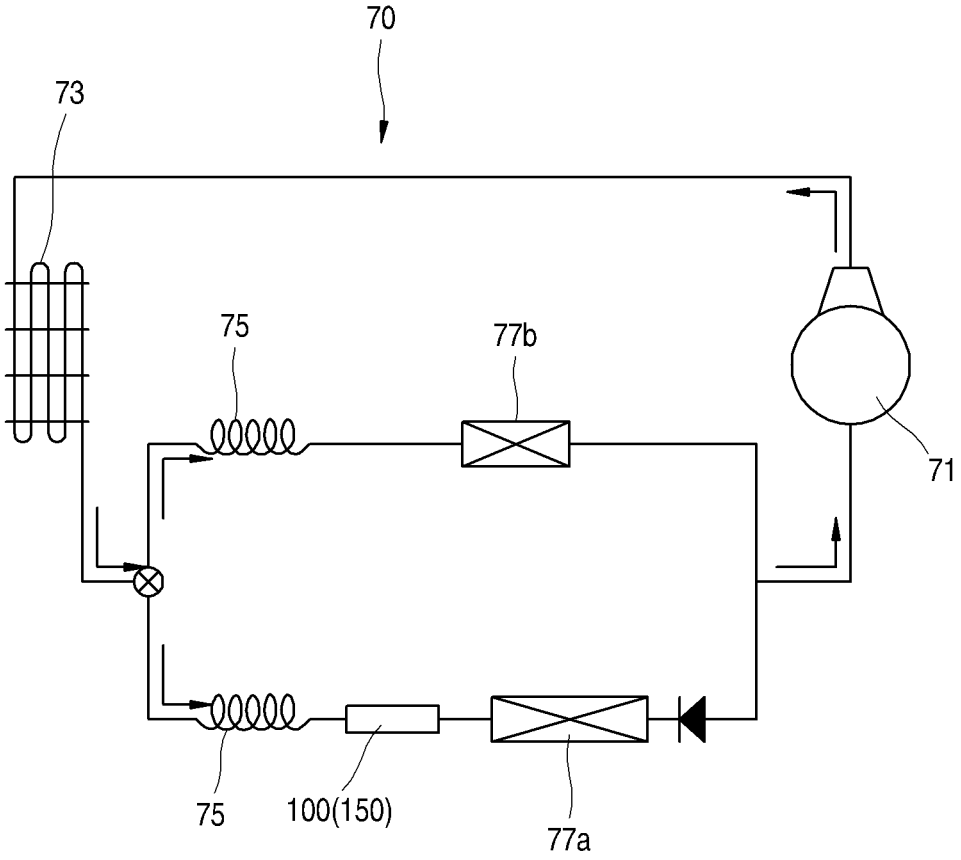
FIG. 18 is a view illustrating a refrigeration cycle applied to a refrigerator according to the present invention.
Figure 19:
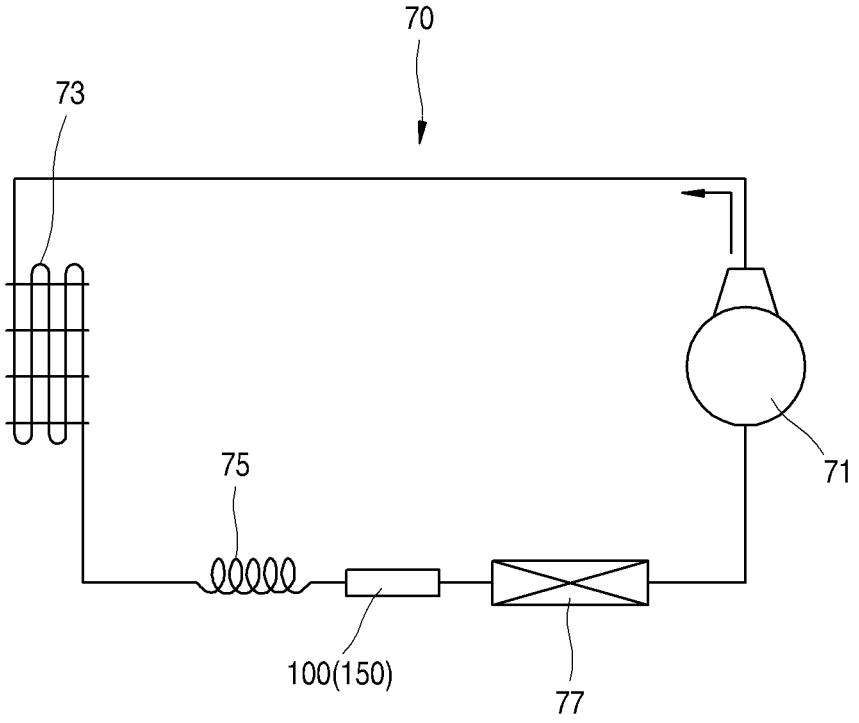
FIG. 19 is a view illustrating another embodiment of a refrigeration, cycle applied to a refrigerator according to the present invention.

FIG. 18 is a view illustrating a refrigeration cycle applied to a refrigerator according to the present invention and FIG. 19 is a view illustrating another embodiment of a refrigeration cycle applied to a refrigerator according to the present invention.

The refrigeration cycle cooling device of the refrigerator according to the present invention is a device for discharging the heat inside the freezing chamber to the outside of the refrigerator through the refrigerant passing through a thermodynamic cycle of evaporation, compression, condensation, and expansion. The refrigeration cycle cooling device of the present invention includes an evaporator 77 for evaporating a liquid phase refrigerant in a low-pressure atmosphere by heat exchange with air in a cooling chamber (space between the grille panel assembly and the inner housing), a compressor 71 for pressurizing a gas phase refrigerant vaporized in the evaporator and discharging the high temperature and high pressure gas refrigerant, a condenser 73 for discharging heat by condensing while the high-temperature and high-pressure gas refrigerant discharged from the compressor exchanges heat with the air of the outside (machine chamber) of the refrigerator, and an expansion device 75 such as a capillary pipe which lowers the pressure of the refrigerant condensed at the condenser 73 in a low temperature atmosphere. The low-temperature and low-pressure refrigerant in the liquid phase whose pressure is lowered in the expansion device 75 flows into the evaporator again.

According to the present invention, since the heat of the heat sink 150 of the thermoelectric element module assembly 100 has to be rapidly cooled, the refrigerant of the low-temperature low-pressure liquid phase, which is lowered in pressure and temperature after passing through the expansion device 75 is configured to pass through the heat sink 150 of the thermoelectric element module assembly 100 before entering the evaporator 77.

Figure 20:
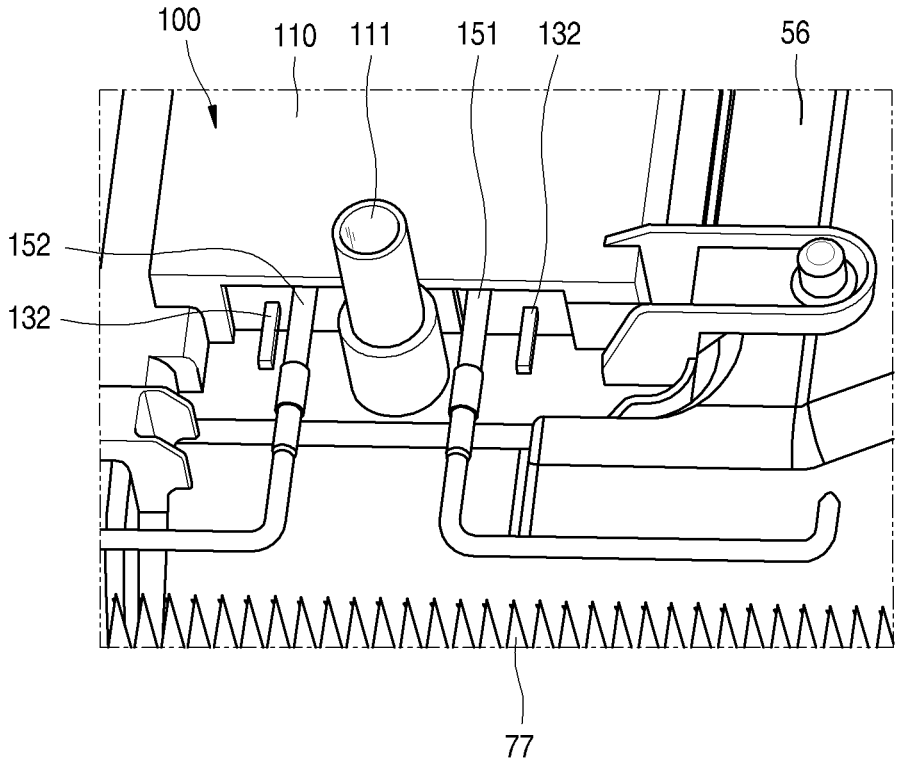
FIG. 20 is an enlarged perspective view illustrating a state where a refrigerant pipe behind the capillary pipe of the refrigerating cycle and a capillary pipe in front of the evaporator are connected to a refrigerant inflow pipe 151 and a refrigerant outflow pipe 152 of the thermoelectric element module assembly fixed to the grille panel assembly, respectively.

FIG. 20 is an enlarged perspective view illustrating a state where a refrigerant pipe behind the capillary pipe of the refrigerating cycle and a capillary pipe in front of the evaporator are connected to a refrigerant inflow pipe 151 and a refrigerant outflow pipe 152 of the thermoelectric element module assembly fixed to the grille panel assembly, respectively. As illustrated in FIG. 20, the refrigerant inflow pipe 151 exposed to the rear of the module housing through an opening hole formed below the module housing 110 of the thermoelectric element module assembly 100, more specifically, below the accommodation groove is connected to a refrigerant pipe, of a refrigeration cycle which is passed through an expansion device such as a capillary pipe. In addition, the refrigerant outflow pipe 152 exposed to the rear of the module housing is connected to the refrigerant pipe introduced into the evaporator. Accordingly, the refrigerant flowing through the capillary pipe flows into the heat sink 150 through the refrigerant inflow pipe 151 to cool or absorb the heat of the heat generation surface of the thermoelectric element 130 and flows out through the refrigerant outflow pipe 152 and flows in the evaporator 77.

The liquid phase refrigerant passes through the heat sink 150 and rapidly absorbs heat generated from the heat generation surface 130*b* of the thermoelectric element 130 by a heat conduction method through the heat sink 150. Thus, the heat of the heat sink 150 is rapidly cooled by the refrigerant circulating through the heat sink.

This will be described in detail with reference to FIG. 18. The compressor 71 pressurizes the low-temperature low-pressure gaseous refrigerant to discharge the high temperature and high-pressure gaseous refrigerant. Such a refrigerant generates heat in the condenser 73 and condensed, that is, liquefied. As described above, the compressor 71 and the condenser 73 are disposed in the machine chamber of the refrigerator.

The high-temperature and high-pressure liquid refrigerant which is liquefied while passing through the condenser 73 flows into the evaporator 77 while being depressurized through the device 75 such as an expansion valve including a capillary pipe or the like. In the evaporator 77, the refrigerant absorbs the surrounding heat and evaporates. According to the embodiment of the present invention illustrated in FIG. 18, the refrigerant passing through the condenser is branched into the refrigerating chamber side evaporator 77*b* or the freezing chamber side evaporator 77*a*. At this time, the heat sink 150 of the thermoelectric element module assembly 100 is provided in front of the refrigerating chamber side evaporator 77*a* on the refrigerant flow path and is disposed behind the expansion device 75.

The deep-temperature freezing chamber 200 is a space in which a temperature of −50° C. has to be kept and the heat generation surface 130*b* of the thermoelectric element 130 has to be kept very cool so that the heat absorption surface 130*a* is smoothly kept cooler than heat generation surface 130*b*. Accordingly, the coldest state can be kept by placing the portion of the heat sink 150 passing through the refrigerant on the front of the fluidized phase of the refrigerant than the refrigerant-side evaporator 77*a*. In particular, since the heat sink 150 directly contacts the thermoelectric element 130 and absorbs heat from the thermoelectric element 130 in a conductive manner through a heat conductor such as a metal, the heating surface 130*b* of the thermoelectric element 130 can be reliably cooled.

On the other hand, when the deep-temperature freezing chamber 200 is not cooled to a deep temperature of −50° C. and is to be used at about −20° C. as a normal freezing chamber, it is possible to use the deep-temperature freezing chamber 200 as a general freezing chamber only by not supplying power to the thermoelectric element 130. In such a case, if power is not applied to the thermoelectric element 130, heat absorption and heat generation do not occur in the heat sink of the thermoelectric element. Therefore, the refrigerant passing through the heat sink 150 does not absorb heat and flows into the freezing chamber side evaporator 77*a* in a liquid refrigerant state which is not evaporated.

The thermoelectric element module accommodation portion 53 is provided with a hole, that is, drain hole 536 for discharging the defrost water generated by the defrosting of the cold sink 120 as described above and is connected to a space between the grille panel 51 and the shroud 56 and/or a space between the grille panel assembly 50 and the inner case 12. Therefore, when the cooling fan 190 is operated without supplying power to the thermoelectric element 130, the cooling air in the space between the grille panel 51 and the shroud 56 and/or the space between the grille panel assembly 50 and the inner case 12 can be introduced into the thermoelectric element module accommodation portion 53 and discharged into the deep-temperature freezing chamber 200 by the cooing fan 190. In addition, in order to promote the introduction of the cooling air in the space between the grille panel 51 and the shroud 56 and/or the space between the grille panel assembly 50 and the inner case into the thermoelectric-element module accommodation portion 53, it is also possible to install an additional fan (not illustrated). In addition, it is also possible to add a damper structure so as to selectively supply the air cooled by the refrigeration cycle cooling device 70 when the deep-temperature freezing chamber is used as a general refrigeration chamber.

In other words, the cooling air generated in the refrigeration cycle cooling device by the general compression method supplies cooling air to the freezing chamber and the refrigerating chamber of the refrigerator of the present invention. When the deep-temperature freezing chamber is operated, the refrigerant passing through the expansion device 75 passes through the heat sink 150 of the thermoelectric element module assembly 100 and is introduced to the evaporator 77*a* after the heat generated from the heat generation surface of the thermoelectric element 130 is rapidly absorbed and the heat generated by the heating surface of the thermoelectric element 130 is rapidly discharged.

The refrigeration cycle cooling device 70 of FIG. 19, which is a modification example of FIG. 18, is different from the refrigeration cycle cooling device 70 illustrated in FIG. 18 in that one evaporator 77 is provided without a separate evaporator 77*b* for the refrigerating chamber in that of FIG. 19 and thus the freezing chamber and the refrigerating chamber is cooled by one evaporator 77 in the refrigeration cycle cooling device 70 of FIG. 19. In other words, there is no difference from the refrigeration cycle structure of FIG. 19 except that there is no need for a three-way valve or a check valve in comparison with FIG. 18, and there is no branching portion of the expansion device 75 and the evaporator 77*b* for the refrigerating chamber. In other words, according to the present invention, even in a case of a refrigeration cycle in which one evaporator 77 is cooled, the refrigerant is disposed at the position corresponding to the front of the evaporator 77 and the rear of the expansion device 75 and is passed through the position while performing heat exchange with the thermoelectric element module assembly 100 so that the cooling of the heat generation surface 130*b* of the thermoelectric element 130 can be performed with the highest priority.

The deep-temperature freezing chamber 200 can store food at a temperature lower than −20° C., which is the temperature of a general freezing chamber and can be cooled down to −50° C. However, such a cryogenic environment is intended to provide a quenching environment to prevent the water from escaping or separating from the cell as described above after being quenched once, the storage temperature may be higher than the temperature of the quenching environment (−50° C.).

Therefore, storage of the food after being quenched already in the quenching environment may result in higher energy consumption. Therefore, in the present invention, it is possible to save power consumption while keeping the freshness of the stored product by keeping the food at a slightly higher temperature (for example, −45 to −40° C.) after the food is cooled at −50° C. at the initial stage of cooling.

These operating conditions can be variously charged. For example, in the early stage, the food is quenched to −50° C. and then kept at a somewhat higher temperature (for example, −35 to −30° C.) to ensure the freshness of the storage product through quenching, reduce the cooling time, power consumption may be further saved.

In addition, the deep-temperature freezing chamber can be also operated as a concept of a fresh chamber in which the initial quenching temperature is set at about −35° C., without implementing a temperature of −50° C., and then continuously kept at about −35° C.

This operation mode can be selected by the user. The selection of the deep-temperature freezing temperature can be attributed to the characteristics of the thermoelectric element module. In other words, although a cooling manner using the compressor and the refrigerant is difficult to change an operation mode rapidly and to control the temperature in detail, since the thermoelectric element module can adjust the temperature of the deep-temperature freezing chamber in accordance with the current applied thereto in a detailed manner, the various operation modes described above are possible.

FIG. 22 is a side sectional perspective view illustrating a state where a thermoelectric element module assembly is installed in a grille panel assembly on which a deep-temperature case is mounted.

With reference to FIG. 9, FIG. 22, or the like, the thermoelectric element module assembly 100 is accommodated in the thermoelectric element module accommodation portion 53 provided in the grille panel assembly 50. A cooling fan 190 is provided in front of the thermoelectric element module assembly 100 in the thermoelectric element module accommodation portion. The cooling fan 190 is fixedly attached to the rear surface of the front portion of the thermoelectric element module accommodation portion 53. In the present invention, there is provided a structure fixing the cooling fan 190 by the screw being penetrated at the four corners of the front portion of the thermoelectric element module accommodation portion 53.

The cooling fan 190 in the form of a box fan provides a flat circular air discharge surface 191 in the front direction and the air discharge surface 191 is in contact with a grill portion 531 provided in the front surface of the thermoelectric element module accommodation portion 53. The grill portion 531 having a size corresponding to the air discharge surface 191 protects the fan by preventing the air from being approached to a fan blade of the cooling fan 190 from the outside while the air discharged from the cooling fan 190 is smoothly discharged. A cold sink 120 provided in front of the thermoelectric element module assembly 100 is disposed behind the box fan-shaped cooling fan 190.

In addition, according to the present invention, a discharge guide 532 in the form of a duct protruding forward from the grill portion 531 is provided at the edge of the grill portion 531 which abuts the air discharge surface 191 of the cooling fan 190. The discharge guide 532 is formed to have a square cross-sectional shape corresponding to that of the cooling fan 190 in the form of a square box fan, as an example. However, as described above, the shape of the discharge guide 532 can be variously modified.

The end of the discharge guide 532 faces the opening groove 227 provided at the rear of the deep-temperature tray 226. Therefore, the cooling air discharged through the discharge guide 532 flows not only into the deep-temperature tray 226 but also strongly forward, thereby cooling the deep-temperature freezing space evenly.

The absorption portion 533 is disposed on the substantially same plane as the air discharge surface and the discharge guide 532 is disposed between the air discharge surface 191 and the absorption portion 533 of the cooling fan. When the absorption portion is disposed further forward than the air discharge surface, the phenomenon that the air discharged from the air discharge surface is immediately re-absorbed into the absorption portion becomes large. On the contrary, if the absorption portion is disposed further behind the air discharge surface, the circulating force of the cooling air circulating in the internal space of the deep-temperature freezing chamber is weakened.

In addition, an absorption portion 533 of a forwardly opened shape is disposed at the upper portion and the lower portion of the air discharge surface, respectively. The absorption portion 5331 located at the upper portion of the cooling fan 190 absorbs heat from the deep-temperature freezing chamber 200 and absorbs the increased air. The absorption portion 5332 disposed at the lower portion of the cooling fan 190 becomes a path through which the cooling air discharged and supplied to the front of the deep-temperature tray 226 passes over the deep-temperature tray 226 and is absorbed into the thermoelectric element module accommodation portion 53 again through the space h between a lower surface of the deep-temperature tray and a bottom surface of the deep-temperature case 210.

The distance h between the lower surface of the deep-temperature freezing tank and the bottom surface of the deep-temperature case is preferably larger than 4 mm and smaller than 7 mm. If the distance therebetween is narrower than 4 mm, the circulating flow of the cooling air is lowered since resistance against cooling air flow increases. Conversely, if the gap therebetween is larger than 7 mm, only the volume of the storage capacity of the deep-temperature tray 226 is reduced while there is little improvement in circulating the flow of cooling air.

The air absorbed into the internal space of the thermoelectric element module accommodation portion 53 through the absorption part 533 flows toward a negative pressure portion generated on the air absorption surface of the cooling fan 190 in the middle, is in contact with and exchanges heat with the heat exchange fins 122 of the cold sink 120. Since the absorption portions are provided above and below, the flow of the cooling air mainly occurs in the up and down direction even in the thermoelectric element module housing portion. Correspondingly, the heat exchange fins 122 of the cold sink 120 are formed in a vertically elongated shape.

As described above, the grille panel 51 is provided with the thermoelectric element module accommodation portion 53 having a forward protruding shape and the deep-temperature case 210 defining the overall contour of the deep-temperature freezing chamber 200 is combined with the thermoelectric element module accommodation portion 53 in a manner in which shapes thereof are combined with each other. On both side surfaces of the deep-temperature case 210, guide rails 212 (see FIG. 3 and FIG. 6) are provided which is guided a sliding movement back and forth by rails (15; see FIG. 2) which is provided a side surface of the inner case 12 and a side surface of the partition wall 42, respectively. In addition, on the rear surface of the deep-temperature case 210, an opening 211 is provided which is opened to receive the thermoelectric element module accommodation portion 53. Accordingly, when the deep-temperature case 210 is pushed back from the front of the freezing chamber 40 in a state where the guide rails 212 are guided by the rails 15, the inner peripheral surface 211*a* of the opening 211 and the outer peripheral surface 534 of the thermoelectric element module accommodation portion 53 face each other while the thermoelectric element module accommodation portion 53 is inserted into the opening 211.

The inner peripheral surface 211*a* has a predetermined depth and overlaps with the outer peripheral surface 534 of the thermoelectric element module accommodation portion 53 in a shape to surround the thermoelectric element module accommodation portion 53. The inner peripheral surface 211*a* and the outer peripheral surface 534 have a predetermined pressure and are in close contact with each other.

The inner peripheral surface 211*a* includes an inclined surface that goes outwardly toward the rear and the outer peripheral surface 534 also includes an inclined surface that goes outwardly toward the rear in a shape corresponding to the inner peripheral surface and thus the deep-temperature case is more smoothly assembled with the thermoelectric element module accommodation portion. The taper angle may be about 1 degree to 5 degrees.

The space between the outer case 213 and the inner case 214 of the deep-temperature case 210 defining the rear surface and the upper and lower left and right surfaces of the deep-temperature freezing space is filled with the heat insulating material and heat exchange between the deep-temperature freezing space and the freezing chamber can be prevented as described above.

FIG. 22 is a side sectional perspective view illustrating a state where a thermoelectric element module assembly is installed in a grille panel assembly on which a deep-temperature case is mounted, FIG. 23 is a perspective view illustrating only a shape of a heating wire, FIG. 24 is a sectional view taken along line L-L in FIG. 11 and a view illustrating a thermoelectric element module accommodation portion and a cold sink.

With reference to FIG. 9 to FIG. 11 and FIG. 22 to FIG. 24, there is a small space under the thermoelectric element module accommodation portion 53 in which the thermoelectric element module assembly 100 is accommodated and space is a space which is provided on the rear side of the absorption portion 5332. In other words, the air in the deep-temperature freezing space absorbed by the absorption portion 5332 is discharged into the cold sink 120 in the upper portion through the lower portion of the thermoelectric element module accommodating unit 53, more specifically into the front side by the cooling fan 190 after the cold sink 120 and the heat exchange fin 122 perform heat exchange, that is into the internal space of the deep-temperature case.

A slope for drain 535 is provided rearward a position where the lower absorption portion 533 is provided, as the bottom of the thermoelectric element module accommodation portion. As illustrated in FIG. 22 and FIG. 9, the slope for drain 535 has a slope inclining downward toward the rear and has a slope inclining downward from both the left and right ends of the slope toward the center as illustrated in FIG. 24. As illustrated in FIG. 11, the drain hole 535 is provided on the front side and the left and right sides as inclined surfaces about the drain hole 536 provided at the rear center of the bottom surface of the thermoelectric element module accommodation portion.

According to the present invention, the formation position of the slope for drain is not limited to the area illustrated in the drawing. Also, the inclination angle of the slope for drain does not have to be constant in all the drain hole areas. For example, the formation position of the drain hole can be formed to be inclined to start from the bottom surface of the thermoelectric element module accommodation portion corresponding to the right-and-lower side of the left and right interface of the cold sink to reach the drain hole. In addition, the inclination angle of the slope for drain may have a shape in which the inclined angle gradually increases as approaching the drain hole from the outer periphery of the slope for drain area.

In addition, a drain hole may be provided not only on the entire bottom surface of the thermoelectric element module accommodation portion but also only in a predetermined area adjacent to the portion where the drain hole is formed.

The drain hole 536 is formed in a shape in which a portion of the grille panel is embedded in the front thereof and a remaining rear surface of the grille panel except for the embedded portion for the drain hole is in contact with the shroud 56 which is coupled to the rear side of the grille panel. Therefore, the shroud 56 spatially separates the front space (deep-temperature freezing space) and the rear space (cooling chamber in which evaporator is disposed) of the shroud and these spaces are communicated spatially with each other only through the drain hole 536.

For reference, the inclined surface structure has a function as an inclined structure of an outer peripheral surface 534 of thermoelectric element module accommodation portion corresponding to an inclined structure of an inner peripheral surface 211*a* of the opening 211 which is provided on the rear side of the deep-temperature freezing chamber described above. In other words, the inclined surface of the member constituting the lower portion of the thermoelectric element module accommodation portion is a structure for discharging the defrost water and also a structure for facilitating fastening with the deep-freezing chamber.

A cold sink 120 and a heat exchange fin 122 protruding forward are provided directly above the bottom surface of the thermoelectric element module accommodation portion having the drain hole 535. The heat exchange fin 122 has a structure in which a plurality of elongated fins are disposed side by side so as to be continuous up and down, as described above.

As the deep-temperature freezing chamber is used, the air circulating inside the deep-temperature freezing chamber by the cooling fan 190 contains moisture in the food and when the air is mixed with the cold sink 120. Condensation occurs in the heat exchange fin 122 of the cold sink. When a considerable level of condensation generation progresses on the surface of the heat exchanging fin 122, both the temperature and humidity of the air flowing through the deep-temperature freezing chamber change to higher values. The air atmosphere inside the deep-temperature freezing chamber can be sensed by a defrost sensor provided in the sensor installation portion 54.

If it is determined that the condensation of the heat exchanging fin 122 progresses to some extent and defrosting is necessary as a result of the determination of the temperature and humidity of the internal air detected by the defrosting sensor, power is supplied to the thermoelectric element 130 of the thermoelectric element module assembly 100 in the second direction which is a direction which is opposite to the first direction (that is, power supply direction in which thermoelectric element surface which is in contact with cold sink becomes heat absorption surface and thermoelectric element surface which is in contact with heat sink becomes heat generation surface). Then heat is absorbed on the surface of the thermoelectric element in contact with the heat sink and heat is generated on the surface of the thermoelectric element in contact with the cold sink.

Accordingly, the condensation water attached to the cold sink 120 and the heat exchange fin 122 is thawed and falls downward. At this time, since the heat exchange fins 122 are continuously extended vertically and are spaced apart from each other by a predetermined distance in the lateral direction, the defrost water flows down without being entangled between the heat exchange fins due to surface tension or the like.

Since the drain hole 535 described above is located below the cold sink 120 and the heat exchange pin 122, the defrost water dropped on the slope for drain 535 flows down to the drain hole 536 along the slope of the inclined surface. The defrost water flowing down through the drain hole 536 flows downward from the space defined between the rear surface of the grille panel 51 and the front surface of the shroud 56 and is discharged to the cooling chamber (side on which evaporator is located) behind the shroud 56 through the discharge hole provided in the lower portion of the shroud 56 to reach a defrost water receiver provided in the lower portion of the evaporator.

Since the atmosphere of the air where the slope for drain 535 and the drain hole 536 are in contact with each other is the atmosphere of the deep-temperature freezing space inside the deep-temperature freezing chamber 200, there is a risk that the defrost water that fails on the surface of the slope for drain 535 cooled down cooler may be frozen again. Accordingly, in the present invention, a heating wire 537 is embedded in the upper portion of the slope for drain 535 to prevent the defrost water from being frozen again on the slope for drain due to the heat generated from the heating wire. In addition, this heating wire 537 extends to the drain hole 536.

The heating wire includes an inflow portion 537-1 that is drawn into the lower space of the disposition portion of the cold sink 120 inside the thermoelectric element module accommodation portion 53 from the power source portion, a gradient surface installation portion 537-2 that extends from the inflow portion 537-1, is laid on the surface of the slope for drain 535 or partially or entirely embedded in the surface thereof, and a drain hole disposition portion 537-3 that is connected to the gradient surface installation portion and extends and is disposed in the drain hole 536.

In particular, various modification examples of the layout design features of the gradient surface installation portion 537-2 are possible. In a case of the heating wire, exposure of at least a portion of the heating wire on the surface of the slope for drain is more effective in preventing freezing of the defrost water than the form embedded in the member of the thermoelectric element module accommodation portion 53. However, it is possible to modify various layout designs within a range that prevents the heating wire exposed to the surface of the slope for drain from causing water ponding or the like with respect to a path through which the defrost water flows down along the gradient.

On the other hand, it is advantageous that the area of the slope for drain covered by the gradient surface installation portion 537-2 is disposed entirely on the slope for drain disposed on the rear side of the absorption portion without providing immediately below the cold sink 120 of the thermoelectric element module 100.

The inflow portion 537-1 of the heating wire is provided on the side of the sensor installation portion which is provided on one side of the thermoelectric element module accommodation portion 53. The wiring of the power supplied to the heating wire may be connected to a sensor which is installed on the sensor installation portion and a lead wire supplied to the thermoelectric element 130 to supply power.

The period for supplying power to the heating wire is kept longer than the time for applying power to the thermoelectric element 130 in the second direction for defrosting the cold sink 120. In other words, when the thermoelectric element surface which is in contact with the cold sink by applying power to the thermoelectric element in the second direction becomes the heat generation surface, the freezing water adhering on the cold sink 120 is gradually melted by such heat. Heat conduction also takes time between the surface of the heat exchanger pin 122 of the cold sink 120 and the surface of the thermoelectric element and it takes time to dissolve the freezing water adhering to the heat exchanger pin 122. Also, it takes time for the melted defrost water to flow down along the heat exchange fin 122.

In addition, even if heat is not generated on the surface of the thermoelectric element which is in contact with the cold sink, a considerable amount of heat is accumulated in the cold sink due to the heat capacity of the cold sink itself. Therefore, defrosting of the freezing water can be continued for a longer time even if the power supply to the thermoelectric element in the second direction is cut off.

Therefore, even if the second direction power source supplied to the thermoelectric element is cut off, the power supplied to the heating wire has to be cut off later than that. If the power supply to the thermoelectric element for the defrosting operation and the power supply for the heating wire are cut off at the same time, there may be a problem that the defrosted water flowing after the shutoff of power is re-frozen on the slope for drain 535.

On the other hand, if power is supplied to the thermoelectric device for defrosting, the defrost water does not fall into the slope for drain as soon as the power is supplied. However, since the surface of the slope for drain 535 is in the deep-temperature freezing environment for a long time and is cooled in a very cold state, the surface of the slope for drain existing at a deep-temperature freezing state has to also be heated. Therefore, when the power supply to the thermoelectric element is started, it is preferable that the power supply to the heating wire is also started. However, when the defrosting starts, the power supply to the thermoelectric element and the heating wire does not have to necessarily be performed at the same time and it may be sufficient when the defrost water drops on the surface of the slope for drain, the deep-freezing condition of the surface of the slop of drain is thawed to some extent and thus the heat generation of the heating wire 537 is progressed so as to prevent re-freezing from occurring.

However, since the timing at which the defrost water drops on the surface of the slope for drain depends on the amount of freezing water, the freezing position of the freezing water, and condition of the freezing water, adhering to the cold sink 120, when at least power supply to the thermoelectric element is started, it is possible to also start power supply to the heating wire together which is the most stable. Of course, it is possible to supply power to the heating wire before the power supply to the thermoelectric element is started. However, since the heat generated from the heating wire is against the deep-temperature freezing environment, it is advantageous in many ways that start times of the power supply for the thermoelectric element and the heating wire substantially correspond with each other.

The drain hole 536 described above is communicated to the defrost water receiver under the evaporator for discharging the defrost water. The drain hole 536 serves not only to discharge the defrost water but also to dissolve the negative pressure that can be strongly generated in the deep-temperature freezing chamber.

As the cooling of the deep-temperature freezing chamber proceeds, the deep-temperature freezing chamber generates a lower pressure, i.e., a negative pressure, than the freezing chamber 40 outside the deep-temperature freezing chamber. Accordingly, when the user desires to open the deep-temperature chamber door 220, such a negative pressure acts on the side where the deep-temperature chamber door 220 is not opened. Furthermore, in order to prevent the cooling air of the deep-temperature freezing chamber from leaking or the heat of the freezing chamber to flow into the deep-temperature freezing chamber, sealing is performed in all of the gaps where the internal space of the deep-temperature freezing chamber can communicate with the outside and thus the deep-temperature freezing chamber has a significantly higher level of sealing structure.

Hereinafter, the sealing structure of the deep-temperature freezing chamber will be briefly described.

FIG. 25 is an enlarged side sectional view illustrating a state where the deep-temperature chamber door is closed in the deep-temperature case.

With reference to FIGS. 16A and 16B, FIGS. 17A and 17B and FIG. 25, as described above, the grille panel assembly 50, more specifically, the grille panel 51 includes the thermoelectric element module element accommodation portion 53 for accommodating the thermoelectric element module assembly 100. The thermoelectric element module accommodation portion 53 is provided in a shape protruding forward from the grille panel 51 and the thermoelectric element module assembly 100 is fitted into the thermoelectric element module accommodation portion 53 from the rear of the grille panel assembly.

A portion of the shroud 56 is superimposed on the rear of the thermoelectric element module accommodation portion 53 of the grille panel 51. More specifically, an abutment surface 561 of the shroud is abutted and fixed to the rear surface of the grille panel 51 surrounding the thermoelectric element module accommodation portion 53. A thermoelectric element module insertion hole 563 is provided around the inner edge of the abutment surface 561 of the shroud and a portion opened by the thermoelectric element module insertion hole 563 becomes a path that communicates with the internal space of the thermoelectric element module accommodation portion 53 from the rear side of the grille panel assembly 50.

The thermoelectric element module assembly 100 described above is fixed to a position where the rear surface of the grille panel 51 and the abutment surface 561 of the shroud 56 overlap each other so that sufficient assembly rigidity can be ensured. According to the present invention, since the grille panel 51 and the abutment surface 561 of the shroud are in contact with each other at the periphery of the thermoelectric element module accommodation portion 53, the interval or gap defined by these abutment surfaces communicates with the thermoelectric element module accommodation portion 53, and consequently, the gap becomes a path which communicates the thermoelectric element module accommodation portion 53 and the general freezing space with each other. Therefore, the gap between the grille panel 51 and the abutment surface of the shroud may be a path through which cooling air in the deep-freezing space flows out into the general freezing space.

Therefore, in the present invention, the first sealing member 61 is pressed and interposed between the rear surface portion of the grille panel 51 around the thermoelectric element module accommodation portion 53 and the abutment surface 561 of the shroud which overlaps the rear surface portion of the grille panel 51. As the sealing material, ethylene propylene diene monomer (EPDM) rubber having excellent sealing performance can be applied. The material of the sealing material may be applied to not only the first sealing material but also the second to fourth sealing materials described below.

On the other hand, since there is a temperature difference of about 30° C. between the deep-temperature freezing space and the general freezing space, the sealing force has to be sufficiently secured. In addition, the sealing structure should not occupy a large internal volume in order to secure the freezing space volume. In view of this, according to the present invention, a rear rib 511 extending rearward from the rear surface of the grille panel 51 is formed. The rear rib 511 is provided on the out periphery of the rear surface of the grille panel 51 slightly spaced from the thermoelectric element module accommodation portion 53.

In addition, the outer peripheral surface of the shroud abutment surface 561 is provided with a rib abutment surface 562 extending rearward so as to be also in contact with the inner surface of the rear rib 511. Accordingly, the shroud abutment surface 561 and the rib abutment surface 562 abut against each other in the form of a letter "L" with the rear surface of the grille panel 51 and the rear rib 511. A second sealing member 62 is similarly pressed and interposed between the rear rib 511 and the rib abutment surface 562.

The sealing structure of the "L"-shaped shape can secure the sealing force even in a narrow space, and according to the characteristics of the step shape, the thermoelectric element module assembly 100 fixed to the rear surface of the shroud abutment surface 561 is assembled easier. In other words, in a case where the outer edge of the flange 112 provided in the module housing 110 of the thermoelectric element module assembly 100 is formed so as to be a certain extent, that is, slightly loosely fitted inside the rib abutment surface 562, when fixing the element module assembly 100 to the grille panel assembly 50, the outer peripheral surface of the flange 112 of the thermoelectric element module assembly 100 is loosely fitted into the step shape portion by the abutment surface 562 and thus it is possible to fix the thermoelectric element module assembly 100 to the grille panel assembly 50 simply by regulating the position of the thermoelectric element module assembly 100 accurately.

On the other hand, gaps may also be generated between overlapping portions where the abutment surfaces 561 of the shroud and the flanges 112 of the module housing 110 are in contact with each other and the cooling air in the deep-temperature freezing space can escape to the general freezing space through such a gap. In view of this, according to the present invention, a third sealing material 63 is interposed between the abutment surface 561 of the shroud and the flange 112 of the module housing 110.

In addition, as described above, the grille panel 51 is provided with the thermoelectric element module accommodation portion 53 protruding forward, and the deep-temperature case 210 defining the overall contour of the deep-temperature freezing chamber 200 is coupled with the element module accommodation portion 53 in a fitted form.

Accordingly, the inner peripheral surface 211*a* of the opening 211 and the outer peripheral surface 534 of the thermoelectric element module accommodation portion 53 are opposed to each other.

The inner peripheral surface 211*a* has a predetermined depth and overlaps with the outer peripheral surface 534 or the thermoelectric element module accommodation portion 53 in a manner to surround the thermoelectric electric module accommodation portion 53. The inner peripheral surface 211*a* and the outer peripheral surface 534 are in close contact with each other with a predetermined pressure.

According to the present invention, a fourth sealing member 64 is pressed in a state of being interposed between the inner peripheral surface 211*a* and the outer peripheral surface 534. When the fourth sealing member 64 is pressed and interposed between the inner peripheral surface 211*a* and the outer peripheral surface 534 while the inner peripheral surface 211*a* and the outer peripheral surface 534 have shapes which are fitted into each other, the deep-temperature case 210 is fastened and fixed to the thermoelectric element module accommodation portion 53 in a forced fit manner. Therefore, according to the present invention, when the fourth sealing member 64 is interposed between the inner peripheral surface 211*a* and the outer peripheral surface 534 and the deep-temperature case 210 is pushed backward, the deep-temperature case and the thermoelectric element module accommodation portion are assembled with each other by being firmly secured to each other and can also prevent the cooling air in the deep-temperature freezing space from flowing out to the freezing chamber.

The structure in which the thermoelectric element module accommodation portion protrudes forward with respect to the grille panel has an effect of ensuring an overlapping range with respect to the deep freezing case as described above and the cold sink of the thermoelectric element module assembly is disposed close to the deep-temperature freezing space, thereby preventing cold loss.

Since the space between the outer case 213 and the inner case 214 of the deep-temperature case 210 defining the rear surface and the upper and lower left and right surfaces of the deep-temperature freezing space is filled with the heat insulating material 80 as described above, it is possible to prevent the heat exchange from occurring between the deep-temperature freezing space and the freezing chamber.

Meanwhile, the deep-temperature chamber door 220, which shields an opened front side of the deep freezing case 210, is also filled with a heat-insulating material 80 such as the foam insulation material 81 to prevent heat exchange between the deep-temperature freezing space and the freezing chamber. However, since the deep-temperature freezing door 220 opens and closes the front of the deep-temperature case, a gap may be formed between the deep-temperature freezing door 220 and the front end of the deep-temperature case 210 and heat in the freezing chamber may be introduced into the deep-temperature case or a cooling air in the deep-temperature case may be escaped to the freezing chamber, through the gap.

In view of this, in the present invention, a gasket 65 made of a silicone material is provided at the outer edge of the rear surface of the deep-temperature freezing door 220 so as to be in close contact with the front surface of the deep-temperature case.

As described above, the inside of the deep-temperature freezing chamber is surely sealed with the outer space by the sealant 60 and the gasket 65. Therefore, a negative pressure may be formed inside the deep-temperature freezing chamber which is cooled to a temperature lower than the ambient temperature. This negative pressure acts as a significant resistance to opening the deep-temperature freezing chamber.

Generally, the generation of such a negative pressure in the refrigerator occurs immediately after the door in a state of being opened is closed, and then gradually disappears. In a case of a refrigerator of the related art, the internal space of the refrigerator is manly made by the refrigeration cycle cooling device 70. This method is a method in which the air in the refrigerating chamber and the freezing chamber flows into the cooling chamber in which the evaporator 77 is located, is cooled, and then is circulated and thus air is circulated and cooled. Thus, the refrigerating and freezing chambers are not completely enclosed but are partially in communication with other spaces. Therefore, when the door is opened, the outside air enters the freezing chamber, and after the door of the freezing chamber is closed, the air is immediately cooled, and thus the volume of the freezing chamber is reduced, so that the negative pressure is generated, and the negative pressure is slowly dissipated due to the structure communicated with other spaces.

However, in a case of the deep-temperature freezing chamber applied in the embodiment of the present invention, since the inside air is cooled through the thermoelectric element, according to the characteristics of the freezing method, unlike typical refrigerators, there is no need that the inside of the deep-temperature freezing chamber communicates with the other space. Therefore, in a case of the deep-temperature freezing chamber according to the embodiment of the present invention, it may be difficult to solve after the negative pressure is generated, and a structure capable of eliminating such negative pressure is required.

In the present invention, a separate negative pressure relieving structure is not added, and the drain hole 536 which becomes a path communicating a space inside the deep-temperature freezing chamber 200 and the thermoelectric element module accommodation portion 53 and a space in which the evaporator 77 is provided can be used as the negative pressure relieving structure.

However, if the flow cross-sectional area of the drain hole 536 is too large, there is a side effect that the outside air is introduced therein through the drain hole 536 to increase the temperature of the deep-temperature freezing chamber.

The shape of the flow cross-section of the drain hole 536 may vary, but a cross-section corresponding to a circle having a diameter of about 6ϕ (Diameter 6 mm) has to be secured and the cross-sectional area can be made less than the cross-sectional area of about 10ϕ. If the flow cross-section of the drain hole does not have a space corresponding to the circle of 6ϕ, the surface tension of the defrost water becomes large, so that the defrost water does not flow down which adhering to the inner surface of the drain hole and is frozen, resulting in a problem that the drain hole is clogged. In addition, if the flow cross-sectional area is 6ϕ or less, the effect of resolving the negative pressure inside the deep-temperature freezing chamber may be insignificant. On the other hand, if the flow cross-sectional area is widened to 10ϕ or more, it adversely affects the maintenance of the deep-temperature freezing state.

Figure 27A:
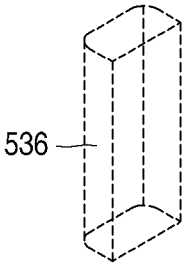

The flow cross-sectional shape of the drain hole 536 according to the present invention illustrated in the preceding figure is as illustrated in FIG. 27A. In other words, the grille panel defines the three sides of the rectangle rounded corners and the shroud defines a remaining side of the rectangle. The shape of the drain hole can be variously modified.

Figure 27B:
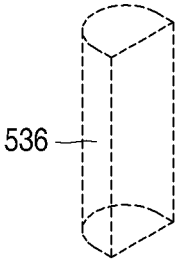

In FIG. 27B, another drain hole which has a cross-sectional shape of 10ϕ or less while securing a flow cross-section corresponding to a circle having a cross-section of 6ϕ and has a different cross-sectional shape is obtained. In another drain hole, also the grille panel defines the three sides of the rectangle rounded corners and the shroud defines a remaining side of the rectangle. In other words, the shape of the cross-section of the drain hole can be variously modified if the drainage can smoothly take place. The sectional shape of the drain hole may also be determined in consideration of ease of manufacture of the grille panel and shroud.

Figure 27C:
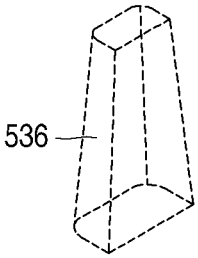
Figure 27D:
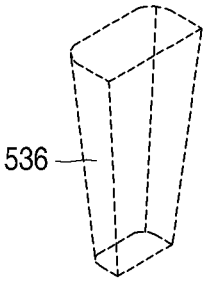

The cross-sectional shape and the cross-sectional area of the drain hole need not be uniform, in the up and down direction, that is, need not be the column shape as illustrated in FIG. 27A and FIG. 27B. It is also possible to have a configuration in which the cross-sectional area gradually increases toward the bottom as illustrated in FIG. 27C or the cross-sectional area gradually decreases toward the bottom as illustrated in FIG. 27D. However, even if the flow cross-sectional area varies along the up and down direction, a flow cross-section corresponding to a circle having a cross-section of 6ϕ is secured and the smallest cross-sectional area among the varying flow cross-sectional areas is preferably 10ϕ or less.

Although not illustrated, the shape of the drain hole can be variously modified.

According to the defrost structure and defrost control method of the present invention, the structure for defrosting is used together with the structure for relieving the negative pressure of the deep-temperature freezing chamber, so that the structure is simple and it is possible to eliminate the freezing water generated in the cold sink and to eliminate the negative pressure of the deep-temperature refrigerator while minimizing the effect of the deep-temperature freezing chamber on the cryogenic refrigeration environment.

According to the embodiment of the present invention described above, the area where defrosting is to be performed in the deep-temperature freezing chamber can be referred to as a portion of the cold sink 120. Since the cold sink 120 is generally made of aluminum or an aluminum alloy having a high thermal conductivity, a position at which freezing occurs also becomes a cold sink portion.

As described above, the deep-temperature freezing chamber 200 of the present invention includes the deep freezing case 210, the deep-temperature chamber door 220 and a deep-freezing tray 226 which is installed in a rear side of the deep-temperature freezing door 220, moves in the front and rear direction along with the deep-temperature freezing door and pulls in and pulls out of the inner space of the deep-temperature case.

In order to minimize the generation of freezing in the deep-temperature freezing space, it is preferable that all of the components located inside the deep-temperature freezing chamber 200 avoid metallic materials having high thermal conductivity. On the other hand, since the deep-temperature tray must be pulled in and pulled out to the deep-temperature case, a structure capable of guiding such sliding movement in the front and rear direction is required.

In the simplest structure, a rail guide is provided on the left or right side or bottom surface of the deep-temperature tray, and a rail for guiding the rail guide to the left or right or bottom of the inner wall of the deep-temperature freezing chamber is formed. However, in the cryogenic environment, since the hardness of the synthetic resin increases and the brittleness increases, the rail guide and the rail of the synthetic resin material move relative to each other, and the breakage of the rail guide and the rail may easily occur even in a small impact. It is preferable that the material for guiding such relative movement is made of a metallic material which can ensure the operation reliability and durability. However, it is very difficult to apply metallic rail guides and rails inside the deep-temperature freezing chamber because it is very difficult to remove the freezing water on the rail guides and rail surfaces. Therefore, it is preferable that a structure in which metallic rail guides and rails are installed in the deep-temperature freezing chamber is avoided.

In addition, in a case where the rail and the rail guide structure are applied to the inside of the deep-temperature freezing chamber, there is a problem that the volume inside the deep-temperature freezing chamber is reduced.

In view of the points described above, according to the present invention, as illustrated in 26, it is preferable that an outer rail 215 made of a metal is installed on the bottom portion of the deep-temperature case and an outer rail guide 221 made of a metal is installed in a lower portion of rear surface of the deep-temperature chamber door 220. With such a structure, the operation of pulling in and pulling out the deep-temperature tray 226 can be supported by the outer rail 215 and the outer rail guide 221.

According to the present invention, an outer rail guide 221 having a shape extending backward and made of a metallic material is provided at the lower portion of the rear surface of the deep-temperature freezing door 220. The rail guide 221 is mounted on the lower portion of the deep-temperature case 210, that is, the lower surface of the outer case 213, and an outer rail 215 is installed in which the rail guide 221 is seated and which slidingly guides the rail guide back and forth. As described above, the rail guide 221 and the outer rail 215 are disposed outside the deep-temperature freezing space, that is, in a space of the freezing chamber, and may be made of a metallic material having high rigidity.

In the embodiment of the present invention, the thermoelectric element module assembly 100 is exemplified as a structure that is behind the deep-temperature freezing chamber 200 which is disposed behind the freezing chamber 40. However, the thermoelectric element module assembly 100 is not necessarily limited to such a position. For example, the thermoelectric element module assembly 100 may be embedded in the upper portion of the inner case 12 of the freezing chamber so as to be positioned above the deep-temperature freezing chamber 200. The heat sink 150 of the thermoelectric element module assembly 100 does not necessarily need to be in contact with air in that the refrigerant of the refrigeration cycle cooling device 70 of the refrigerator flows into the heat sink to cool by heat conduction. Accordingly, the thermoelectric element module assembly 100 may be embedded in the upper portion of the inner case 12 of the freezer room.

While the present invention has been particularly illustrated and described with reference to exemplary embodiments thereof, it is to be understood that the scope of the invention is not limited to the disclosed embodiments. It is apparent that various modifications can be made by a person skilled in the art within the scope of the technical idea of the present invention. In addition, although the embodiments of the present invention have been described above and the effects of the present invention are not explicitly described and explained, it is needless to say that the effects that can be predicted by the configurations also have to be recognized.

Hereinafter, a structure of a refrigerator according to another embodiment of the present invention will be described.

In the description of other embodiments of the present invention, the same reference numerals are used for the same components as those of the embodiment described above and a detailed description thereof will be omitted.

FIG. 28 is a perspective view of the thermoelectric element module assembly according to another embodiment of the present invention as viewed from the front. FIG. 29 is an exploded perspective view of the coupling structure of the thermoelectric element module assembly as viewed from the front.

As illustrated in the figure, a thermoelectric element module 100 according to another embodiment of the present invention includes a thermoelectric element 130, a cold sink 120, a heat sink 300, a heat insulating material 140, and a module housing 110.

Since the thermoelectric element module assembly 100 is inserted and fixed from a rear side to a front side of the grille panel assembly 50 and the deep-temperature freezing chamber 200 is provided in front of the thermoelectric element module assembly 100, the thermoelectric element module assembly 100 is configured that the heat absorption is generated at a surface forming a front side of a thermoelectric element, that is, a surface facing the deep-temperature freezing chamber 200 and the heat generation is generated at a surface forming a rear side of the thermoelectric element, that is a surface facing away from the deep-temperature freezing chamber 200 or a surface opposite to a direction facing the deep-temperature freezing chamber 200. When current is supplied in the first direction in which heat absorption is generated at the surface facing the deep-temperature freezing chamber on the thermoelectric element and heat generation is generated at the surface which faces the surface facing the deep freezing chamber on the thermoelectric element, the deep-temperature freezing chamber can be frozen.

In the embodiment of the present invention, the thermoelectric element 130 has the same shape as a flat plate having a front surface and a rear surface, the front surface is a heat absorption surface 130*a*, and the rear surface is a heat generation surface 130*b*. The DC power supplied to the thermoelectric element 130 causes a Peltier effect and thereby moves the heat of the heat absorption surface 130*a* of the thermoelectric element 130 toward the heat generation surface 130*b*. Therefore, the front surface of the thermoelectric element 130 becomes a cold surface, and the rear surface thereof becomes a heat generation portion. In other words, it can be said that the heat inside the deep-temperature freezing chamber 200 is discharged to the outside of the deep-temperature freezing chamber 200. The power supplied to the thermoelectric element 130 may be applied to the thermoelectric element through the lead 132 provided in the thermoelectric element 130.

On the front surface of the thermoelectric element 130, that is, the heat absorption surface 130*a* facing the deep-temperature freezing chamber 200, the cold sink 120 contacts and is stacked. The cold sink 120 may be made of a metallic material such as aluminum having a high thermal conductivity or an alloy material. On the front surface of the cold sink 120, a plurality of heat exchange fins 122 extending in the up and down direction are formed to be spaced apart from each other in the lateral direction.

The heat sink 300 is in contact with the rear surface of the thermoelectric element 130, that is, the heat generation surface 130*b* facing the direction in which the deep temperature freezing chamber 200 is disposed. The heat sink 300 is configured to rapidly dissipate or discharge the heat generated on the heat generation surface 130*b* by the Peltier effect and a portion which corresponds to the evaporator 77 of the refrigeration cycle cooling device 70 used for cooling the refrigerator can be configured as the heat sink 300. In other words, when the low-temperature low-pressure liquid refrigerant passing through the refrigerating cycle-type expansion device 75 absorbs heat or evaporates while the heat is absorbed in the heat sink 300, heat generated at the heating surface 130*b* of the thermoelectric element 130 is absorbed or evaporated while being absorbed by the refrigerant in the refrigeration cycle, so that the heat of the heat generation surface 130*b* can be cooled instantaneously.

Since the cold sink 120 and the heat sink 300 described above are stacked to each other with the flat thermoelectric element 130 therebetween, it is necessary to isolate the heat between the cold sink 120 and the heat sink 300. Accordingly, the thermoelectric element module assembly 100 according to the present invention includes a heat insulating material 140 that surrounds the thermoelectric element 130 and fills a gap between the heat sink 300 and the cold sink 120. In other words, the area of the cold sink 120 is larger than that of the thermoelectric element 130 and is substantially the same as the area of the thermoelectric element 130 and the heat insulating material 140. Similarly, the area of the heat sink 300 is larger than that of the thermoelectric element 130 and the areas of the thermoelectric element 130 and the heat insulating material 140 are substantially the same.

On the other hand, the sizes of the cold sink 120 and the heat sink 300 are not necessarily equal to each other and it is possible to configure the heat sink 300 to be larger in order to effectively discharge heat.

However, according to the present invention, the refrigerant in the refrigeration cycle cooling device 70 flows through the heat sink so that the heat discharge efficiency of the heat sink 300 can be instantly and surely achieved, the flow path of the refrigerant is disposed across all area of the heat sink, and thus the refrigerant evaporates in the heat sink to absorb heat quickly from the heat generation surface of the thermoelectric element 130 as vaporizing heat. In other words, the size of the heat sink 300 illustrated in the present invention is designed to have a size enough to immediately absorb and discharge heat generated by the thermoelectric element 130, and the cold sink 120 is designed to have a size which is smaller than that of the heat sink. However, in the present invention, considering the fact that the cold sink 120 is heat exchanged between gas and solid, while the heat sink 130 is heat exchanged between liquid and solid, the size of the cold sink 120 further increases and thus it should be noted that the heat exchange efficiency on the side of the cold sink 120 also increases. In order to increase the size of the cold sink 120, in the embodiment of the present invention, although it is described that the cold sink 120 is designed to a size corresponding to the heat sink 130 as an example by considering compactness of the thermoelectric element module assembly 100, the cold sink 120 may be configured to be larger than that of the heat sink 130 in order to further increase heat exchange efficiency of the cold sink 120 portion.

Meanwhile, the module housing 110 is formed so that the thermoelectric element module assembly 100 is accommodated therein, is fixedly mounted on the grille panel assembly 50 and provides the fixing and the mounting of the thermoelectric element module assembly 100 and a structure which can effectively supply a cooling air to deep-temperature freezing chamber 200.

The module housing 110 includes an accommodation groove 114. The accommodation groove 114 may provide a space in which the components constituting the thermoelectric element module assembly 100 are accommodated. The accommodation groove 114 is opened toward the deep-temperature freezing chamber 200 and the front surface of the accommodation groove 114 can be airtight by the thermoelectric element module assembly 100 being mounted on the grille panel assembly 50. Therefore, the cooling air generated at the cold sink 120 can be effectively supplied to the inside of the deep-temperature freezing chamber 200 and the heat sink 300 can be exchanged heat by the evaporator 77 without affecting the temperature of the deep temperature freezing chamber 200 and the inside of the refrigerator.

A fixing boss 114*a* may be formed on the inner side of the accommodation groove 114. The fixing boss 114*a* may extend through the heat sink 300, the heat insulating material 140, and the cold sink 120. An opening is formed in the extended end of the fixing boss 114*a* and the inside thereof is hollow so that the fixing member 114*b* passing through the cold sink 120 can be fastened to the opening of the fixing boss 114*a*. At this time, the fixing member 114*b* may be a screw, a bolt, or a corresponding structure that is fastened to the fixing boss 114*a*.

In addition, a rim hole 115 through which the refrigerant inflow pipe 360 and the refrigerant outflow pipe 370 pass may be further formed at the rim of the accommodation groove 114. A pair of the rim holes 115 may be formed to be spaced apart from each other so that the refrigerant inflow pipe, the refrigerant outflow pipe 370, the lead 132 of the thermoelectric element module 130 can be accessed together. In addition, the rim hole 115 may be formed to open at least a portion of the periphery of the accommodation groove 114 and may be opened toward the evaporator 77. Therefore, the refrigerant inflow pipe 360 and the refrigerant outflow pipe 370 can be easily connected to each other at a position adjacent to the evaporator 77.

A flange 112 is formed around the opened end of the accommodation groove 114 and the flange 112 can be coupled with the shroud 56 or the grille panel 51 in a close contact state. The flange 112 can block leakage of cooing air through surface contact with the shroud 56 or the grille panel 51 and can support so that the front surface of the thermoelectric element module assembly 100 is stably seated on the grille panel assembly 50.

Housing coupling portion 117 may be formed on both sides of the flange 112. The housing coupling portion 117 may be configured to be coupled to one side of the grille panel 51 or the shroud 56 by a coupling member such as a screw. The module housing 110 may be fixedly mounted on the grille panel assembly 50, may be in close contact with the grille panel assembly 50, and leakage of cooling air of the thermoelectric element module assembly 100 and the deep-temperature freezing chamber 200 through a portion at which the flange 112 and the grille panel assembly 50 are in contact with each other can be prevented.

A spacer 111 which extends toward the rear side, that is, the inner case 12 may be provided on the rear surface of the grille panel 51. The spacer 111 may support the module housing 110 so as to keep a state where the module housing 110 may be spaced apart from the inner case 12.

The heat sink 300 may be accommodated in the module housing 110 and then the heat insulating material 140 may be stacked. The heat insulating material 140 has a rectangular frame shape and the thermoelectric element 130 can be disposed therein. Both surfaces of the thermoelectric element 130 are respectively in contact with the heat sink 300 and the cold sink 120 to generate heat in the heat sink 300 and to absorb heat in the cold sink 120 when power is applied thereto.

Meanwhile, the cold sink 120 may be mounted after lamination to the heat insulating material 140. The front surface of the cold sink 120 corresponds to the size of the opening of the accommodation groove 114 and can block the opened surface of the accommodation groove 114.

In addition, an element contacting portion 124 that can be inserted into the thermoelectric element accommodation hole 141 at the center of the heat insulating material 140 may be formed at the rear center of the cold sink 120. The element contacting portion 124 is formed to have a size corresponding to the thermoelectric element accommodation hole 141 to hermetically seal the inside of the heat insulating member 140 and to be in contact with the heat absorption surface 130*a* of the thermoelectric element 130 can be cooled.

The cold sink 120 is coupled to the module housing 110 by fastening the fixing member 114*b* to the fastening holes 123 formed on both sides of the cold sink 120. The element contacting portion 124 of the cold sink 120 is in a close contact with the thermoelectric element 130*a* of the heat sink 130.

Meanwhile, a temperature sensor 125 for sensing the temperature of the cold sink 120 may be provided on a front side of the cold sink 120. The temperature sensor 125 may be fixed to one side of the heat exchange fin 122 by a sensor bracket 126.

The temperature sensor 125 may sense the temperature of the cold sink 120 to control the operation of the thermoelectric element 130. For example, when the reverse voltage is applied to the thermoelectric element 130 during the defrosting operation of the deep-temperature freezing chamber 200, the temperature sensor 125 does not increase the temperature of the cold sink 120 above the set temperature and prevents overheating.

FIG. 30 is a view illustrating a connection state of a refrigerant pipe between the thermoelectric element module assembly and the evaporator.

As illustrated in the figure, the heat sink 300 side of the thermoelectric element module assembly 100 is configured to be cooled using a low-temperature refrigerant flowing into the evaporator 77. In other words, a portion of the refrigerant pipe that is introduced into the evaporator 77 may be bypassed to be introduced into the heat sink 300 for cooling the heat generation surface 130*b* of the thermoelectric element 130.

In more detail, the evaporator 77 may be mounted in a space between the inner case 12 and the grille panel assembly 50. The thermoelectric element module assembly 100 may be fixed to and mounted on the grille panel assembly 50 and the inner case 12 and may be positioned above the evaporator 77.

At this time, the position of the thermoelectric element module assembly 100 is disposed on one side, which is adjacent to the distal end pipe of the evaporator 77, of the left and right sides of the evaporator 77 so as to be easily connected to the evaporator 77 and the pipe assembly 78. In other words, the thermoelectric element module assembly 100 may be disposed adjacent to the ends of the evaporator input pipe 771 and the evaporator output pipe 772 through which the refrigerant flows into the evaporator 77.

A connection work between the thermoelectric element 130 and the evaporator 77 and the piping assemblies 78 is more easily performed by the disposition structure of the thermoelectric element module assembly 100 and the coupling structure of the module housing 110.

The refrigerant inflow pipe 360 and the refrigerant outflow pipe 370 may be formed in a shape bent toward the evaporator input pipe 771 and the evaporator output pipe 772 so as to be easily connected to the evaporator input pipe 771 and the evaporator output pipe 772 of the evaporator 77 side.

Meanwhile, the pipe assembly 78 may be disposed on the outer side of the inner case 12, more specifically on the rear wall surface of the refrigerator main body 10. The pipe assembly 78 includes a compressor connecting portion 783 connected to the compressor 71, a capillary pipe 781 connected to the evaporator input pipe 771, and an output connecting portion 782 connected to the evaporator output pipe 772.

The refrigerant inflow pipe 360 of the thermoelectric element module assembly 100 is welded to the capillary pipe 781 in a state where the evaporator 77 and the thermoelectric element module assembly 100 are fixedly mounted and the refrigerant outflow pipe 370 may be connected to the evaporator input pipe 771 by welding. The evaporator output pipe 772 may be connected to the output connection portion 782 of the pipe assembly 78 by welding.

Looking at the flow path of the refrigerant by such a connection structure of the pipe, the low-temperature refrigerant flowing through the capillary pipe 781 passes through the heat sink 300 and it is possible to cool the heat generation surface 130*b* of the thermoelectric element 130 which is in contact with the heat sink 300. The refrigerant heat-exchanged via the evaporator input pipe 771 through the evaporator 77 flows into the pipe assembly 78 through the evaporator output pipe 772 and the output connection portion 782 and may be supplied to the compressor 71 side along the compressor connecting portion 783 of the pipe assembly 78. The heat sink 300 can be effectively cooled through the bypass of the low-temperature refrigerant flowing into the evaporator 77.

The heat absorption surface 130*a* of the thermoelectric element 130 can be brought into a cryogenic temperature state through the cooling of the heat generation surface 130*b* by the heat sink 300. At this time, the temperature difference between the heat absorption surface 130*a* and the heat generation surface 130*b* may be about 30° C. or more, so that the inside of the deep-temperature freezing chamber 200 can be cooled to a cryogenic temperature of −40° C. to −50° C.

Hereinafter, a structure for defrosting the deep-temperature freezing chamber 200 according to an embodiment of the present invention will be described.

FIG. 31 is a partial perspective view illustrating the disposition of the defrost heater and the defrost water guide according to another embodiment of the present invention.

As illustrated in the drawing, the thermoelectric element module accommodation portion 53 is formed on one side of the grille panel 51. The thermoelectric element module accommodation portion 53 is opened at the rear and a space protruding forward can be formed to accommodate at least a portion of the thermoelectric element module assembly 100.

The thermoelectric element module accommodation portion 53 has a rectangular cross-sectional structure and the cooling fan 190 may be provided therein. The air inside the deep-temperature freezing chamber 200 can be absorbed through the absorption portion 533 by driving of the cooling fan 190 to be cooled by the thermoelectric element module assembly 100 and the cooled air can be supplied inside the deep-temperature freezing chamber 200 through the grill portion 531.

The cooling fan 190 may be configured as a box fan having a shape corresponding to the size of the grill portion 531 and, in a state of being mounted, both left and right sides of the cooling fan 190 are in close contact with the inner surface of the thermoelectric element module accommodation portion 53.

The upper and lower ends of the cooling fan 190 may be positioned at positions corresponding to the ends of the absorption portion 533 formed above and below the grill portion 531. Specifically, the fan support portion 534 may be formed at a lower end of the absorption portion 533 above the grill part 531 and at an upper end of the absorption portion 533 below the grill portion 531. The fan support portion 534 may extend along the upper and lower ends of the absorption portion 533 to be lengthened and can support the upper and lower ends of the cooling fan 190.

Therefore, the cooling fan 190 can keep the fixed state inside the thermoelectric element module accommodation portion 53 and the air absorbed into the absorption portion 533 and the air absorbed into the grill portion 531 is not leaked but can smoothly flow.

The opened rear surface of the thermoelectric element module accommodation portion 53 may be shielded by the cold sink 120 or the module housing 110. At this time, the rear end of the cooling fan 190 is disposed adjacent to the cold sink 120, so that all the air absorbed through the absorption portion 533 can be guided to the cold sink 120 and then can be discharged to the grill portion 531 after being cooled through the cold sink 120.

On the other hand, a defrost heater 230 may be provided on the bottom surface of the thermoelectric element module accommodation portion 53. The defrost heater 230 is heated during the defrosting operation of the deep-temperature freezing chamber 200, thereby heating the internal space the thermoelectric element module accommodation portion 53. In particular, the defrost heater 230 may melt the ice crumb falling from the cold sink 120 daring the defrost operation.

Specifically, when the defrosting operation of the deep-temperature freezing chamber 200 is started, a reverse voltage is applied to the thermoelectric element 130. Accordingly, heat is generated at the heat absorption surface 130*a* and the cold sink 120 contacting the heat absorption surface 130*a* can be heated.

Frost formed on the cold sink 120 and ice generated by growing the frost can be melted by heating the cold sink 120. A lump of ice that is melted due to the heat generated by the cold sink 120 fall on the bottom surface of the thermoelectric element module accommodation portion 53. In a case of a large lump of ice, the lump of ice may not melt due to the heating of the cold sink 120.

Therefore, ice failing on the bottom of the thermoelectric element module accommodation portion 53 can be heated by the defrost heater 230 and melted. The defrost heater 230 may be disposed on the bottom surface 535 of the thermoelectric element module accommodation portion 53 so that the failing ice can be effectively melted and may be disposed to be bent a plurality of times so as to be heated all the bottom surface 535 thereof or at least the lower side of the cold sink.

In addition, the defrost heater 230 may be disposed in a path through which the defrost water is discharged to prevent completely insoluble ice from entering the path and freezing in the path through which the defrost water is discharged.

More specifically, the defrost heater 230 may include an input portion 231 and an output portion 232, an accommodation portion heating portion 233, and a guide heating portion 234.

The input portion 231 and the output portion 232 are connected to an electric wire for supplying power to the defrost heater 230 and can extend from the outside of the thermoelectric element module accommodation portion 53 toward the inside of the thermoelectric element module accommodation portion 53. The accommodation portion heating portion 233 extends from the input portion 231 and the output portion 232 and is connected to each other and can be formed to be bent many times so as to be disposed over the entire bottom surface of the thermoelectric element module accommodation portion 53 or over all the specific area. The guide heating portion 234 is formed so that a portion of the accommodation portion heating portion 233 is bent and inserted into the defrost water guide 240 to be described below.

The guide heating portion 234 may extend from the upper side of the defrost water guide 240 to the lower end of the defrost water guide 240. The guide heating portion 234 extends from the upper end of the defrost water guide 240 to the lower end of the defrost water guide 240 and then is bent at the lower end of the defrost water guide 240 to extend to the upper end of the defrost water guide 240. Therefore, the entire space of the defrost water guide 240 can be heated by the guide heating portion 234 and it is possible to prevent the freezing of the inside of the defrost water guide 240 or the clogging of the inside of the defrost water guide 240 by ice.

Of course, the defrost heater 230 may include an input portion 231, an output portion 232, and an accommodation portion heating portion 233 except for the guide heating portion 234. In this case, the defrost heater 230 may be configured to intensively heat the bottom surface 535 of the thermoelectric element module accommodation portion 53.

In addition, a defrost water guide 240 for discharging the defrost water generated during the defrosting operation of the deep-temperature freezing chamber 200 may be provided at the lower end of the opened surface of the thermoelectric element module accommodation portion 53. The defrost water guide 240 is configured to discharge defrost water generated during the defrosting operation of the deep-temperature freezing chamber 200.

The defrost water guide 240 is configured to communicate the internal space of the thermoelectric element module accommodation portion 53 with the rear surface of the grille panel assembly 50, more specifically, the rear surface of the shroud 56. Therefore, the defrost water in the thermoelectric element module accommodation portion 53 can be discharged to the space behind the shroud 56, that is, the space in which the evaporator 77 is accommodated.

On the other hand, the bottom surface 535 of the thermoelectric element module accommodation portion 53 may be inclined to effectively discharge the defrost water. The bottom surface 535 of the thermoelectric element module accommodation portion 53 may be formed to be inclined toward the defrost water guide 240.

The defrost water guide 240 is formed at the lower end of the opening of the thermoelectric element module accommodation portion 53 and may be located at the center thereof. Accordingly, the bottom surface 535 of the thermoelectric element module accommodation portion 53 may include a first inclined surface 535*a*, a second inclined surface 535*b*, and a third inclined surface 535*c*.

The first inclined surface 535*a* is formed to have an inclination from the front end to the rear end of the thermoelectric element module accommodation portion 53. The second inclined surface 535*b* and the third inclined surface 535*c* may extend toward the center from the left end and the right end of the thermoelectric element module accommodation portion 53, respectively. Both left and right ends of the first inclined surface 535*a* may be in contact with the second inclined surface 535*b* and the third inclined surface 535*c* the lowest portion among the extended end portions of the first inclined surface 535*a*, the second inclined surface 535*b*, and the third inclined surface 535*c* are communicated with the opened upper surface of the defrost water guide 240 and thus the defrost water in the thermoelectric element module accommodation portion 53 can be smoothly discharged.

In other words, the inside lower surface of the thermoelectric element module accommodation portion 53 may be inclined, and an inclined surface may be formed toward the entrance of the defrost water guide 240 and thus water inside the thermoelectric element module accommodation portion 53 can be directed toward the defrost water guide 240 side.

FIG. 32 is an exploded perspective view illustrating a coupling structure of the defrost water guide. FIG. 33 is a partial perspective view illustrating a coupling structure of the grille panel assembly and the defrost water guide.

Referring to the drawings, a guide mounting portion 536 for mounting a defrost water guide 240 may be formed at a lower opening of the thermoelectric element module accommodation portion 53. The defrost water guide 240 may be recessed from the rear surface of the grille panel 51 and extend vertically so as to pass through the center of the thermoelectric element module accommodation portion 53. The guide mounting portion 536 is formed to have a width and a thickness corresponding to the defrosting water guide 240 so that interference between the defrosting water guide 240 and other structures can be prevented when the defrosting water guide 240 is mounted and the defrost water guide 240 can be fixed firmly.

More specifically, the guide mounting portion 536 may be recessed from the rear surface of the grille panel 51 and may be formed so as to be in contact with both left and right side surfaces and the rear surface of the defrost water guide 240.

An accommodation portion discharge port 536*a* may be formed at the upper end of the guide mounting portion 536. The accommodation portion discharge port 536*a* is opened at the bottom surface of the thermoelectric element module accommodation portion 53 and can communicate with the opened upper surface of the defrost water guide 240. At this time, the accommodation portion discharge port 536*a* may be formed to be somewhat smaller than the opened top surface of the defrost water guide 240. Therefore, the upper portion of the defrost water guide 240 may be restrained to the guide mounting portion 536 in a state where the defrost water guide 240 is mounted on the guide mounting portion 536.

On the other hand, the guide mounting portion 536 may be provided with a mounting portion restraining groove 536*b*. The mounting portion restraining groove 536*b* is formed below the accommodation portion discharge port 536*a* and has a size corresponding to the corresponding position so that the guide restraining protrusion 244 protruding from the upper end of the defroster water guide 240 can be inserted. Of course, the mounting portion restraining groove 536*b* and the guide restraining protrusion 244 may be formed to be displaced from each other such that the defrost water guide 240 can be fixed in the guide mounting portion 536.

A mounting restraining protrusion 536*c* may be formed below the guide restraining groove 245. The mounting portion restraining protrusion 536*c* is formed at the opened front end of the guide mounting portion 536 and can protrude in the opposite directions on both left and right sides. Therefore, when the defrost water guide 240 is mounted on the guide mounting portion 536, the defrosting water guide 240 is inserted into the guide restraining groove 245 formed in the defrost water guide 240 and the defrost water guide 240 Can be further fixed.

In other words, the upper end of the defrost water guide 240 is restrained at the lower end of the accommodation portion discharge port 536*a* in a state where the defrost water guide 240 is mounted on the guide mounting portion 536 and the guide restraining protrusion 244 is inserted into the mounting portion restraining groove 536*b* and the mounting portion restraining protrusion 536*c* is restrained by the guide restraining groove 245 so that the defroster water guide 240 can be restrained in multiple and thus the defrost water guide can be kept in a robust mounting state.

Meanwhile, the defrost water guide 240 guides the defrost water in the thermoelectric element module accommodation portion 53 to the rear side of the shroud 56 and may be formed to be lengthened in the up and down direction.

The defrost water guide 240 includes generally a front surface 241, a left side surface 242 and a right side surface 243 and the rear surface and the upper and lower surfaces thereof may be opened. The length of the defrost water guide 240 extending in the up and down direction may be longer than the length of the guide mounting portion 536. The defrost water guide 240 may have a length that allows the lower end of the defrost water guide 240 to protrude through the through-hole 561 of the shroud 56 in a state where the defrost water guide 240 is mounted on the guide mounting portion 536.

The front surface 241 of the defrost water guide 240 includes an extension portion 241*a* extending downward from the upper end and a rounded portion 241*b* rounded from the end of the extension portion 241*a* to the lower end.

The lower end of the extension portion 241*a* may extend to the through-hole 561 of the shroud 56. The rounded portion 241*b* may be rounded rearward at a lower end of the extension portion 241*a* so that the front surface 241 has a predetermined curvature toward the rear.

The defrost water guided through the defrost water guide 240 is moved downward along the extension portion 241*a* and is guided from a point passing through the shroud 56, that is, a point passing through the through-hole 561 of the shroud 56 by the rounded portion 241*b* to be directed rearward. Accordingly, the defrost water guided to the space in which the evaporator 77 is disposed is discharged toward the evaporator 77 through the defrost water guide 240 and thus the generation of the flowing sound or the dropping sound of the defrost water can be minimized.

A guide-restraining protrusion 244 may be formed at the upper end of the defrost water guide 240. The guide-restraining protrusion 244 is formed along the upper-end circumference of the defrost water guide 240 and has a shape protruding outward. Therefore, when the defrost water guide 240 is mounted on the guide mounting portion 536, it can be inserted forwardly from the rear into the mounting portion restraining groove 536*b*. Due to such a structure, the upper end of the defrost water guide 240 is restrained at three sides and can have a stable restraining structure.

In addition, the guide restraining groove 245 may be formed below the guide restraining protrusion 244. The guide restraining grooves 245 are formed on the left side surface 242 and right side surface 243 of the defrost water guide 240 so that the mounting portion restraining protrusion 536*c* can be received in the process of mounting the defrost water guide 240 on the guide mounting portion 536 and the right side surface 243, respectively and may extend in the front-rear direction. In addition, the guide restraining groove 245 may be formed with a locking portion 245*a* in a protruding state to which the mounting portion restraining protrusion 536*c* is restrained by being engaged in a state where the defrost water guide 240 is fully inserted. Therefore, in a case where the defrost water guide 240 is completely mounted, the mounting portion restraining protrusion 536*c* is positioned inside the guide restraining groove 245 and the restraining protrusion 536*c* is kept in a state of being restrained by the retaining portion 245*a*.

Meanwhile, a lower restraining protrusion 246 may be further formed on the left side surface 242 and the right side surface 243 of the dispenser guide 240. The lower restraining protrusion 246 may be protruded to a position exposed to the outside of the through-hole 561 of the shroud 56 in a state where the defrost water guide 240 is mounted. The lower restraining protrusion 246 may be in contact with the outer surface of the shroud 56. At this time, it is preferable that the lower restraining protrusion 246 is positioned on the left side surface 242 and the right side surface 243 of the defrost water guide at a height corresponding to the rounded portion 241*b* of the defrost water guide 240.

Accordingly, the lower end of the defrost water guide 240 can be restrained by the shroud 56, so that the lower end of the defrost water guide 240, that is, the rounded portion 241*b* can keep a state of protruding through the through-hole 561 of the shroud 56. The defrost water discharged by the defrost water guide 240 can be kept to be in a state of being discharged to the outside of the shroud 56 without flowing into the inside of the shroud 56.

In other words, as illustrated in FIG. 12, in a state where the defrost water guide 240 and the shroud 56 are mounted, the end portion of the defrost water guide 240, that is, only the rounded portion 241*b* protrudes to the outside of the through-hole 561 of the shroud 56 and the remaining portion thereof can be shielded.

The opened rear surface of the defrost water guide 240 can be shielded by mounting the shroud 56. Therefore, when the shroud 56 is mounted, the defrost water guide 240 forms a vertically opened path and the defrost water in the thermoelectric element module accommodation portion 53 can be discharged through the defrost water guide 240 to be discharged to the outside of the shroud 56.

Hereinafter, a structure and an operation state for operation of the deep-temperature freezing chamber 200 capable of realizing such a cryogenic temperature will be described with reference to the drawings.

FIG. 34 is a view illustrating a state where the thermoelectric element module assembly and the grille panel assembly are coupled. FIG. 35 is an enlarged view of portion A of FIG. 34. FIG. 36 is an enlarged view of portion B in FIG. 34.

The deep-temperature case 210 forming the deep-temperature freezing chamber 200 is mounted inside the refrigerating chamber 30. The opened rear surface of the deep-temperature case 210 is in close contact with the front surface of the grille panel 51. The thermoelectric element module assembly 100 and the thermoelectric element module accommodation portion 53 on which the cooling fan 190 is mounted may be inserted through the rear surface of the deep-temperature case 210 and the cooling air can be supplied to the inside of the deep-temperature freezing chamber 200.

Meanwhile, the thermoelectric element module assembly 100 may be disposed behind the cooling fan 190 and may be fixedly mounted on the grille panel assembly 50 and the inner case 12 in a state of being accommodated and assembled in the module housing 110.

In this case, a portion of the thermoelectric element module assembly 100 where cooling air is generated may be disposed inside the deep-temperature freezing chamber 200 and a portion of the thermoelectric element module assembly 100 where heat is generated is provided inside a space in which the evaporator 17 may be accommodated.

By defining a boundary between the deep-temperature freezing chamber 200 and the accommodating space of the evaporator 77 as the extension line $D_L$ of the front surface of the shroud 56, the disposition of the thermoelectric element module assembly is described in more detail.

The heat absorption side of the thermoelectric element module 100 may be disposed at the front side and the heat generation side thereof may be disposed at the rear side with respect to the extension line $D_L$. At this time, the extension line $D_L$ may be a boundary between spaces which the refrigerating chamber 30 and the evaporator 77 are accommodated and may be defined as a rear surface of the grille panel 51 rather than the front surface of the shroud 56.

In other words, the cold sink 120 may be disposed in front of the extension line $D_L$ in a state where the thermoelectric element module assembly 100 is mounted and the rear surface of the cold sink 120 may be disposed on the extension line $D_L$.

Therefore, the entire cold sink 120 where the cooling air is generated is located inside the deep-temperature freezing chamber 200, more specifically, inside the thermoelectric element module accommodation portion 53. Therefore, the cold sink 120 is disposed in a space independent from the heat sink 300 and the cooling air generated from the cold sink 120 can be supplied to the inside of the deep-temperature freezing chamber 200. At this time, in a case where the cold sink 120 is located further rearward, a portion of the cold sink 120 may be out of the area of the deep-temperature freezing chamber 200, and the cooling performance may be deteriorated. In a case where the cold sink 120 is positioned further forward, there is a problem that the volume of the deep-temperature freezing chamber 200 is reduced.

Meanwhile, the heat sink 300, the heat insulation material 140, and the thermoelectric element 130 may be positioned in the rear side with respect to the extension line $D_L$ and the front surface of the heat insulation material 140 which is in contact with the rear surface of the cold sink 120 may be positioned on the extension line $D_L$. The heat insulating material 140 substantially shields the opening on the extension line $D_L$ so that heat transfer between the cold sink 120 and the heat sink 300 can be completely blocked.

The heat sink 300 is disposed in an area where the evaporator 77 is accommodated, that is, an area between the grille panel assembly 50 and the inner case 12 and the refrigerant supplied to the evaporator side cools the heat sink 300. It is possible to maximize the cooling performance of the thermoelectric element 130 through cooling of the heat sink 300 using the low-temperature refrigerant. Meanwhile, the heat sink 300 may further be cooled by the cooling air of the evaporator 77 by the module housing 110 disposed to be spaced apart from the inner case 12.

In this way, the thermoelectric element module assembly 100 dissipates heat in the area where the evaporator 77 is disposed, absorbs heat in the inner area of the deep-temperature freezing chamber 200, and can cool the deep-temperature freezing chamber 200 to a cryogenic temperature state.

On the other hand, during the deep-temperature freezing storage of food using the deep-temperature freezing chamber 200, frost can be generated inside the thermoelectric element module accommodation portion 53 due to moisture introduced therein, in particular, freezing can be intensively generated on the side of the cold sink 120 in which the cooling action is actively generated.

When the frost of the inside of the thermoelectric element module accommodation portion 53 grows, the cooling air cannot be smoothly supplied into the deep-temperature freezing chamber 200 and the heat exchange performance of the cold sink 120 may be deteriorated due to the frost formed on the cold sink 120.

Therefore, the deep-temperature freezing chamber 200 performs the defrosting operation to remove the frost of the inside of the thermoelectric element module accommodation portion 53. The defrosting operation of the deep-temperature freezing chamber 200 may be performed together with the defrosting operation of the refrigerator. The defrosting operation of the refrigerator may be started during the defrosting operation of the deep-temperature freezing chamber 200 and the defrosting operation of the deep-temperature freezing chamber 200 may be started during the defrosting operation of the refrigerator. In other words, the defrosting operation of the deep-temperature freezing chamber 200 or the refrigerator is performed at the same time, so that the defrosting operation is not affected by the cooling of the deep-temperature freezing chamber 200 and the storage space inside the refrigerator.

The defrosting operation of the deep-temperature freezing chamber 200 may be performed according to the temperature sensed by the temperature sensor 125. In a case where the temperature rises above the set temperature within the set time, defrosting is performed by determining that the outside air has flowed into the deep-temperature freezing chamber 200 or the load increases. For example, if the temperature sensed by the temperature sensor 125 rises by 10° C. or more within 3 minutes, the defrosting operation is performed after 2 hours elapses. In addition, the temperature sensor 125 may detect the overheating of the cold sink 120 during the defrosting operation and may control the defrosting operation such as stopping the defrosting operation or lowering the temperature.

When the defrosting operation of the deep-temperature freezing chamber 200 is performed, the defrosting operation of the refrigerator is performed. Then, the cooling fan 190 is stopped to block the supply of the heated air into the deep-temperature freezing chamber 200.

A reverse voltage is supplied to the thermoelectric element 130 during the defrosting operation of the deep-temperature freezing chamber 200 so that the heat absorption surface 130*a* of the thermoelectric element 130 is heated and the cold sink 120 thereof is heated. The frost and the frozen ice in the cold sink 120 drop onto the bottom surface 535 of the thermoelectric element module accommodation portion 53 due to the heating of the cold sink 120.

Meanwhile, the reverse voltage is applied to the thermoelectric element 130 and at the same time the operation of the defrost heater 230 also starts. The inside, in particular, the lower surface of the thermoelectric element module accommodation portion 53 is heated, by the operation of the defrost heater 230. Therefore, the ice falling from the cold sink 120 is melted by the heat of the defrost heater 230.

The water melted by the defrost heater 230 is guided toward the defrost water guide 240 and may be discharged to space where the evaporator 77 is accommodated through the defrost water guide 240. At this time, even if there is ice that is not completely melted by the defrost heater 230 inside the defrost water guide 240, it can be completely melted through the guide heating portion 234 while passing through the defrost water guide 240, and it is possible to prevent freezing of the inside of the defrost water guide 240.

The water generated in the defrosting operation of the deep-temperature freezing chamber 200 flows into the defrost water guide 240 side along the bottom surface 535 of the thermoelectric element module accommodation portion 53. The defrost water can be discharged to the outside of the shroud 56, that is, space where the evaporator 77 is located, through the defrost water guide 240.

The defrost water flowing down along the defrost water guide 240 flows along the rounded portion 241*b* while passing through the shroud 56. The defrost water flows down toward the evaporator 77 by the curved surface of the rounded portion 241*b*.

At this time, the defrosting operation of the refrigerator may also be in operation. Accordingly, the evaporator defrost heater 230 may also be driven, thereby preventing freezing of the surface of the evaporator 77 due to the defrost water.

The water flowing down along the evaporator 77 is collected by the defrost water fan 791 under the evaporator 77 and the defrost water collected in the defrost water fan 791 is discharged to the drain pan provided in the machine room.

What is claimed is:

1. A refrigerator comprising:

a main body defining a storage space;

a freezing chamber defining an insulating space configured to maintain a chamber temperature that is less than a temperature of the storage space;

an evaporator configured to cool the storage space;

a grille panel assembly that defines an evaporator space that accommodates the evaporator and at least a portion of the storage space;

a thermoelectric element assembly that is located at a side of the freezing chamber, the thermoelectric element assembly comprising a thermoelectric element, a heat sink, and a cold sink that is configured to cool the freezing chamber to the chamber temperature;

a module accommodation portion that is located at the grille panel assembly and that accommodates at least a portion of the thermoelectric element assembly; and a defrost water guide that is coupled to a rear side of the grille panel assembly and that extends from the module accommodation portion toward the evaporator space, wherein the grille panel assembly comprises:

a grille panel that defines a rear wall of the storage space, the grille panel defining an inlet port and a discharge port that are configured to pass air, and a shroud that defines a wall surface of the evaporator space, that is coupled to the grille panel, and that is spaced apart from the grille panel to define a flow path configured to pass air, wherein the grille panel comprises a guide mounting portion that is recessed from a rear surface of the grille panel and that is configured to mount the defrost water guide, wherein a rear end of the defrost water guide is flush with the rear surface of the grille panel based on the defrost water guide being mounted on the guide mounting portion, wherein the grille panel further comprises a mounting restraining protrusion that protrudes from a side surface of the guide mounting portion, and wherein the defrost water guide defines a guide restraining groove that is recessed from a side surface of the defrost water guide and that is configured to receive the mounting restraining protrusion.

2. The refrigerator according to claim 1, wherein the defrost water guide is located vertically below the cold sink and configured to discharge defrost water during a defrost operation of the cold sink.

3. The refrigerator according to claim 1, wherein the defrost water guide defines an opening at a rear surface of the defrost water guide, and wherein the shroud covers the opening of the defrost water guide to define a flow path configured to guide defrost water to the evaporator space.

4. The refrigerator according to claim 1, wherein the defrost water guide defines an opening at a rear surface of the defrost water guide, and wherein the shroud is configured to, based on coupling to the grille panel, cover the opening defined at the rear surface of the defrost water guide.

5. The refrigerator according to claim 1, wherein a vertical length of the defrost water guide is greater than a vertical length of the guide mounting portion.

6. The refrigerator according to claim 1, wherein the defrost water guide further defines a locking opening in the guide restraining groove, the locking opening being configured to couple to the mounting restraining protrusion.

7. The refrigerator according to claim 1, wherein a bottom surface of the module accommodation portion is inclined toward the defrost water guide, and wherein the defrost water guide is configured to connect to the bottom surface of the module accommodation portion.

8. The refrigerator according to claim 7, wherein the bottom surface of the module accommodation portion comprises:

a first inclined surface that is inclined with respect to a horizontal plane and that extends in a front-rear direction from a front end of the module accommodation portion to a center of the module accommodation portion;

a second inclined surface that is inclined with respect to the horizontal plane and that extends in a left-right direction from a left end of the module accommodation portion to the center of the module accommodation portion; and a third inclined surface that is inclined with respect to the horizontal plane and that extends from a right end of the module accommodation portion to the center of the module accommodation portion.

9. The refrigerator according to claim 1, wherein the defrost water guide extends from the module accommodation portion to the evaporator space through the shroud.

10. The refrigerator according to claim 9, wherein the shroud defines a through-hole that receives at least a portion of the defrost water guide and that is configured to limit movement of the defrost water guide relative to the shroud, and wherein the defrost water guide comprises a lower protrusion that passes through the through-hole.

11. The refrigerator according to claim 9, wherein the defrost water guide comprises:

an extension portion that extends from the module accommodation portion in a downward direction and that is configured to guide defrost water in the downward direction; and a rounded portion that is curved from an end of the extension portion toward the evaporator and that is configured to guide defrost water to the evaporator, and wherein the rounded portion is located outside of the shroud.

12. The refrigerator according to claim 1, wherein the defrost water guide comprises a lower restraining protrusion that protrudes from the side surface of the defrost water guide and that is disposed vertically below the guide restraining groove.

13. The refrigerator according to claim 12, wherein the shroud defines a through-hole that receives at a lower portion of the defrost water guide and that is configured to limit movement of the defrost water guide relative to the shroud, and wherein the lower restraining protrusion is disposed outside of the through-hole.

14. The refrigerator according to claim 13, wherein the lower portion of the defrost water guide is inclined or curved with respect to the rear surface of the grille panel and extends toward the evaporator.

15. The refrigerator according to claim 1, further comprising a defrost heater that extends along a bottom surface of the module accommodation portion.

16. The refrigerator according to claim 15, wherein the defrost heater is received inside of the defrost water guide and extends vertically from the bottom surface of the module accommodation portion toward the evaporator space.

17. The refrigerator according to claim 15, wherein the shroud defines a through-hole that receives a lower portion of the defrost water guide and that is configured to limit movement of the defrost water guide relative to the shroud, and wherein the defrost heater extends along the defrost water guide and passes through the through-hole.

* * * * *